US007973477B2

(12) United States Patent
Miura et al.

(10) Patent No.: US 7,973,477 B2
(45) Date of Patent: Jul. 5, 2011

(54) PLASMA DISPLAY PANEL HAVING A PHOSPHOR LAYER THAT IS AT LEAST PARTLY COVERED WITH A MATERIAL HIGHER IN SECONDARY ELECTRON EMISSION AND PRODUCTION METHOD THEREFORE

(75) Inventors: Masanori Miura, Osaka (JP); Yukihiro Morita, Osaka (JP); Shinichiro Hashimoto, Osaka (JP); Kyohei Yoshino, Osaka (JP); Junko Matsushita, Osaka (JP); Masashi Goto, Osaka (JP)

(73) Assignee: Panasonic Corporation, Osaka (JP)

( * ) Notice: Subject to any disclaimer, the term of this patent is extended or adjusted under 35 U.S.C. 154(b) by 717 days.

(21) Appl. No.: 11/576,098

(22) PCT Filed: Oct. 5, 2005

(86) PCT No.: PCT/JP2005/018443

§ 371 (c)(1),
(2), (4) Date: Mar. 27, 2007

(87) PCT Pub. No.: WO2006/038654

PCT Pub. Date: Apr. 13, 2006

(65) Prior Publication Data

US 2008/0061692 A1 Mar. 13, 2008

(30) Foreign Application Priority Data

Oct. 5, 2004 (JP) ..... 2004-293040
Jan. 27, 2005 (JP) ..... 2005-020274
Aug. 5, 2005 (JP) ..... 2005-227440

(51) Int. Cl.
*H01J 17/49* (2006.01)

(52) U.S. Cl. ..... 313/582

(58) Field of Classification Search ..... 313/582
See application file for complete search history.

(56) References Cited

U.S. PATENT DOCUMENTS 5,005,951 A * 4/1991 Te Velde ..... 349/143
(Continued)

FOREIGN PATENT DOCUMENTS

JP 5-41164 * 2/1993
(Continued)

OTHER PUBLICATIONS

Soo Gil Kim, Jin Yong Kim, Hyeong Joon Kim, Deposition of MgO thin films by modified electrostatic spray pyrolysis method, Thin Solid Films, vol. 376, Issues 1-2, Nov. 1, 2000, pp. 110-114, ISSN 0040-6090, DOI: 10.1016/S0040-6090(00)01186-X. (http://www.sciencedirect.com/science/article/B6TW0-41H3KJ8-H/2/294c3e53327cd11bcf164304f13b5db1).*

*Primary Examiner* — Toan Ton
*Assistant Examiner* — Britt D Hanley

(57) ABSTRACT

Provided is a PDP in which a weak discharge is always generated in a stable manner to lower the firing voltage, the generation of the reset luminous points is restricted to improve the image quality, and reduction of the luminous efficiency and reduction of the luminance are restricted to improve the luminance. A manufacturing method of the PDP is also provided.

The PDP includes a front panel and a back panel arranged to face each other with a discharge space between the panels. A phosphor layer is provided in an area of the back panel that faces toward the discharge space. Part of the surface of the phosphor layer is covered with a phosphor-coating film as a high γ member. The phosphor-coating film is made of a material having a higher secondary electron emission coefficient than a material of the phosphor layer. The high γ member and the remaining are of the surface of the phosphor layer are exposed to the discharge space.

64 Claims, 26 Drawing Sheets

U.S. PATENT DOCUMENTS

| | | | | |
|---|---|---|---|---|
| 6,346,775 | B1 * | 2/2002 | Lee et al. | 315/169.3 |
| 6,407,509 | B1 * | 6/2002 | Ikeda et al. | 315/169.4 |
| 2001/0050534 | A1 * | 12/2001 | Amemiya et al. | 313/586 |
| 2004/0070341 | A1 * | 4/2004 | Chul Park | |
| 2004/0100893 | A1 * | 5/2004 | Germishuizen et al. | 369/108 |
| 2004/0124775 | A1 * | 7/2004 | Okada et al. | 313/587 |

FOREIGN PATENT DOCUMENTS

| | | | |
|---|---|---|---|
| JP | 6-325696 | * | 11/1994 |
| JP | 7-312177 | * | 11/1995 |
| JP | 8-212929 | * | 8/1996 |
| JP | 11-311975 | * | 11/1999 |
| JP | 2001-28242 | * | 1/2001 |
| JP | 2001-76628 | * | 3/2001 |
| JP | 2002-110046 | * | 4/2001 |
| JP | 2001-222944 | * | 8/2001 |
| JP | 2002-075223 | * | 3/2002 |
| JP | 2003-272530 | * | 9/2003 |
| JP | 2004-134407 | * | 4/2004 |
| JP | 2004-152672 | * | 5/2004 |
| JP | 2004-214049 | * | 7/2004 |
| JP | 2004-220929 | * | 8/2004 |

* cited by examiner

PLASMA DISPLAY PANEL HAVING A PHOSPHOR LAYER THAT IS AT LEAST PARTLY COVERED WITH A MATERIAL HIGHER IN SECONDARY ELECTRON EMISSION AND PRODUCTION METHOD THEREFORE

TECHNICAL FIELD

The present invention relates to a plasma display panel and a manufacturing method thereof.

BACKGROUND ART

Plasma display panel devices (hereinafter referred to as PDP devices), which have been developed into products, are flat surface display devices that use radiations from gas discharges. The PDP devices includes a DC (direct current) type and an AC (alternate current) type. Among such PDP devices, surface discharge AC type PDP devices have high technical potential and are long in life. Here, the structure of PDPs (hereinafter referred to as PDPs) that are panel units of the PDP devices will be described with reference to FIG. 26A. FIG. 26A is a development perspective view (partially sectional view) showing the structure of a conventionally typical surface discharge AC type PDP.

As shown in FIG. 26A, the PDP has a structure in which a front panel 710 and a back panel 720 are arranged to face each other. The front panel 710 includes a front substrate 711, display electrode pairs 712 that are formed on the surface of the front substrate 711, and a dielectric layer 715 and a dielectric protective layer 716 that are formed to cover the display electrode pairs, in the stated order. Each of the display electrode pairs 712 is composed of a scan electrode 713 and a sustain electrode 714 that extend in a form of stripes. The scan electrode 713 is composed of a transparent electrode element 713*a* and a bus line 713*b* that are laminated to each other; and the sustain electrode 714 is composed of a transparent electrode element 714*a* and a bus line 714*b* that are laminated to each other. It should be noted here that the bus lines 713*b* and 714*b* are provided to reduce the high resistance of the transparent electrode elements 713*a* and 714*a*, and are formed to be small in width from a metal material or the like.

The dielectric layer 715 is made of a low-melting point glass, and has a current restriction function that is unique to AC type PDPs. The dielectric protective layer 716 protects the surfaces of the scan electrode 713 and the sustain electrode 714, and has a function to lower the firing voltage by emitting secondary electrons efficiently. As the material of the dielectric protective layer 716, MgO (magnesium oxide), a metal oxide, is widely used since MgO is an optically transparent electrical insulation material that has a high value of the secondary electron emission coefficient γ and has high sputtering resistance.

The back panel 720 is constructed such that a plurality of data electrodes 722 are formed in stripes on a surface of a back substrate 721, and that a dielectric layer 723, which is made of a low-melting point glass, is formed to cover the data electrodes 722 and at least part of a surface of the back substrate 721. Further, on the dielectric layer 723, barrier ribs 724, which are made of a low-melting point glass and have a predetermined height, are formed between adjacent discharge cells (not illustrated), in a form of stripes or parallel crosses (in FIG. 26A, formed in parallel crosses as one example). Also, a phosphor layer 725 is provided inside each dent that is enclosed by the dielectric layer 723 and the barrier ribs 724. One of three colors red, green, and blue, which are the colors of light emitted from the phosphor layers 725, is assigned to each discharge cell.

In manufacturing the PDP, the front panel 710 and the back panel 720 are arranged such that the data electrodes 722 intersect with the scan electrodes 713 and sustain electrodes 714, and the panels are bonded together. In this process, a discharge space 730 is formed between the front panel 710 and the back panel 720. Then, the air remaining therein and impurity gas are exhausted from the space, and a rare gas such as a mixture of xenon (Xe) and neon (Ne) or a mixture of xenon (Xe) and helium (He) is filled in the discharge space 730 as a discharge gas. The rate of partial pressure of Xe to the total pressure of the discharge gas is set to be in a range of 5(%) to 6(%). The filling pressure (total pressure) is set to approximately several tens (kPa). In the PDP, each area where a display electrode pair 712 intersects with a data electrode 722 corresponds to a discharge cell that is a unit of discharge, and a plurality of discharge cells are arranged in a matrix.

A PDP device is composed of the PDP with the above-described structure, a drive circuit, and a control circuit, where the PDP is connected to the drive circuit and the control circuit, and the drive circuit drives the electrodes 713, 714, and 722 in the form of a matrix, and the control circuit controls these components. The AC type PDPs are driven by a drive method that includes the following steps:

(1) the reset period in which all the display cells are reset;
(2) the write period in which each discharge cell is addressed, and display states are selected and input into each cell depending on the input data; and
(3) the sustain period in which discharge cells in the display state are lighted for display.

The scan electrode 713 and the sustain electrode 714 of the front panel 710 are used for direct lighting for display, and the data electrodes 722 are used for selecting discharge cells that are to be lighted for display, and the data electrodes 722 do not directly contribute to the lighting. In the write period (2) above, the write data is input using the data electrodes 722 of the back panel 720, and the wall charge is formed on the surface of the dielectric protective layer 716 of the front panel 710, facing thereto.

In the sustain period (3) above, voltage pulses (for example, with a rectangular wave voltage of approximately 200 (V)) are respectively applied to the scan electrode 713 and the sustain electrode 714 in each display electrode pair 712 such that these pulses are different from each other in the phase. That is to say, in the sustain period, by applying an AC voltage between the electrodes in each display electrode pair 712, it is possible to cause the discharge cells, in which the display state has been written, to generate a pulse discharge each time the voltage polarity changes. The generation of such sustain discharges causes resonance lines of 147 (nm) to be emitted from the excited Xe atoms and causes molecular beams of 173 (nm) to be emitted from the excited Xe molecules in the discharge spaces 30, as the display light emission.

The ultraviolet rays generated by this are converted into visible light by the phosphor layers 725 of the back panel 720, which enables the visible light to be obtained. Here, in the discharge cells where the wall charge has not been written to the dielectric protective layer 716, the sustain discharge is not generated even if the AC voltage is applied in the sustain period, and the display state therein becomes black. It should be noted here that in the AC type PDPs, generally, a pixel being a unit of display is composed of three discharge cells having respectively phosphor layers 725 of red, green, and blue, as units of display discharges.

In conventional technologies, to improve the contrast ratio, a weak discharge (reset discharge) is generated in a stable manner during the reset period in which the wall charge distribution of all the display cells is reset, among the three operation periods in the PDPs. Typically, a high voltage with a ramp waveform, which represents voltage/time and rises and falls with a slow slant, is applied between the scan electrode 721 and the data electrode 722 of the back panel 720 so as to cause a small discharge current to flow constantly so that a weak discharge is generated in a stable manner.

The discharge generated when the rising ramp waveform voltage is applied during the reset period is a discharge generated when the data electrode 722 or the phosphor layers 725 side having a small value of the secondary electron emission coefficient γ becomes a cathode. For this reason, the firing voltage for the discharge increases. This causes the weak discharge unstable, and makes a strong discharge apt to be generated. This causes a problem that an erroneous light emission (hereinafter referred to as reset luminous point) occurs during the reset period, irrelevant to displaying of image.

In conventional technologies, to generate the weak discharge in a stable manner during the reset period, the surfaces of the phosphor layers 725 are improved in quality. It is considered that by improving the quality of the surfaces of the phosphor layers 725, the firing voltage for when the phosphor layers 725 side becomes a cathode in the reset period is lowered, and this causes the weak discharge to be generated in a stable manner, providing a write control that is accurate enough to restrict the occurrence of the reset luminous points.

Meanwhile, it has been proposed in the development of PDP that the rate of partial pressure of Xe to the total pressure of the discharge gas be increased (for high Xe) to improve the luminous efficiency and luminance. However, if the rate of partial pressure of Xe to the total pressure of the discharge gas is increased, the luminous efficiency is improved, but the firing voltage increases, and when the ramp waveform is applied during the reset period, the weak discharge is generated in an unstable manner, and an accurate reset becomes impossible. This is a critical problem. That is to say, in high-Xe PDPs, the voltage applied at the start of the discharge becomes large, and the discharge delay becomes large. When these happen, the reset discharge generated is apt to be a strong discharge instead of a weak discharge, an inaccurate amount of wall charge moves, reset luminous points occur, and a black display portion of the PDP is lighted to be a white display, and the display becomes inaccurate.

In a proposed conventional technology, all areas of the phosphor layers 725, barrier ribs 724, and back panel 20 that face toward the discharge spaces 730 are covered with a layer of a material that has a high value of the secondary electron emission coefficient γ to decrease the drive voltage, reduce the loss of charged particles on the side surfaces of the barrier ribs 724 or the surface of the phosphor layers 725, and increase the luminous efficiency (see, for example, Document 1).

FIG. 26B is a cross sectional view showing one embodiment disclosed in Document 1. As shown in FIG. 26B, in a back panel 740, all areas of the phosphor layers 725, which have been formed above an inner surface of a back substrate (facing toward the discharge spaces 730), are covered with a phosphor-coating film 746 that is made of a material that has a high value of the secondary electron emission coefficient γ. It should be noted here that in this embodiment, the phosphor-coating film 746 also covers the surface of the barrier ribs 724 so that any area of the surface of the barrier ribs 724 is not exposed to the discharge spaces 730.

In the PDP of Document 1 shown in FIG. 26B, positive wall charges are accumulated on the surface of the phosphor layers 725 in areas near the data electrodes 722, positive ion groups float in the discharge spaces 730 in areas near the data electrodes 722, electric particles having been dispersed in the discharge spaces 730 are lost on the side surfaces of the barrier ribs 724 and the surface of the phosphor layers 725. This adversely influences the luminous efficiency. As a method of solving the problem, Document 1 teaches that a film 746, which is made of a material that has a high value of the secondary electron emission coefficient γ, is formed on areas (surfaces of the phosphor layers 725) in the back panel 740 that face toward the discharge spaces 730, so as to neutralize the floating positive ion groups with the secondary electrons that are released into the discharge spaces 730 when the positive ions bombard the surface of the film 746, thus enhancing the electric field of the discharge spaces 730 such that the next discharge can be generated with low voltage and low power consumption.

It is accordingly considered that the technology of Document 1 can reduce the power of the discharge during the sustain period to a certain extent.

In another conventional technology, a film made of MgO is formed to cover the surface of the phosphor layers 725 to keep the luminance of the PDP for a long time in a stable manner (see, for example, Document 2). This technology adopts a structure in which the surface of the phosphor layers 725 is covered with a film of MgO, which enhances the secondary electron emittance performance and activates the discharge state, and protects the phosphor layers 725 from the sputtering during the discharge. It is accordingly considered that in the PDPs adopting the technology, the luminance can be maintained for a long time in a stable manner.

Document 1: Japanese Patent Application Publication No. 2002-110046

Document 2: Japanese Patent Application Publication No. 08-212929

DISCLOSURE OF THE INVENTION

The Problems the Invention is Going to Solve

However, with the conventional technologies including Documents 1 and 2, it is difficult to stabilize the generation of a weak discharge during the rest period. More specifically, according to the technology of Document 1, all areas of the phosphor layers and barrier ribs that face toward the discharge spaces are covered with a layer of a material that has a high value of the secondary electron emission coefficient γ. It is though that, with such a structure, it is difficult to stabilize the generation of a weak discharge and to restrict the generation of reset luminous points during the reset period. Especially, when the rate of partial pressure of Xe to the total pressure of the discharge gas is increased, it is difficult to stabilize the generation of a weak discharge.

Also, according to the technology of Document 1, the whole surface of the phosphor layers 725 is covered with the film. This causes part of the resonance lines emitted from the excited Xe atoms in the discharge spaces 730 to be absorbed by the film formed on the phosphor layers 725, reducing the amount of resonance lines that reach the phosphor layers 725. It is accordingly estimated that in the PDPs adopting the technology, the luminous efficiency is reduced and the luminance is decreased.

Also, in the PDP of Document 2, a film made of MgO is formed to cover the surface of the phosphor layers 725. It is though that, with such a structure, it is difficult to stabilize the generation of a weak discharge during the reset period.

Also, in the PDP of Document 2, the whole surface of the phosphor layers 725 is covered with a film 746 whose thickness is in a range of 0.5 (μm) to 20 (μm) inclusive. This, as is the case with the PDP of Document 1, causes the resonance lines emitted from the excited Xe atoms in the discharge spaces 730 to be absorbed by the film 746 formed on the phosphor layers 725, which makes the resonance lines difficult to reach the phosphor layers 725, and greatly reduces the luminous efficiency.

It is therefore an object of the present invention to provide a PDP in which a weak discharge is always generated in a stable manner to lower the firing voltage, the generation of the reset luminous points is restricted to improve the image quality, and reduction of the luminous efficiency and reduction of the luminance are restricted to improve the luminance, and to provide a manufacturing method by which the PDP can be manufactured with ease.

Means to Solve the Problems

The above object is fulfilled by a PDP including a first substrate and a second substrate arranged to face each other with a space therebetween, and including a phosphor layer in an area of the first substrate that faces toward the space, wherein part of a surface of the phosphor layer is covered with a high gamma member (hereinafter referred to as high γ member) that is made of a material having a higher secondary electron emission coefficient than a material of the phosphor layer, and the high γ member and a remaining area (namely, each area in which the high γ member is not formed) of the surface of the phosphor layer are exposed to the space.

The above object is also fulfilled by a PDP including a first substrate and a second substrate arranged to face each other with a space therebetween, and including a phosphor layer in an area of the first substrate that faces toward the space, wherein a surface of the phosphor layer is covered with a high γ member being a film that is made of a material having a higher secondary electron emission coefficient than a material of the phosphor layer, and a film thickness of the high γ member is in a range of 1 nm to 10 nm inclusive.

The above object is also fulfilled by a manufacturing method of a PDP that includes a first substrate and a second substrate arranged to face each other with a space therebetween, and includes a phosphor layer in an area of the first substrate that faces toward the space, the manufacturing method comprising the steps of:

forming the phosphor layer on a surface of the first substrate that are to face the second substrate; and forming a high γ member on part of a surface of the phosphor layer, using a material that has a higher secondary electron emission coefficient than a material of the phosphor layer, wherein in the high γ member forming step, the high γ member is formed so that both the high γ member and a remaining area of the surface of the phosphor layer are exposed to the space.

The above object is also fulfilled by a manufacturing method of a PDP that includes a first substrate and a second substrate arranged to face each other with a space therebetween, and includes a phosphor layer in an area of the first substrate that faces toward the space, the manufacturing method comprising the steps of:

forming the phosphor layer on a surface of the first substrate that are to face the second substrate; and forming a high γ member as a film on a surface of the phosphor layer, using a material that has a higher secondary electron emission coefficient than a material of the phosphor layer, wherein in the high γ member forming step, the high γ member is formed so that a film thickness of the high γ member is in a range of 1 nm to 10 nm inclusive.

The above object is also fulfilled by a forming apparatus for forming a high γ member on a surface of a phosphor layer in an area corresponding to a surface of an electrode, using a material that has a higher secondary electron emission coefficient than a material of the phosphor layer, wherein the phosphor layer is formed on a surface of a substrate to cover the electrode formed on the surface of the substrate, the forming apparatus comprising: an electrically charging unit operable to electrically charge the material of the high γ member; a dispersing unit operable to disperse the electrically charged material; and a voltage applying unit operable to apply a voltage to the electrode so that the dispersed material is accumulated on the surface of the phosphor layer unevenly in the area corresponding to the surface of the electrode.

EFFECTS OF THE INVENTION

The inventors of the present invention found that a strong discharge is apt to be generated when the rising ramp waveform, among the ramp waveforms, is applied during the reset period, when PDPs with conventional structures are driven. More specifically, in the reset period, all cells are reset by first applying a rising ramp waveform voltage with a positive slant to the scan electrodes, and then applying a falling ramp waveform voltage. In this reset period, a reset discharge would become unstable and a strong discharge, namely an undesired discharge, would be generated when the rising ramp waveform voltage is applied when the data electrodes or the phosphor layers side having a small value of the secondary electron emission coefficient γ becomes a cathode.

The above-described phenomenon taken into consideration, in the PDP of the present invention, the high γ members are formed to be exposed to the discharge spaces. With this arrangement, the firing voltage, when the ramp waveform is applied and when the phosphor layers side becomes a cathode during the reset period when the PDP is driven, is lowered, which restricts the strong discharge from being generated, and enables the reset discharge to be generated in a stable manner.

Also, in the PDP of the present invention, part of the surface of the phosphor layers is exposed to the discharge spaces. This structure, when the PDP is driven, enables the ultraviolet rays generated in the discharge spaces to enter the phosphor layers without being reduced greatly. The PDP with such a structure can restrict the reduction in the luminous efficiency of the panel, compared with the case where, as in the PDP with the technology of Document 1, the whole surface of the phosphor layers is coated with the MgO film.

Accordingly, the PDP of the present invention enables a weak discharge to be generated in a stable manner, and can provide both high luminous efficiency and high image quality. The PDP of the present invention can be modified as follows.

In the above-described PDP, the high γ member may be in a form of dots or stripes provided on the surface of the phosphor layer.

In the above-described PDP, the high γ member may be in a form of particles attached to the surface of the phosphor layer.

In the above-described PDP, a diameter of the particles may be in a range of 0.05 μm to 20 μm inclusive.

In the above-described PDP, a diameter of first particles among the particles may be in a range of 0.05 μm to 1 μm inclusive.

In the above-described PDP, a diameter of secondary particles among the particles may be in a range of 2 μm to 20 μm inclusive.

In the above-described PDP, a plurality of first electrodes may be provided on a surface of the first substrate, and a dielectric layer and the phosphor layer may have been stacked on the surface of the first substrate to cover the plurality of first electrodes, and the high γ member may be provided in a surface area that includes an area that is directly above the first electrodes.

In the above-described PDP, the high γ member may be provided on the surface of the phosphor layer unevenly in area.

In the above-described PDP, the high γ member may be provided on the surface of the phosphor layer unevenly in an area that corresponds to at least part of a surface of the first electrodes.

In the above-described PDP, a plurality of first electrodes may be provided on a surface of the first substrate, a plurality of pairs of second electrode and third electrode may be provided on a surface of the second substrate in a direction perpendicular to an extension direction of the first electrodes, and the high γ member may be provided in areas that are three-dimensional intersections of the electrode pairs and the first electrodes, or in areas that correspond to the three-dimensional intersections.

In the above-described PDP, one of the second electrode and the third electrode in each pair may be a scan electrode and another may be a sustain electrode, and the high γ member may be provided in areas that are three-dimensional intersections of the scan electrodes and the first electrodes, or in areas that correspond to the three-dimensional intersections.

In the above-described PDP, a voltage, which is based on input image data, may be applied to each of the first electrode, the second electrode, and the third electrode, and in a discharge cell that is selected based on the input image data, a write discharge may be generated when a voltage is applied between the first electrode and the second electrode, and a wall charge may be provided by the generation of the write discharge.

In the above-described PDP, a plurality of data electrodes may be provided on a surface of the first substrate, a plurality of pairs of scan electrode and sustain electrode may be provided on a surface of the second substrate in parallel with each other in a direction perpendicular to an extension direction of the data electrodes, and the high γ member may exist on the surface of the phosphor layer in an area that is demarcated by perpendicular lines dropped to the surface of the first substrate from each of side edges of the scan electrode.

In the above-described PDP, a dielectric layer may be provided on the first substrate to cover the plurality of data electrodes, and on a surface of the dielectric layer, barrier ribs may be provided to erect between adjacent data electrodes and to extend in parallel with the data electrodes, and have slant surfaces such that a distance between adjacent barrier ribs becomes smaller toward the surface of the first substrate, the phosphor layer may be provided in each dent that is enclosed by the dielectric layer and the barrier ribs, and the high γ member may be provided on the surface of the phosphor layer in an area that includes the area demarcated by the perpendicular lines, and includes a surface of a portion of the phosphor layer that is provided on a slant surface of the barrier ribs.

In the above-described PDP, a dielectric layer may be provided on the first substrate to cover the plurality of data electrodes, and on a surface of the dielectric layer, first barrier ribs may be provided to erect between adjacent data electrodes to extend in parallel with the data electrodes, and second barrier ribs may be provided in a direction perpendicular to the first barrier ribs to extend between adjacent pairs of electrodes provided on the second substrate, the phosphor layer may be provided in each dent that is enclosed by the dielectric layer, the first barrier ribs, and the second barrier ribs, the second barrier ribs may have slant surfaces such that a distance between adjacent second barrier ribs becomes smaller toward the surface of the first substrate, and the high γ member may be provided on the surface of the phosphor layer in an area that includes the area demarcated by the perpendicular lines, and includes a surface of a portion of the phosphor layer that is provided on a slant surface of the second barrier ribs.

In the above-described PDP, the high γ member may exist on the surface of the phosphor layer in an area that is demarcated by second perpendicular lines dropped to the surface of the second substrate from each of side edges of the data electrode.

In the above-described PDP, an area of the surface of the phosphor layer that is demarcated by third perpendicular lines dropped to the surface of the first substrate from each of side edges of the sustain electrode may be exposed to the space.

In the above-described PDP, areas other than an area of the surface of the phosphor layer that is demarcated by the perpendicular lines may be exposed to the space.

In the above-described PDP, thickness of the high a member may be in a range of 100 nm to 3 μm inclusive.

In the above-described PDP, the high γ member may contain a metal oxide.

In the above-described PDP, the metal oxide may contain at least one of MgO, CaO, BaO, SrO, MgNO, and ZnO.

In the above-described PDP, the metal oxide may contain at least one of MgO and SrO.

In the above-described PDP, the high γ member may contain at least one of carbon nanotube, nanofiber, fullerene, and AIN.

In the above-described PDP, the high γ member may contain at least one of Pt, Au, Pd, Mg, Ta, W, and Ni which are metal materials.

In the above-described PDP, the high γ member may contain at least one of Pt and Mg.

In the above-described PDP, a coverage ratio of the high γ member to the surface of the phosphor layer may be in a range of 1% to 50% inclusive.

In the above-described PDP, a coverage ratio of the high γ member to the surface of the phosphor layer may be in a range of 3% to 20% inclusive.

In the PDP of the present invention with the above-described structure where a high γ member is provided as a film on a surface of the phosphor layer, with a film thickness of the high γ member being in a range of 1 nm to 10 nm inclusive, it does not happen that substantially a large amount of ultraviolet rays, which are generated in the discharge spaces and include resonance lines of 147 (nm), is absorbed by the high γ member, and the ultraviolet rays enter the phosphor layers with a high efficiency. As apparent from this, it is possible, in the PDP of the present invention, to restrict the reduction of luminous efficiency caused by the high γ member formed on the surface of the phosphor layers, by setting the film thickness of the high γ member to be in a range of 1 nm to 10 nm inclusive. Further, when the film thickness of the high γ member is set to be in a range of 1 nm to 10 nm inclusive, the high γ member may be formed to cover substantially the whole surface of the phosphor layers. Here, the phrase "cover substantially the whole surface" means that if, for example, the formed high γ member has a slight amount of pin holes due to some inappropriate conditions in the manufacturing process, the high γ member is included in the scope of the present invention.

Also, in the PDP of the present invention, the high γ members are formed to be exposed to the discharge spaces. With this structure, the firing voltage, for when the ramp waveform voltage is applied and when the phosphor layers side becomes a cathode during the reset period when the PDP is driven, is lowered, and this causes the weak discharge to be generated in a stable manner.

Accordingly, the PDP of the present invention enables a weak discharge to be generated in a stable manner during the reset period, and can provide both high luminous efficiency and high image quality. The PDP of the present invention with such a structure can be modified as follows.

In the above-described PDP, the high γ member may contain a metal oxide. More specifically, it is preferable that the metal oxide contains at least one of MgO and SrO. Further, it is preferable that the metal oxide contains MgO, and the high γ member has been formed from the metal oxide by an electron beam vapor deposition method.

In the above-described PDP, the space that exists between the first substrate and the second substrate may have been filled with a discharge gas that contains Xe, and a ratio of a partial pressure of Xe to a total pressure of the discharge gas may be in a range of 5% to 100% inclusive.

In the above-described PDP, it is more preferable that the ratio of a partial pressure of Xe to a total pressure of the discharge gas is in a range of 5% to 50% inclusive.

The above object is also fulfilled by a manufacturing method of a PDP, the method enabling the high γ member and the PDP of the present invention having the high γ member to be manufactured with ease and reliability. The manufacturing method of the present invention can be modified as follows.

In the manufacturing method of the PDP of the present invention, in the high γ member forming step, the high γ member may be formed as a film in a form of dots or stripes on the surface of the phosphor layer, by any of a spray method, a dispersion accumulation method, and an electron beam vapor deposition method.

In the above-described manufacturing method of the PDP, in the high γ member forming step, the high γ member may be formed as a film in a form of dots or stripes on the surface of the phosphor layer, by attaching particles of the material to the surface of the phosphor layer using any of a dispersion method, a spray method, a dispersion accumulation method, and an electrodeposition method.

In the above-described manufacturing method of the PDP, before the phosphor layer is formed in the phosphor layer forming step, a plurality of first electrodes may be formed on the surface of the first substrate to be in parallel with each other, and a dielectric layer is formed to cover the first electrodes, and in the high γ member forming step, the high γ member may be formed in a surface area that includes an area that is directly above the first electrodes.

In the above-described manufacturing method of the PDP, before the phosphor layer is formed in the phosphor layer forming step, a plurality of first electrodes may be formed on the surface of the first substrate to be in parallel with each other, and a dielectric layer may be formed to cover the first electrodes, a plurality of pairs of second electrode and third electrode may be formed on a surface of the second substrate in a direction perpendicular to an extension direction of the first electrodes, and in the high γ member forming step, the high γ member may be formed in areas that include intersections of the first electrodes and the second electrodes.

In the above-described manufacturing method of the PDP, in the high γ member forming step, the high γ member may be formed using a material that contains MgO or SrO.

In the above-described manufacturing method of the PDP, in the high γ member forming step, the high γ member may be formed using a material that contains at least one of carbon nanotube, nanofiber, fullerene, and AlN.

In the above-described manufacturing method of the PDP, in the high γ member forming step, the high γ member may be formed using a material that contains Pt or Mg.

In the above-described manufacturing method of the PDP, in the high γ member forming step, the high γ member may be formed so that a coverage ratio of the high γ member to the surface of the phosphor layer is in a range of 3% to 20% inclusive.

The manufacturing method of the PDP of the present invention, where in the high γ member forming step, the high γ member is formed so that a film thickness of the high γ member is in a range of 1 nm to 10 nm inclusive, can be modified as follows.

In the above-described manufacturing method of the PDP, in the high γ member forming step, the high γ member may be formed by an electron beam vapor deposition method.

In the above-described manufacturing method of the PDP, in the high γ member forming step, the high γ member may be formed using a material that contains MgO or SrO.

The above-described manufacturing method of the PDP may comprise the steps of: sealing the first substrate and the second substrate at peripheries thereof; and filling a discharge gas in the space, wherein the discharge gas used in the discharge gas filling step has been adjusted such that a ratio of a partial pressure of Xe to a total pressure of the discharge gas is in a range of 5% to 50% inclusive.

In the above-described manufacturing method of the PDP, in the high γ member forming step, the material of the high γ member may be electrically charged, and the electrically charged material may be accumulated in the part of the surface of the phosphor layer by static electricity.

In the above-described manufacturing method of the PDP, before the phosphor layer is formed in the phosphor layer forming step, a plurality of first electrodes may be formed on the surface of the first substrate to be in parallel with each other, and a dielectric layer may be formed to cover the first electrodes, and in the high γ member forming step, the material of the high γ member may be charged positively, and the positively charged material may be accumulated by applying a negative voltage to the first electrodes.

In the above-described manufacturing method of the PDP, in the high γ member forming step, the applied negative voltage may become greater on a negative side over time.

In the above-described manufacturing method of the PDP, in the high γ member forming step, the applied negative voltage may become greater on a negative side over time continuously or in a step-by-step manner.

In the above-described manufacturing method of the PDP, in the high γ member forming step, the electrically charged material may be dispersed toward the surface of the phosphor layer.

In the above-described manufacturing method of the PDP, in the high γ member forming step, the material of the high γ member may be electrically charged in plasma, and the electrically charged material may be accumulated by an electron beam vapor deposition.

In the above-described manufacturing method of the PDP, in the high γ member forming step, the material of the high γ member may electrically charged by eradiating a plasma beam onto the material, and the electrically charged material may be accumulated as a film.

In the above-described manufacturing method of the PDP, in the high γ member forming step, the material of the high γ member may contain at least MgO.

In the above-described manufacturing method of the PDP, before the phosphor layer is formed in the phosphor layer forming step, a plurality of data electrodes may be formed on a surface of the first substrate to be in parallel with each other, then a dielectric layer may be formed to cover the data electrodes, and on a surface of the dielectric layer, barrier ribs may be formed to erect between adjacent data electrodes and to extend in parallel with the data electrodes, and have slant surfaces such that a distance between adjacent barrier ribs becomes smaller toward the surface of the first substrate, in the phosphor layer forming step, the phosphor layer may be formed on inner surfaces of each dent that is enclosed by the dielectric layer and the barrier ribs, a plurality of pairs of scan electrode and sustain electrode may be formed on a surface of the second substrate in parallel with each other in a direction perpendicular to an extension direction of the data electrodes, and the high γ member may be formed by a slant vapor deposition method on the surface of the phosphor layer in areas on the slant surfaces with an angle perpendicular to perpendicular lines that are dropped to the surface of the first substrate from each of side edges of the scan electrode.

In the above-described manufacturing method of the PDP, a plurality of pairs of scan electrode and sustain electrode may be formed on a surface of the second substrate in parallel with each other in a direction perpendicular to an extension direction of the data electrodes, before the phosphor layer is formed in the phosphor layer forming step, a plurality of data electrodes may be formed on a surface of the first substrate to be in parallel with each other, then a dielectric layer is formed to cover the data electrodes, and on a surface of the dielectric layer, first barrier ribs may be formed to erect between adjacent data electrodes to extend in parallel with the data electrodes, and second barrier ribs may be formed in a direction perpendicular to the first barrier ribs to extend between adjacent pairs of electrodes formed on the second substrate, in the phosphor layer forming step, the phosphor layer may be formed on inner surfaces of each dent that is enclosed by the dielectric layer, the first barrier ribs, and the second barrier ribs, the second barrier ribs may have slant surfaces such that a distance between adjacent second barrier ribs becomes smaller toward the surface of the first substrate, and the high γ member may be formed by a slant vapor deposition method on the surface of the phosphor layer in areas on the slant surfaces of the second barrier ribs with an angle perpendicular to perpendicular lines that are dropped to the surface of the first substrate from each of side edges of the scan electrode.

In the above-described manufacturing method of the PDP, in the high γ member forming step, the first substrate may be transported in a direction along a main surface of the first substrate while the angle is maintained.

In the above-described manufacturing method of the PDP, in the high γ member forming step, the high γ member may be formed as a film by an electron vapor deposition method, using a metal oxide material containing MgO.

In the above-described manufacturing method of the PDP, in the high γ member forming step, the high γ member may be formed as a film whose thickness is in a range of 100 nm to 3 μm inclusive.

In the above-described manufacturing method of the PDP, in the high γ member forming step, areas other than an area of the surface of the phosphor layer that is demarcated by the perpendicular lines may be maintained to be exposed to the space.

The above object is also fulfilled by a forming apparatus for forming a high γ member, which adopts the above-described structures to form the high γ member as defined above. Use of such a forming apparatus makes it possible to manufacture the PDP of the present invention with ease.

DESCRIPTION OF CHARACTERS

Figure 1:
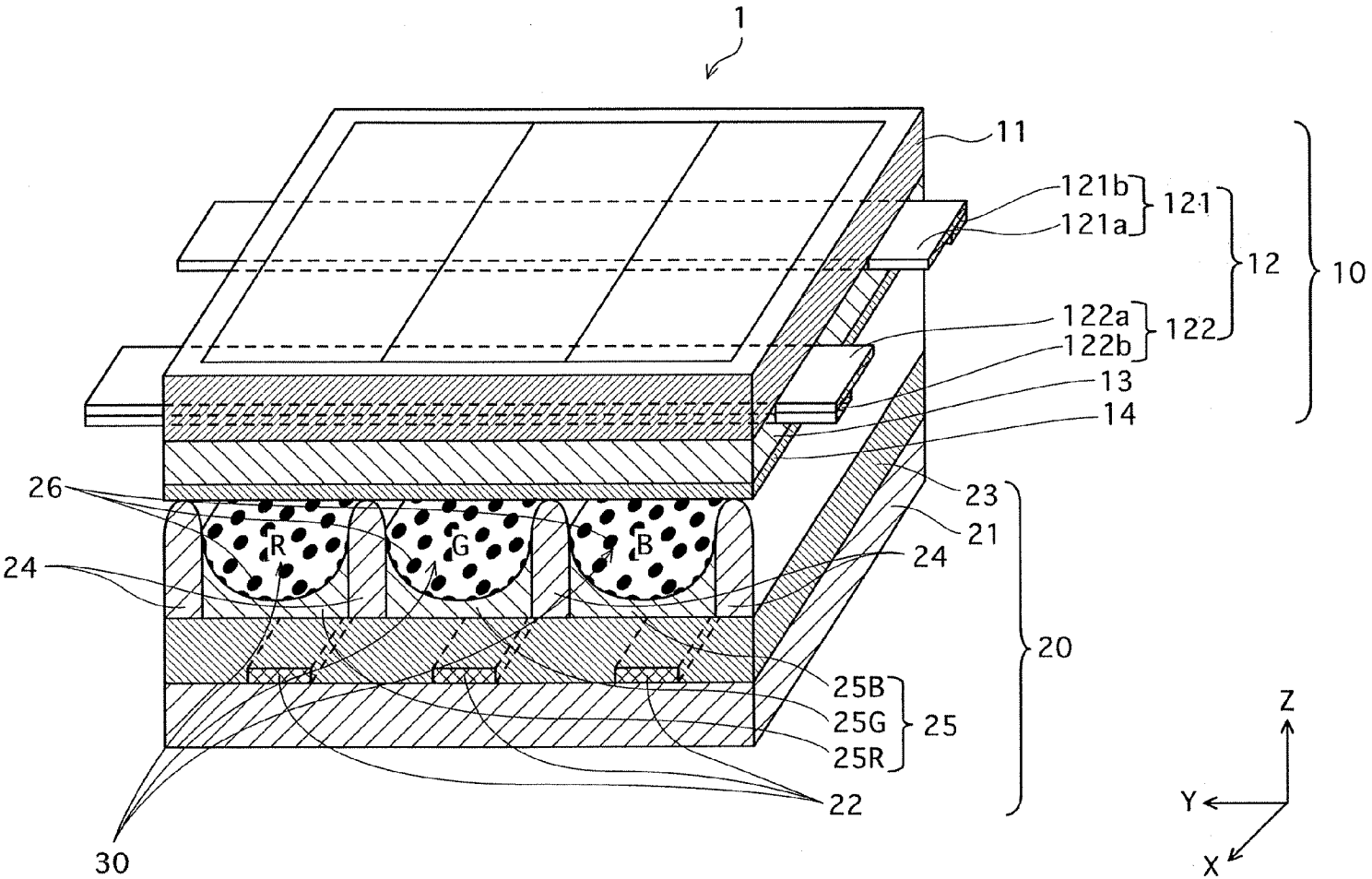
FIG. 1 is a main part perspective view (partially sectional view) showing the main part of the PDP 1 in Embodiment 1.

1, 2, 3, 4, 5, 6, 7, 8, 9, 1006 PDP
10 front panel
11 front substrate
12 display electrode pair
13 dielectric layer
14 dielectric protective layer
20, 40, 50, 60, 70, 80, 90, 1080, 1180, 1190 back panel
21, 41, 51, 61, 71, 81, 91, 1081, 1181, 1191 back substrate
22, 42, 52, 62, 72, 82, 92, 1082, 1182, 1192 data electrode
23, 43, 53, 63, 73, 83, 93, 1083, 1183, 1193 dielectric layer
24, 44, 54, 64, 74, 84, 94, 1084, 1184, 1194 barrier rib
25, 45, 55, 65, 75, 85, 95, 1085, 1185, 1195 phosphor layer
26, 46, 76, 96, 1196 phosphor-coating film
56, 66 particles
86, 1086, 1186 high γ member
121 scan electrode
122 sustain electrode

BEST MODE FOR CARRYING OUT THE INVENTION

The following describes the best mode for carrying out the invention with reference to the attached drawings. It should be noted here that the structures of the plasma display panel (hereinafter referred to as PDP) provided in the following description are merely examples, and that the present invention can have various structures appropriately modified to make use of the features of the present invention.

Embodiment 1

1. Entire Structure of PDP 1

The entire structure of a PDP 1 of the present invention will be described with reference to FIG. 1. FIG. 1 is a main part perspective view showing the main part of the PDP 1.

As shown in FIG. 1, the PDP 1 is composed of two major parts: a front panel 10 and a back panel 20. The front panel 10 is constructed such that a plurality of display electrode pairs 12 are disposed in parallel with each other on a main surface (in FIG. 1, the lower main surface facing downward in the Z axis direction) of a front substrate 11. And a dielectric layer 13 and a dielectric protective layer 14 are formed to cover the display electrode pairs 12, in the stated order. Each pair of the display electrode pairs 12 is made of a scan electrode (hereinafter referred to as Scn electrode) 121 and a sustain electrode (hereinafter referred to as Sus electrode) 122. The Scn electrode 121 is composed of a transparent electrode element 121*a* and a bus line 121*b* that are laminated to each other; and the Sus electrode 122 is composed of a transparent electrode element 122*a* and a bus line 122*b* that are laminated to each other.

Of these components of the Scn electrode 121 and the Sus electrode 122, the transparent electrode element 121*a* and the transparent electrode element 122*a* contain, for example, ITO (Indium Tin Oxide), $SnO_2$, and ZnO, and the bus line 121*b* and the bus line 122*b* contain, for example, Au, Ag, Cr, Cu, Ni, and Pt. It should be noted here that each of the Scn electrode 121 and the Sus electrode 122 of the front panel 10 is not limited to a two-layer structure, but may be a single-layer structure made of a metal such as Ag, or may have three or more layers of Cr—Cu—Cr or the like.

The front substrate 11 is made of, for example, a soda-lime glass. The dielectric layer 13 is made of, for example, a lead-based, low-melting glass. The dielectric protective layer 14 is made of, for example, MgO. The dielectric protective layer 14 is typically formed by the vacuum deposition method, but may be formed by the oblique deposition method or the like. Also, the dielectric protective layer 14 may be set to be in a range of 70(%) to 85(%) inclusive of a single-crystal material in the weight density.

The back panel 20 is constructed such that a plurality of data electrodes (hereinafter referred to as Dat electrodes) 22 are formed in stripes on a main surface (in FIG. 1, the upper surface facing upward in the Z axis direction) of a back substrate 21. And a dielectric layer 23 is formed to cover the Dat electrodes 22. Further, on the dielectric layer 23, barrier ribs 24 are formed to erect between adjacent Dat electrodes 22. Also, a phosphor layer 25 is provided inside each dent (groove) that is enclosed by the dielectric layer 23 and the barrier ribs 24. There are three types of phosphor layers 25: phosphor layers 25R with red color (R); phosphor layers 25G with green color (G); and phosphor layers 25B with blue color (B). One of these colors is assigned to each dent. The phosphor layers 25R, 25G, and 25B are made of, for example, the following phosphor materials, respectively.

| | |
|---|---|
| Red (R) phosphor | (Y, Gd) $BO_3$: Eu |
| Green (G) phosphor | $Zn_2SiO_4$: Mn |
| Blue (B) phosphor | $BaMg_2Al_{14}O_{24}$: Eu |

In the PDP 1 of the present embodiment, phosphor-coating films 26 are further formed on the surface of the phosphor layers. The phosphor-coating films 26 cover part of the surface of the phosphor layers 25, so that both the remaining part of the surface of the phosphor layers 25 and the surface of the phosphor-coating films 26 are exposed to discharge spaces 30.

Of the components constituting the back panel 20, the back substrate 21 is made of, for example, a soda-lime glass, as is the case with the front substrate 11. The Dat electrodes 22 are made of, for example, Au, Ag, Cr, Cu, Ni, and Pt. The dielectric layer 23 is basically made of a lead-based, low-melting glass, as is the case with the dielectric layer 13. However, the dielectric layer 23 may contain $TiO_2$ in addition. The barrier ribs 24 of the back panel 20 may be formed in parallel crosses, as well as in stripes as shown in FIG. 1.

The structure of the phosphor-coating films 26 will be described later.

As shown in FIG. 1, the front panel 10 and the back panel 20 are arranged such that the main surfaces thereof, on which the display electrode pairs 12 and the like and the Dat electrodes 22 and the like are respectively formed, face each other, and such that display electrode pairs 12 and the Dat electrodes 22 intersect. The front panel 10 and the back panel 20 arranged in this manner are put together and sealed at their peripherals, using a frit glass or the like. A Xe—Ne based discharge gas (rare gas) is filled in the discharge spaces 30 that are formed between the front panel 10 and the back panel 20. The filling pressure of the discharge gas is approximately 60 (kPa). It should be noted here that as the discharge gas, a Xe—Ne—He based mixture gas may be used, as well as the Xe—Ne based gas. Also, the rate of partial pressure of Xe to the total pressure of the discharge gas, which is one of the great factors that affect the luminous efficiency of the panel, is set to be in a range of 5(%) to 50(%) inclusive.

2. Structure of Phosphor-Coating Films 26

The phosphor-coating films 26, which are most characteristic among the constituent elements of the PDP 1 in the present embodiment, will be described with reference to FIGS. 2A and 2B.

Figure 2A:
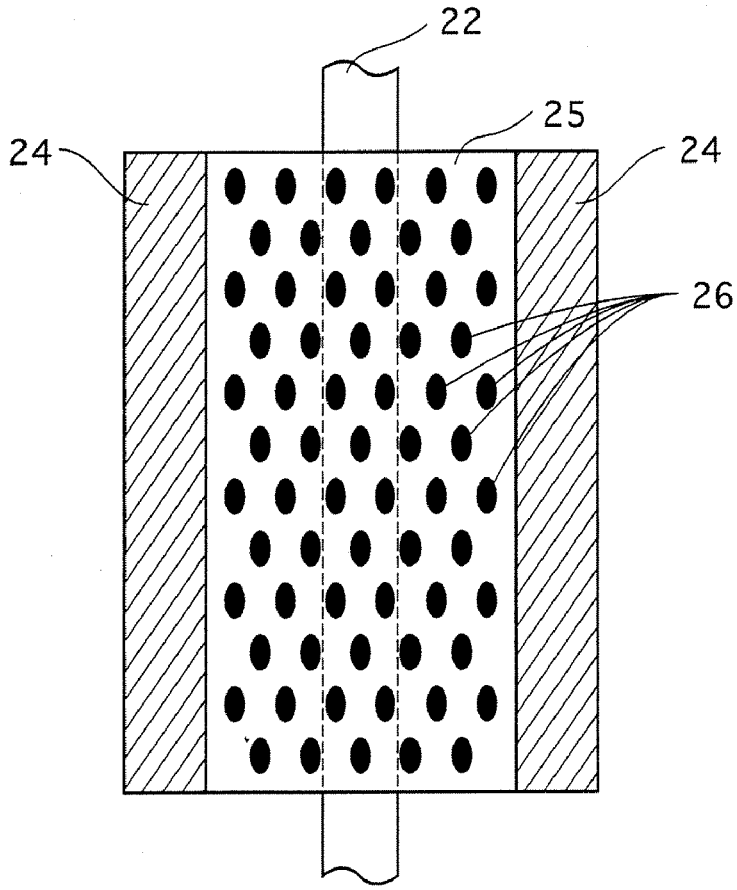
FIGS. 2A and 2B are a plan view and a cross-sectional view showing the back panel 20 of the PDP 1.

FIG. 2A is a plan view of the phosphor layers 25 of the back panel 20. FIG. 2B is a cross-sectional view of the phosphor layers 25 shown in FIG. 2A.

As shown in FIG. 2A, in the PDP 1, the phosphor-coating films 26 are formed on the surface of the phosphor layers 25 in the back panel 20. The phosphor-coating films 26 are formed to be scattered over the surface of the phosphor layers 25. The coverage ratio of the phosphor-coating films 26 to the surface of the phosphor layers 25 is set to a range of 1(%) to 50(%) inclusive. It should be noted here that more preferably, the coverage ratio is set to a range of 3(%) to 20(%) inclusive.

Figure 2B:
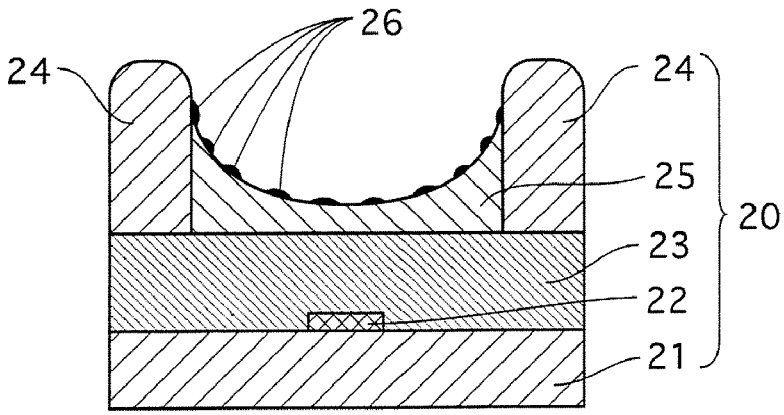

As shown in FIG. 2B, the phosphor-coating films 26 are formed to cover part of the surface of the phosphor layers 25, and are exposed to the discharge spaces 30. Also, since the phosphor-coating films 26 are formed on part of the surface of the phosphor layers 25, the remaining area of the surface of the phosphor layers 25, on which the phosphor-coating films 26 are not formed, is exposed to the discharge spaces 30.

The phosphor-coating films 26 are made of a material that is different from and has a higher value of the secondary electron emission coefficient γ than each phosphor material of the phosphor layers 25. The portions where the phosphor-coating films 26 are formed are the high γ members of the PDP 1 in the present embodiment. The material of the phosphor-coating films 26 may be a metal oxide such as MgO, SrO, CaO, BaO, MgNO, and ZnO. Also, the material of the phosphor-coating films 26 may be a nanofiber such as a carbon nanotube (CNT), a fullerene such as C60, or AlN. Further, the material of the phosphor-coating films 26 may be Pt, Au, Pd, Mg, Ta, W, or Ni.

Among the above-listed possible materials of the phosphor-coating films 26, among the metal oxides, MgO or SrO is preferable in terms of the secondary electron emission coefficient γ; and among the metal materials, Pt or Mg is preferable.

It should be noted here the phosphor-coating films 26 may contain impurities or materials other than the above-indicated materials. That is to say, the phosphor-coating films 26 may be made of any combination of materials that, as a whole, has a higher value of the secondary electron emission coefficient γ than each phosphor material.

3. Forming Phosphor-Coating Films 26

The phosphor-coating films 26 shown in FIGS. 2A and 2B can be formed by a spray method of spraying a mixed organic solvent containing a MgO material, a dispersion accumulation method, or an electronic beam deposition method. For example, the phosphor-coating films 26 are formed by the spray method including the following steps.

(1) A mixed organic solvent is generated by mixing ethanol with the MgO material.

(2) A mask is attached to the surface of the phosphor layers 25, and the mixed organic solvent is applied to part of the surface of the phosphor layers 25 through the holes that are formed in the mask.

(3) The mixed organic solvent applied to the part of the surface of the phosphor layers 25 is dried and the organic solvent is volatilized.

The phosphor-coating films 26 are formed as shown in FIGS. 2A and 2B, after the above-described steps are performed.

Also, for example, the phosphor-coating films 26 can be formed by the dispersion accumulation method as follows. First, the MgO material is dispersed into the organic solvent. The MgO material dispersed in the organic solvent is then allowed to sink silently from the solvent surface a predetermined portion of the phosphor layers of the back panel, to be accumulated there. The organic solvent is then dried and the organic solvent is volatilized. This completes forming the phosphor-coating films 26 on part of the surface of the phosphor layers. It should be noted here that, prior to the accumulation of the MgO material, a resist mask may be attached to the surface of the phosphor layers so as to cover such portions on which the phosphor-coating films 26 should not be formed. The phosphor-coating films 26 can be formed as shown in FIGS. 2A and 2B with these procedures.

4. How to Drive PDP 1

Figure 3:
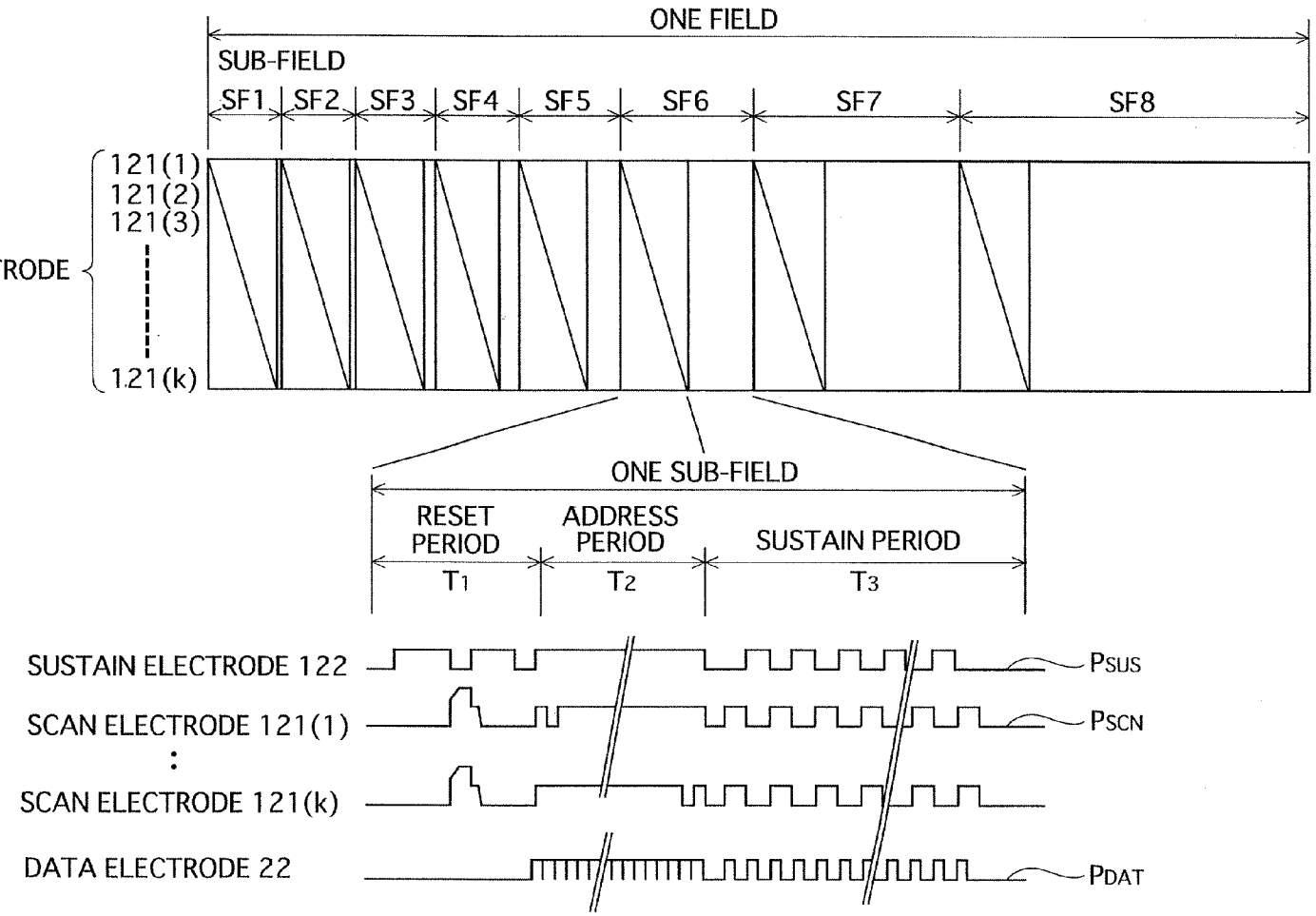
FIG. 3 shows waveforms of pulses that are applied to the electrodes 121, 122, 22 when the PDP 1 is driven.

In the PDP 1 having the above-described structure, each of the electrodes 121, 122, and 22 is connected to a control drive unit that includes a driver for each electrode, although the illustration is omitted. The following will describe how the PDP 1 including the control drive unit, which is connected as described above, is driven, with reference to FIG. 3. FIG. 3 shows that the display driving is performed by an address/display separation driving method. In the driving method, one field is divided into eight sub-fields SF1-SF8, for example, as shown in FIG. 3, to realize the phosphor layers 256 levels of grayscale. And three periods: a reset period T1; a write period T2; and a sustain period T3 are set in each of the sub-fields SF1-SF8.

In driving the PDP 1, in the reset period T1, the resetting is performed to cause a reset discharge in each discharge cell of the PDP 1 so that the influence of the presence/absence of a discharge in a preceding sub-frame is removed from the current sub-frame and to absorb the variation of the discharge characteristic. The reset discharge is generated in the reset period T1 by applying a ramp waveform, which represents voltage/time and rises and falls with a slow slant, between the Scn electrode 121 and the Dat electrode 22 so as to cause a small discharge current to flow constantly, as shown in FIG. 3. This enables a reset discharge, which is a weak discharge, to be generated once in each of the rising slant portion and the falling slant portion of the ramp waveform, in each discharge cell of the PDP 1.

Next, in the write period T2, the k lines of Scn electrodes (1) to (k) are scanned in a sequential order for each line based on the sub-field data, so that a write discharge (weak discharge) is generated between the Scn electrode 121 and the Dat electrode 122 in each of the discharge cells in which a sustain discharge is to be generated within the current sub-field. In the discharge cells in which the write discharge is generated between the Scn electrode 121 and the Dat electrode 122, a wall charge is held by the surface of the dielectric protective layer 14 of the front panel 10.

Then, in the sustain period T3, sustain pulses Psus and Pscn, which are rectangular waves, are respectively applied to the Sus electrode 122 and the Scn electrode 121 with a predetermined cycle (for example, 6 μsec) and with a predetermined voltage (for example, 180 V). The sustain pulse Psus to be applied to the Sus electrode 122 and the sustain pulse Pscn applied to the Scn electrode 121 have the same cycle. The phases of the sustain pulse Psus and the sustain pulse Pscn are shifted from each other by a half cycle. The sustain pulse Psus and the sustain pulse Pscn are applied to all the discharge cells of the PDP 1 simultaneously.

By the application of the pulses as shown in FIG. 3, in each of the discharge cells of the PDP 1 in which the writing was performed, a pulse discharge is generated each time the voltage polarity changes as an alternate voltage is applied in the sustain period T3. The generation of such sustain discharges causes resonance lines of 147 (nm) to be emitted from the excited Xe atoms and causes molecular beams of 173 (nm) to be emitted from the excited Xe molecules in the discharge spaces 30, as the display light emission. The ultraviolet rays generated by this are converted into visible light by the phosphor layers 25 of the back panel 20, which realizes the image display.

5. Advantages of PDP 1

As shown in FIG. 2A, the PDP 1 of the present embodiment has a structure in which the phosphor-coating films 26 are formed on the surface of the phosphor layers 25 to cover part of the surface so that both the remaining part of the surface of the phosphor layers 25 and the surface of the phosphor-coating films 26 are exposed to the discharge spaces 30, where the phosphor-coating films 26 are the high γ members that have a high value of the secondary electron emission coefficient γ and are made of a material containing MgO that has a higher value of the secondary electron emission coefficient γ than the phosphor materials. With such a structure in which part of the surface of the phosphor layers 25 is exposed to the discharge spaces 30, when the PDP 1 is driven, the ultraviolet rays that are generated in the discharge spaces 30 in the sustain period T3 enter the phosphor layers 25 without being reduced greatly. The PDP 1 with such a structure can restrict the reduction in the luminous efficiency of the panel, compared with the case where, as in the PDP disclosed in Document 1, the whole surface of the phosphor layers is coated with the MgO film. Furthermore, the present embodiment defines that the coverage ratio of the phosphor-coating films 26 to the surface of the phosphor layers 25 is in a range of 1(%) to 50(%) inclusive, and more preferably, in a range of 3(%) to 20(%) inclusive. The definition of the value ranges will be described later.

Also, with such a structure in which the phosphor-coating films 26 are exposed to the discharge spaces 30, it is possible to lower the firing voltage when the phosphor layers 25 side becomes a cathode, where the firing voltage is generated when the ramp waveform is applied (especially when the rising ramp waveform is applied) in the reset period T1 when the PDP 1 is driven. This restricts the generation of a strong discharge, and causes the reset discharge (weak discharge) to be generated in a stable manner. This advantageous effect is produced for the following reasons. If the phosphor-coating films 26 have not been formed on the surf ace of the phosphor layers 25, the discharge is not generated in a stable manner since a smaller amount of electrons are emitted in the appearance when the Xe partial pressure is set to a higher value. On the other hand, in the PDP 1 including the phosphor-coating films 26, the phosphor-coating films 26 receive a great amount of energy when the Auger neutralization is performed. And due to this, a weak discharge is generated in a stable manner.

As described above, the reset discharge is generated in a stable manner in the PDP 1 of the present embodiment. Accordingly, even if the rate of partial pressure of Xe to the total pressure of the discharge gas is increased to a range of 5(%) to 50(%) inclusive, the image quality is not reduced.

Accordingly, the PDP 1 of the present embodiment can provide both high luminous efficiency and high image quality by generating the weak discharge in a stable manner during the reset period T1.

6. Coverage Ratio of Phosphor-Coating Films 26

For the PDP 1 of the present embodiment, it is defined that the coverage ratio of the phosphor-coating films 26 to the surface of the phosphor layers 25 is in a range 1(%) to 50(%) inclusive, and more preferably, in a range of 3(%) to 20(%) inclusive. The definition is made for the following reasons.

When the coverage ratio of the phosphor-coating films 26 to the surface of the phosphor layers 25 is less than 1(%), the function to stabilize the generation of the reset discharge during the reset period T1 is not achieved by the surface being exposed to the discharge spaces 30. For this reason, the coverage ratio of the phosphor-coating films 26 needs to be set to at least 1(%), and preferably to 3(%) or more. Also, the more the area of the surface of the phosphor-coating films 26, which is made of a material that includes MgO, is, the more amount of ultraviolet rays, which are generated in the discharge spaces 30, is absorbed by the phosphor-coating films 26. Accordingly, when the coverage ratio of the phosphor-coating films 26 to the surface of the phosphor layers 25 is more than 50(%), only a small amount of ultraviolet rays reach the phosphor layers 25, and the panel luminous efficiency falls below the practical level. It should be noted here that the upper limit of the coverage ratio is 20(%) for the similar reason when the other components of the PDP 1 are taken into consideration.

7. Confirmation Experiment

The following describes an experiment that was conducted to confirm the above-described advantages of the PDP 1 in the present embodiment.

The experiment was conducted using PDPs that had been manufactured by the above-described manufacturing method to have the structure of the present embodiment. That is to say, prepared were such PDPs in which the phosphor-coating films 26 containing MgO and having thickness in a range of 0.5 (μm) to 20 (μm) inclusive were formed on the surface of the phosphor layers 25 in the back panel 20, with 5(%) of the coverage ratio. The phosphor-coating films 26 were formed by a spray method of spraying a mixed dispersed organic solvent containing MgO and ethanol. The discharge spaces 30 were filled with a high-Xe discharge gas, where the rate of partial pressure of Xe to the total pressure of the discharge gas was approximately 30(%).

For the confirmation experiment, also prepared as comparative examples were PDPs having the structure disclosed in Document 1. The comparative example PDPs had a structure in which the whole surface of the phosphor layers was covered with a MgO film having thickness in a range of 0.5 (μm) to 20 (μm) inclusive.

For the confirmation of the advantages, the PDPs of the present embodiment and the comparative examples were driven for display, the luminous efficiency and the stability of the weak discharge generated during reset period T1 were measured, and the results were compared with conventional panels in which the phosphor layers were not covered with any film. The results showed that the weak discharge was generated during the reset period T1 more stably and the image quality was more excellent due to reduction of erroneous writing, in the PDPs of the present embodiment than in the conventional PDPs. Also, in the PDPs of the present embodiment, the luminous efficiency was improved up to approximately 3 (lm/W) since the rate of partial pressure of Xe to the total pressure of the discharge gas had been increased up to 30(%).

On the other hand, the luminous efficiency in the comparative PDPs, in which the whole surface of the phosphor layers were covered with a MgO film, was approximately 0.1 (lm/W). The value is as low as approximately 1/10 of the conventional PDPs in which the phosphor layers were not covered with any film. It is considered that this is because the MgO film formed on the surface of the phosphor layers in the comparative PDPs absorb the ultraviolet rays which include the resonance lines and are generated in the discharge spaces.

It is understood from the above-described results of the experiment that the reduction in the luminous efficiency is restricted and the firing voltage is lowered when the phosphor layers 25 side becomes a cathode during the reset period T1, by adopting the structure of the present embodiment in which the high γ members (the phosphor-coating films 26) that are made of a material having a higher value of the secondary electron emission coefficient γ than the phosphor materials on the surface of the phosphor layers 25 to cover part of the surface of the phosphor layers 25 so that both the remaining part of the surface of the phosphor layers 25 and the surface of the phosphor-coating films 26 are exposed to discharge spaces 30. It is accordingly possible for the PDP of the present embodiment to generate the weak discharge in a stable manner during the reset period T1 and to restrict the reduction of the image quality that may be caused by erroneous writing. Also, the PDP of the present embodiment is difficult to have reduction of the image quality even if the rate of partial pressure of Xe to the total pressure of the discharge gas is set to 5(%). Accordingly, the PDP of the present embodiment achieves both the improvement in the luminous efficiency and the improvement in the image quality.

Embodiment 2

The structure of a PDP 2 of Embodiment 2 will be described with reference to FIGS. 4A, 4B and 5. The front panel 10 and a back panel 40 excluding phosphor-coating films 46 are structured in the same manner as in Embodiment 1, and description thereof is omitted.

Figure 4A:
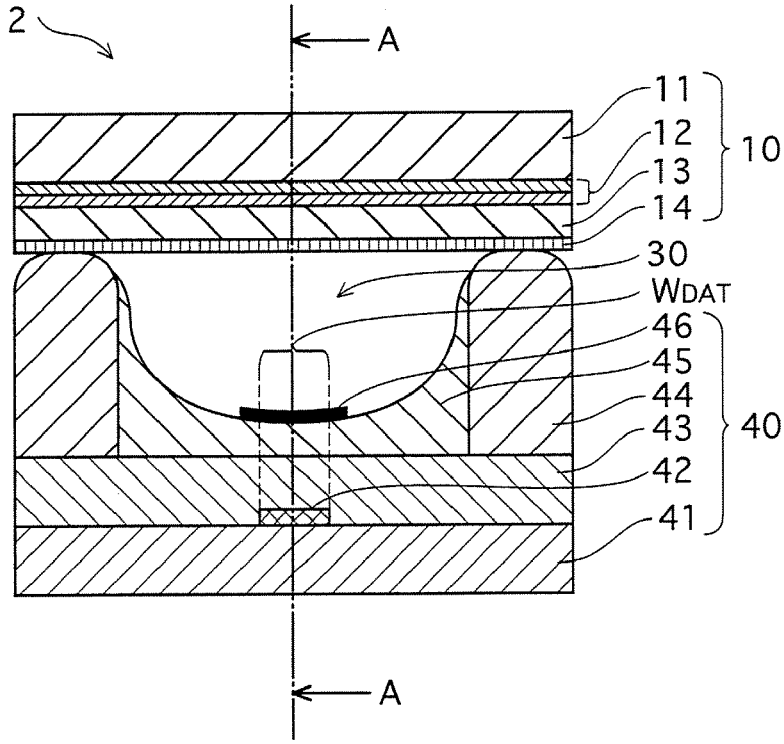
FIGS. 4A and 4B are main part cross-sectional views showing the structure of the PDP 2 in Embodiment 2.
Figure 4B:
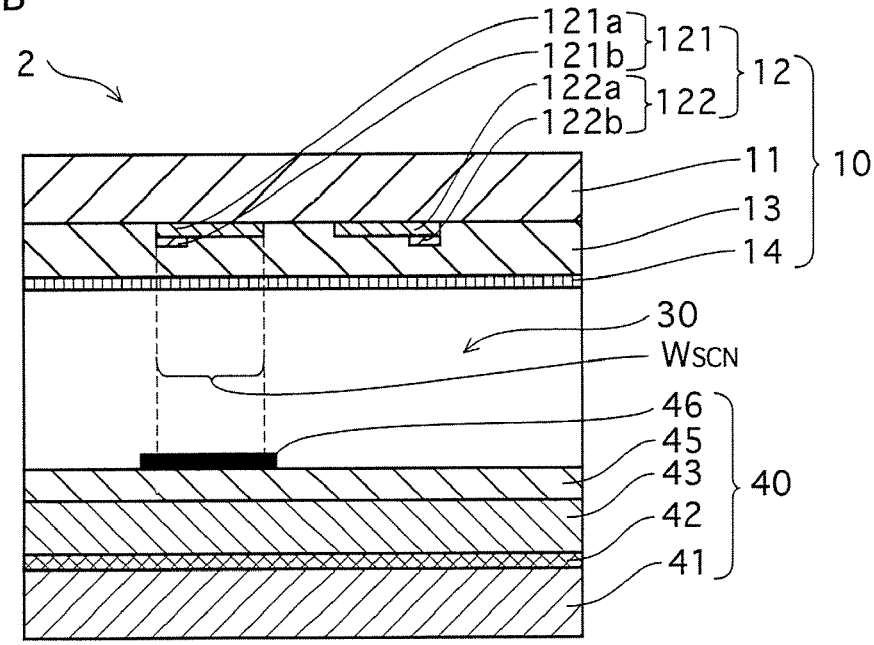

As shown in FIG. 4A, the phosphor-coating films 46 in the PDP 2 are formed on part of the surface of phosphor layers 45 as in Embodiment 1 in this sense, but are formed differently from the phosphor-coating films 26 in Embodiment 1 in that the phosphor-coating films 46 are formed in areas $W_{DAT}$ that are located directly above the Dat electrodes 42. Also, as shown in FIG. 4B that is a cross-sectional view taken along line A-A shown in FIG. 4A, the phosphor-coating films 46 are formed in areas $W_{SCN}$ that are located directly below the Scn electrodes 121 constituting the display electrode pairs 12 formed in the front panel 10.

Figure 5:
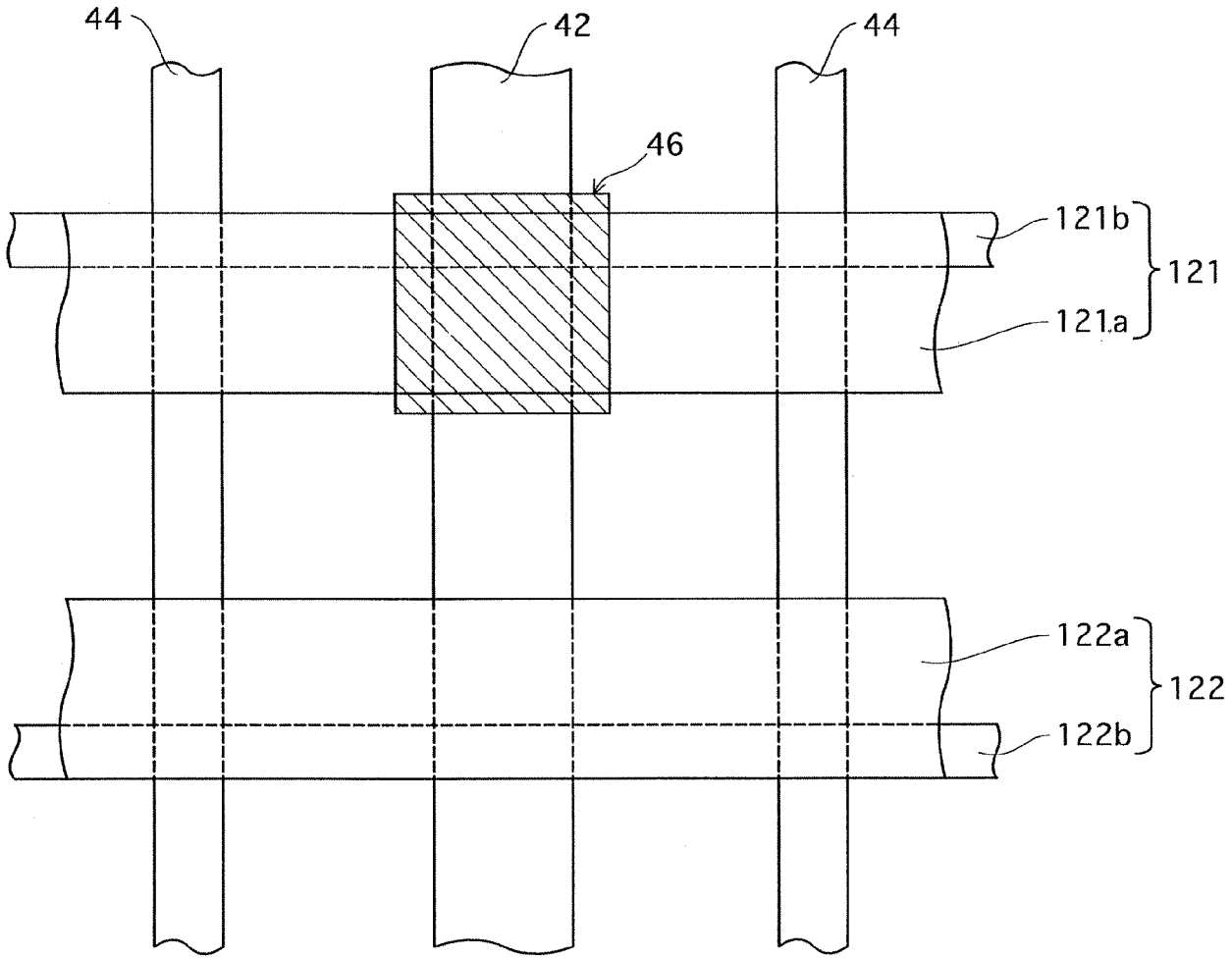
FIG. 5 is an illustrative plan view showing the positional relationships between the electrodes 121, 122, 42 and the phosphor-coating films 46 in the PDP 2.

FIG. 5 shows only the electrodes 121, 122, and 42, the barrier ribs 44, and the phosphor-coating films 46 out of the components constituting the PDP 2. As shown in FIG. 5, each of the phosphor-coating films 46 is formed on the surface of the phosphor layer 45 in the discharge cell, in correspondence with an area where the Scn electrode 121 and the Dat electrode 42 intersect with each other. In the PDP 2, the coverage ratio of the phosphor-coating films 46 to the surface of the phosphor layers 45 is in a range of 1(%) to 50(%) inclusive, and more preferably, in a range of 3(%) to 20(%) inclusive, as is the case with Embodiment 1.

The phosphor-coating films 46 are made of a material that has a higher value of the secondary electron emission coefficient γ than each phosphor material of the phosphor layers 45, as is the case with Embodiment 1. For example, the phosphor-coating films 46 are made of the same material as the phosphor-coating films 26 disclosed in Embodiment 1.

In the present embodiment, each of the phosphor-coating films 46 is formed in correspondence with an area in which a weak discharge is to be generated in the reset period T1, namely an area where the Scn electrode 121 and the Dat electrode 42 intersect with each other. With this structure, the weak discharge (reset discharge) is generated in a stable manner when a ramp waveform pulse is applied between the Scn electrode 121 and the Sus electrode 42 during the reset period T1. The stability in generating the weak discharge is more excellent than conventional PDPs especially when the rate of partial pressure of Xe to the total pressure of the discharge gas is increased to 5(%) or more.

Accordingly, the PDP 2 of the present embodiment can generate the weak discharge in a stable manner during the reset period T1, and thus achieves both high luminous efficiency and high image quality.

It should be noted here that the phosphor-coating films 46 in the PDP 2 of the present embodiment can be formed by the same method as the one disclosed in Embodiment 1.

In the present embodiment, each of the phosphor-coating films 46 is formed on the surface of the phosphor layer 45 in the discharge cell, in correspondence with an area where the Scn electrode 121 and the Dat electrode 42 intersect with each other. However, not limited to this, each of the phosphor-coating films 46 may be formed above the whole Dat electrode 42, regardless of the Scn electrode 121.

Embodiment 3

A PDP 3 of Embodiment 3 will be described with reference to FIG. 6. The front panel 10 and a back panel 50 excluding the high γ members are structured in the same manner as in Embodiments 1 and 2, and description thereof is omitted.

1. Structure of PDP 3

Figure 6:
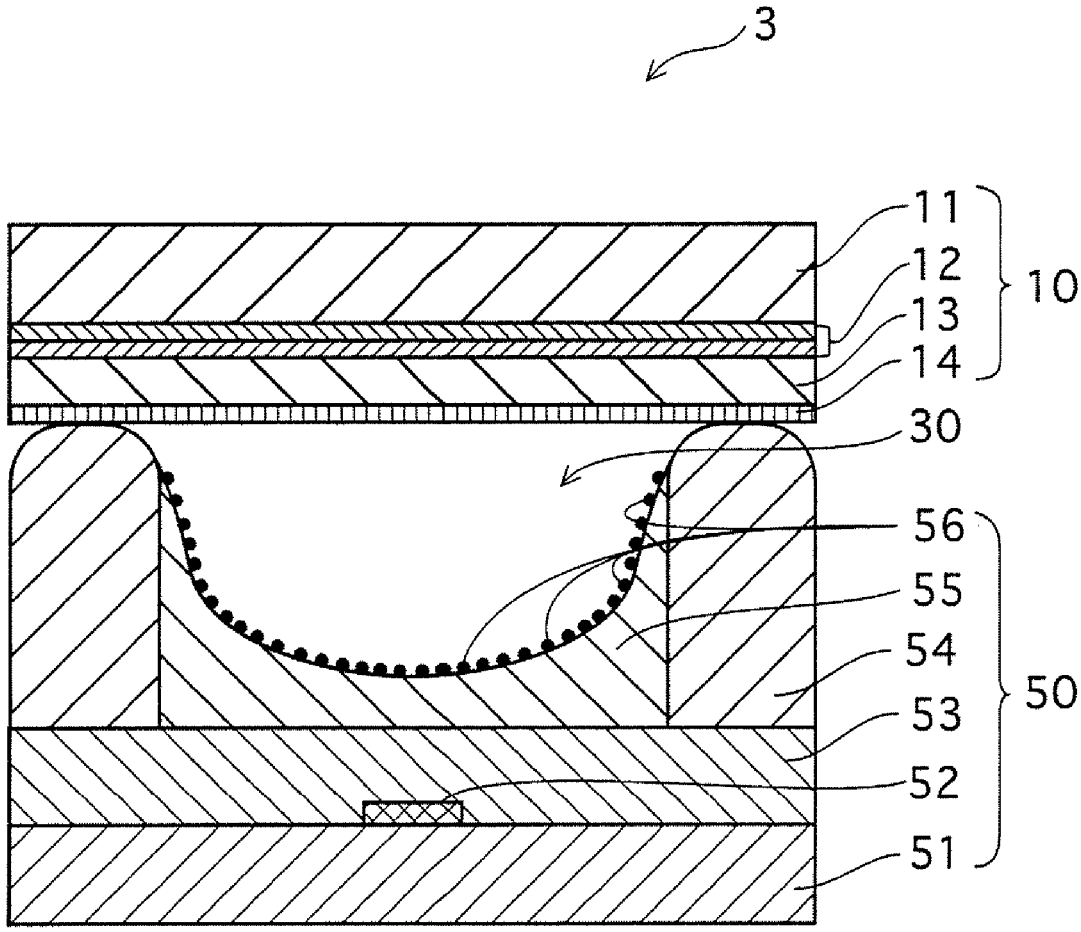
FIG. 6 is a main part cross-sectional view showing the structure of the PDP 3 in Embodiment 3.

As shown in FIG. 6, in the PDP 3 of the present embodiment, particles 56 are attached to the surface of phosphor layers 55. The particles 56 are made of a material that has a higher value of the secondary electron emission coefficient γ than each phosphor material of the phosphor layers 55. For example, the particles 56 are made of the same material as the phosphor-coating films 26 disclosed in Embodiment 1. In the PDP 3 of the present embodiment, the portions where the particles 56 are formed on the surface of the phosphor layers 55 are the high γ members. As one example, the high γ members can be formed using a metal oxide such as MgO or SrO as the material. In this case, particles of the metal oxide that are in the range of 0.05 (μm) to 1 (μm) inclusive in size are dispersed using a compressed nitrogen gas, so that the particles 56 are attached and the high γ members are formed on the surface of the phosphor layers 55.

In the present embodiment, the coverage ratio of the particles 56 to the surface of the phosphor layers 55 is in a range of 1(%) to 50(%) inclusive, and more preferably, in a range of 3(%) to 20(%) inclusive, as is the case with the embodiments described earlier.

In the PDP 3, in which the particles 56 are formed on the surface of the phosphor layers 55 with the coverage ratio in the above-mentioned value range, both the particles 56 having a high value of the secondary electron emission coefficient γ and the phosphor layers 55 are exposed to the discharge spaces 30. It is accordingly possible for the PDP 3 of the present embodiment to generate the weak discharge in a stable manner during the reset period T1 when the panel is driven, and to achieve both the high luminous efficiency and the high image quality.

As the method of forming the particles 56 on the surface of the phosphor layers 55, for example, the spray method, dispersion accumulation method, and electrodeposition method may be used, as well as the above-described dispersion method.

2. Diameter of Particles 56

As described above, to form the particles 56 as the high γ members, particles of the metal oxide that are in the range of 0.05 (μm) to 1 (μm) inclusive in size are dispersed. The dispersed particles aggregate with each other and form larger particles whose particle diameter is in a range of 2 (μm) to 20 (μm) inclusive. As a result, the high γ members are composed of the particles 56 that are in a range of 0.05 (μm) to 20 (μm) inclusive in size, or in a range more wider than this range. It should be noted here that particles of less than 0.05 (μm) in size cannot be used in reality because they are difficult to generate, and even if they are generated, they are difficult to aggregate after the dispersion. On the other hand, particles of more than 20 (μm) in size cannot be used in reality because they absorb the resonance lines and molecular beams that are generated in the discharge spaces 30, thus decrease the panel luminous efficiency.

3. Confirmation Experiment

The following describes an experiment that was conducted to confirm the above-described advantages of the PDP 3 in the present embodiment.

The PDPs used in the experiment were manufactured with the following procedures. First, MgO particles whose diameter is in a range of 0.1 (μm) to 0.6 (μm) inclusive were dispersed on the surface of the phosphor layers 55 in the back panel by the dispersion method. The coverage ratio of the high γ members (portions where the particles 56 are formed) to the surface of the phosphor layers 55 was defined as approximately 10(%). The diameter of the particles 56 after the dispersion and aggregation was in a range of 0.2 (μm) to 5 (μm) inclusive. Also, for the PDPs used in the experiment, the rate of partial pressure of Xe to the total pressure of the discharge gas filled in the discharge spaces 30 was set to approximately 15(%).

In the experiment, the PDPs with the above-described structure were driven for display, and the luminous efficiency and the stability of the weak discharge generated during reset period T1 were measured. The results showed that, in the PDPs used in the experiment, the firing voltage was lowered when the phosphor layers 55 side becomes a cathode and the weak discharge was generated in a stable manner during the reset period T1, and the image quality was improved due to reduction of erroneous writing. Also, the luminous efficiency was improved up to approximately 2 (lm/W) since the rate of partial pressure of Xe to the total pressure of the discharge gas had been increased up to 15(%).

It is understood from the above-described results of the experiment that in the PDPs subjected to the experiment, the high γ members formed by attaching the particles 56 to the surface of the phosphor layers 55 enables the weak discharge to be generated in a stable manner during the reset period T1 while a high luminous efficiency is maintained. It is preferable in attaching the particles 56 that the first particle diameter of the particles when they are dispersed is in a range of 0.05 (μm) to 1 (μm) inclusive, and that the second particle diameter of the particles after the dispersed particles aggregate with each other is in a range of 2 (μm) to 20 (μm) inclusive.

Also, with the high γ members, the PDP of the present embodiment can stabilize the generation of the weak discharge during the reset period T1 even if the rate of partial pressure of Xe to the total pressure of the discharge gas is set to as high as 5(%) or more, thus can increase the luminous efficiency.

Embodiment 4

The structure of a PDP 4 of Embodiment 4 will be described with reference to FIGS. 7A, 7B and 8. The front panel 10 and a back panel 60 excluding particles 66 are structured in the same manner as in Embodiments 1-3, and description thereof is omitted.

1. Structure of PDP 4

Figure 7A:
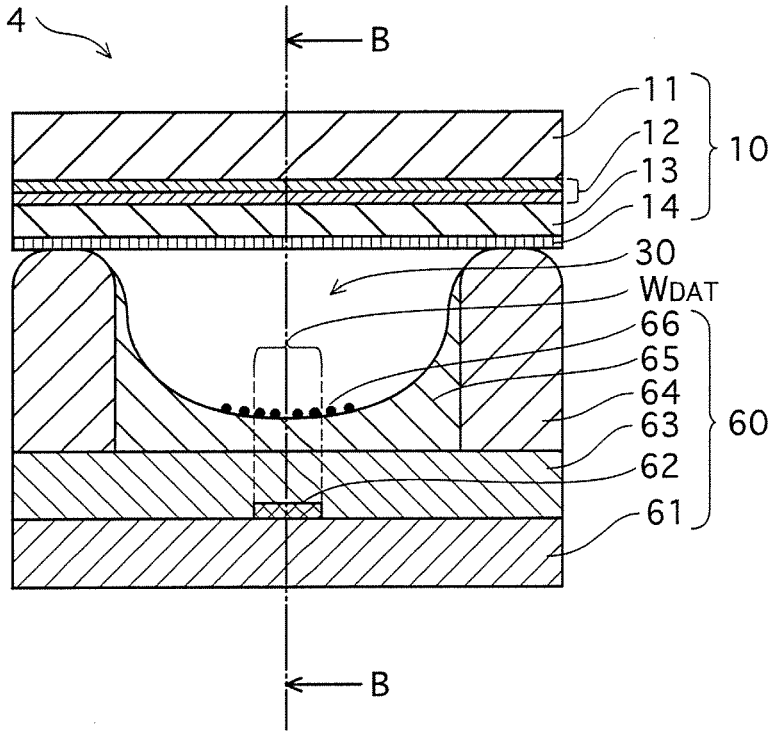
FIGS. 7A, 7B are main part cross-sectional views showing the structure of the PDP 4 in Embodiment 4.
Figure 7B:
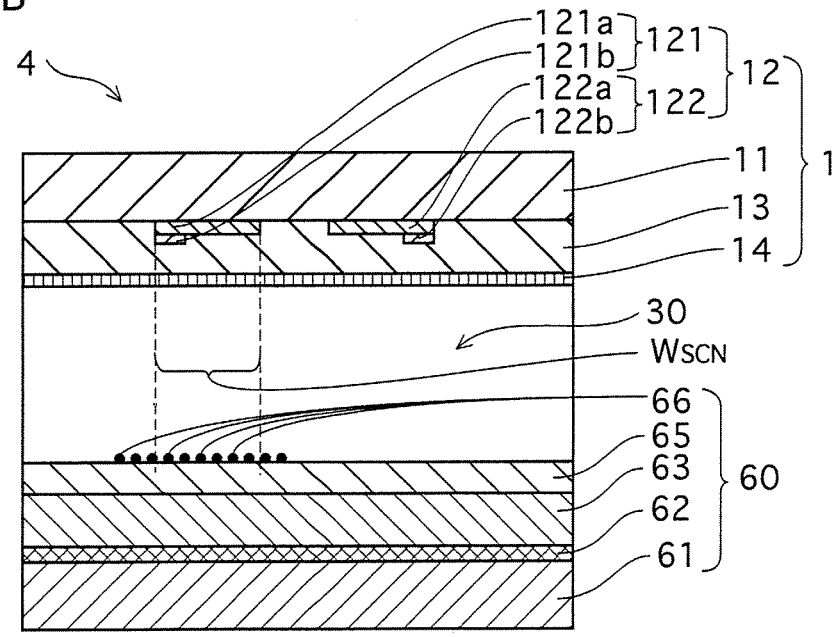

As shown in FIG. 7A, the particles 66 in the PDP 4 are formed on part of the surface of phosphor layers 65 in areas $W_{DAT}$ that are located directly above the Dat electrodes 62. Also, as shown in FIG. 7B, the particles 66 are formed in areas $W_{SCN}$ that are located directly below the Scn electrodes 121 constituting the display electrode pairs 12 formed in the front panel 10. That is to say, the high γ members are formed by forming the particles 66 in the same location as in Embodiment 2.

In the PDP 4, the coverage ratio of the particles 66 to the surface of the phosphor layers 65 is in a range of 1(%) to 50(%) inclusive, and more preferably, in a range of 3(%) to 20(%) inclusive, for the same reason as described earlier.

The particles 66 are made of a material that has a higher value of the secondary electron emission coefficient γ than each phosphor material of the phosphor layers 65, as is the case with Embodiment 1. For example, the particles 66 are made of the same material as the phosphor-coating films 26, 46 and 56.

In the present embodiment, each group of the particles 66 is formed in correspondence with an area in which a weak discharge is to be generated in the reset period T1, namely an area where the Scn electrode 121 and the Dat electrode 62 intersect with each other. With this structure having the high γ members formed in this manner, the weak discharge (reset discharge) is generated in a stable manner when a ramp waveform voltage pulse is applied between the Scn electrode 121 and the Dat electrode 62 during the reset period T1. The stability in generating the weak discharge is more excellent than conventional PDPs especially when the rate of partial pressure of Xe to the total pressure of the discharge gas is increased to 5(%) or more.

Accordingly, the PDP 4 of the present embodiment can generate the weak discharge in a stable manner during the reset period T1, and thus achieves both high luminous efficiency and high image quality.

2. Method of Attaching Particles 66

The method of attaching the particles 66 in the PDP 4 of the present embodiment will be described with reference to FIG. 8. FIG. 8 is a schematic cross section showing the process of attaching the particles 66. It should be noted here that in FIG. 8, only four barrier ribs 64 are formed in the back panel for the sake of drawing convenience, but the practically used back panel includes 32 barrier ribs 64.

Figure 8:
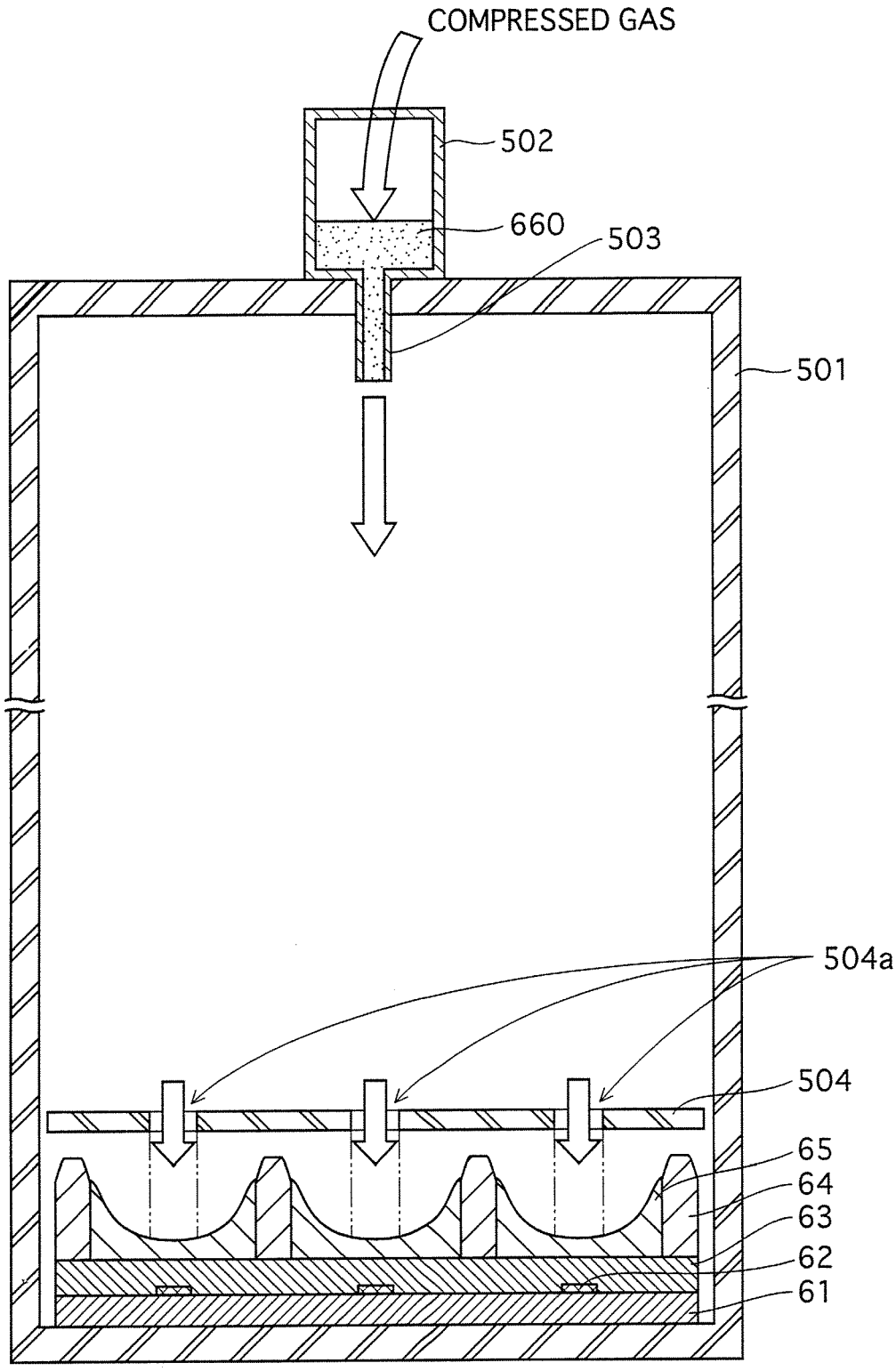
FIG. 8 is a schematic apparatus diagram showing the process of forming the particles 66 in the PDP 4.

As shown in FIG. 8, a back substrate 61 is placed on the inside bottom of a dispersion container 501. Here, the back substrate 61 is placed to be substantially horizontal in the dispersion container 501. On the back substrate 61 placed in the dispersion container 501, a plurality of Dat electrodes 62 are formed. The surface of the back substrate 61 with the Dat electrodes 62 thereon is covered with a basic dielectric layer 63. On the basic dielectric layer 63, barrier ribs 64 and phosphor layers 65 are formed.

Next, a metal mask 504, which includes holes 504*a* that are made in a desired pattern, is arranged on the back substrate 61 in the dispersion container 501. Although omitted in FIG. 8, fixtures are used to fix the metal mask 504. That is to say, in the actuality, the metal mask 504 is fixed by fixtures or the like so that the holes 504*a* are not shifted in position relative to the back substrate 61 and the dispersion container 501.

The dispersion container 501 is provided with a particles inserting unit 502 at an upper portion thereof. A predetermined amount of particles 660 of, for example, MgO and the like are put into the particles inserting unit 502. Then a compressed gas of nitrogen gas or the air is supplied to the particles inserting unit 502 to cause the particles 660 to be ejected with a great force from a nozzle 503 toward the surface of the phosphor layers 65 on the back substrate 61. After such an ejection of the particles 660, the compressed gas is stopped to be supplied to allow the particles 660 to fall freely for a certain period of time. In this way, the particles are dispersed onto the surface of the phosphor layers 65.

The particles 660 having been dispersed on the surface of the phosphor layers 65 are dried. This causes the particles 66 to be formed as the high γ members.

Here, the coverage ratio of the particles 66 to the surface of the phosphor layers 65 is in a range of 1(%) to 50(%) inclusive, and more preferably, in a range of 3(%) to 20(%) inclusive, as is the case with the earlier descriptions. Also, the high γ members are formed at the positions as shown in FIGS. 7A and 7B. These arrangements can be achieved by the setting of the holes 504*a* in the metal mask 504, and the setting of position of the metal mask 504 relative to the back substrate 61.

The shape, size, dispersion conditions and the like of the dispersion container 501 are appropriately set based on the shape and size of the particles 66, the quality of the material of the particles 660, and so on. As for the dispersion, it is possible to perform a uniform dispersion by a certain method such as the electrification. Also, it is possible to adopt various methods such as a dry method and a wet method to restrict the aggregation of particles. These methods can readily be realized by using the spacer dispersion method that is used in manufacturing liquid crystal panels, and thus the description thereof is omitted here.

To form the particles 66, a spray method, a dispersion accumulation method, an electrodeposition method or the like may be used, as well as the dispersion method. For example, the particles 66 are formed by the spray method as follows: a resist mask having a predetermined pattern is formed on the surface of the phosphor layers 65; a mixed organic solvent containing the particles 660 and ethanol is sprayed onto the resist mask; the sprayed solvent is dried; and the resist mask is removed. These procedures enable the particles 66 to be formed in the predetermined pattern, as shown in FIGS. 7A and 7B.

Also, the particles 66 can be formed by the dispersion accumulation method as follows: a resist mask having a predetermined pattern is formed on the surface of the phosphor layers 65; the particles 660 floating on the surface of a mixed organic solvent are allowed to sink silently to be accumulated on the bottom; the organic solvent is dried; and the resist mask is removed.

Furthermore, the particles 66 can be formed by the electrodeposition method as follows: a voltage is applied to the back substrate 61 side using the Dat electrodes 62 formed on the back substrate 61 within electrolysis solution that contains the particles 660; this allows the particles 660 to be electrically charged and to be dragged to and attached to the surface of the phosphor layers 65 at positions directly above the Dat electrodes 62. In this way, the particles 66 are formed at the desired positions by this method.

Embodiment 5

The structure of a PDP 5 of Embodiment 5 will be described with reference to FIGS. 9A and 9B.

1. Structure of PDP 5

Figure 9A:
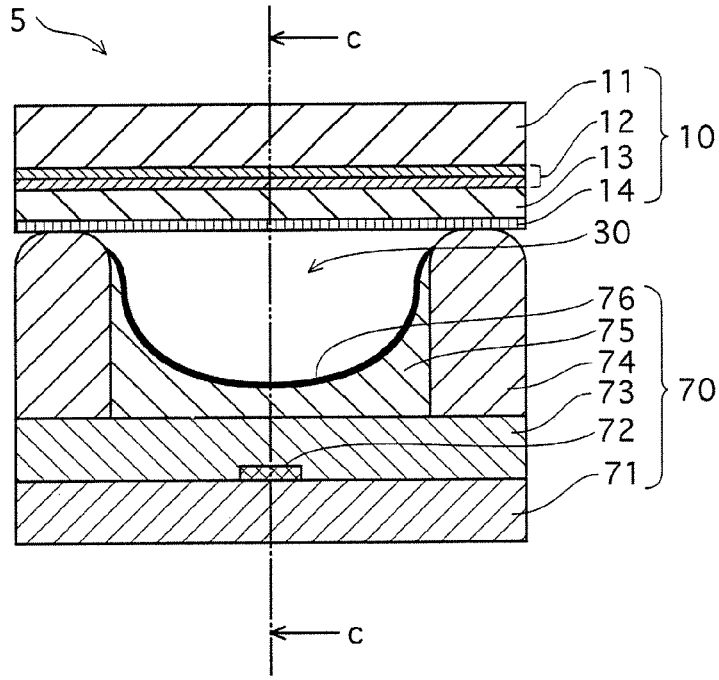
FIGS. 9A and 9B are main part cross-sectional views showing the structure of the PDP 5 in Embodiment 5.
Figure 9B:
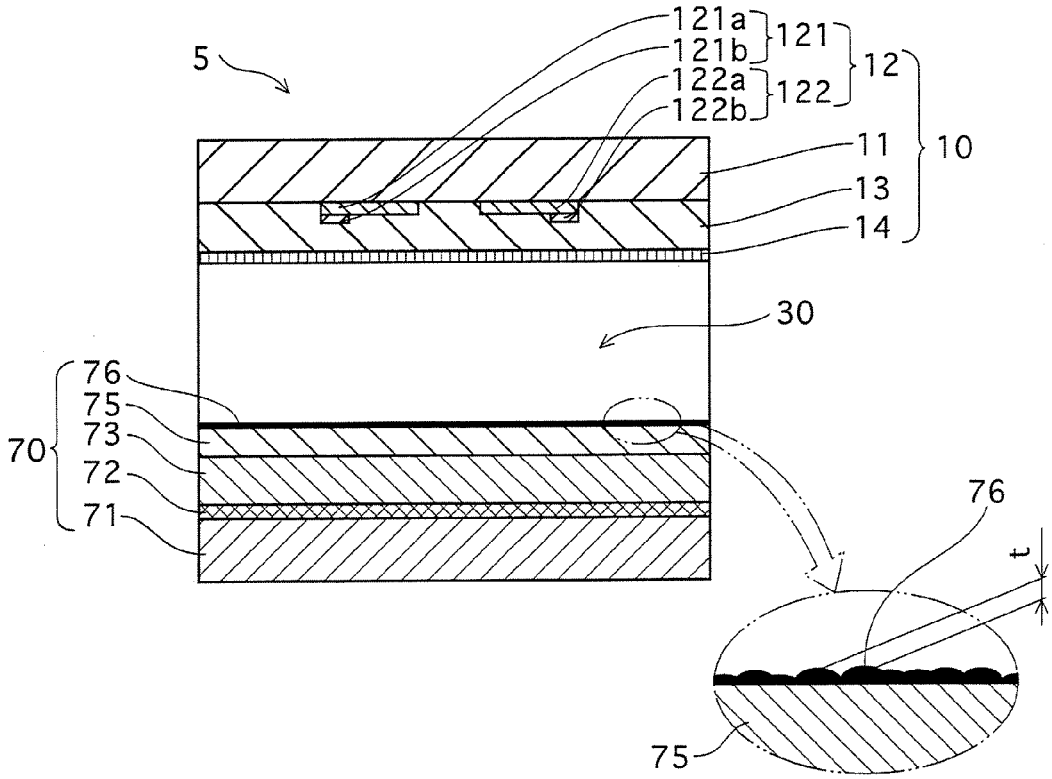

As shown in FIGS. 9A and 9B, in the PDP 5 of the present embodiment, phosphor-coating films 76 are formed on the surface of phosphor layers 75 so as to cover the substantially whole surface of the phosphor layers 75 in the back panel 70. Note that the PDP 5 of the present embodiment has the same constituent elements as the PDPs 1-4 of Embodiment 1-4, except for the phosphor-coating films 76. The phrase "cover the substantially whole surface" means to allow pin holes, formation unevenness and the like that are generated during the manufacturing process.

The PDP 5 of the present embodiment differs from the PDPs 1-4 in Embodiments 1-4 in that the phosphor-coating films 76 are formed on the surface of phosphor layers 75 so as to cover the substantially whole surface of the phosphor layers 75. Furthermore, the phosphor-coating films 76 of the present embodiment differs from the MgO film of Document 1 in that the film thickness t of the phosphor-coating films 76 is defined. That is to say, in the PDP of Document 1, the MgO films are formed on the surface of phosphor layers so as to cover the whole surface of the phosphor layers, and the thickness of the MgO films is not defined. For this reason, the PDP of Document 1 may provide as low luminous efficiency as cannot be acceptable in practical use, which will also be understood from the experiment results shown in Embodiment 1.

In contrast, in the PDP 5 of the present embodiment, as shown in the enlarged part in FIG. 9B, the film thickness t of the phosphor-coating films 76, which are formed to cover substantially the whole surface of the phosphor layers 75, is defined to be in a range of 1 (nm) to 10 (nm) inclusive. With such very thin phosphor-coating films 76, most of the resonance lines and molecular beams generated in the discharge spaces 30 transmits into the phosphor layers 75 without being absorbed by the phosphor-coating films 76. This structure prevents the panel luminous efficiency of the PDP 5 from greatly decreasing.

The phosphor-coating films 76 of the PDP 5, although the film thickness t thereof is defined to be very thin, namely defined to be in the above-indicated value range, the firing voltage is lowered when the phosphor layers 75 side becomes a cathode and the weak discharge is generated in a stable manner, as is the case with Embodiments 1-4. These advantages do not change even if the rate of partial pressure of Xe to the total pressure of the discharge gas is increased to 5(%) or more for the purpose of improving the luminous efficiency.

The phosphor-coating films 76 are made of a material that has a higher value of the secondary electron emission coefficient γ than each phosphor material of the phosphor layers 75, as is the case with Embodiments 1-4. For example, the phosphor-coating films 76 are made of any of the above-listed materials.

2. Method of Forming Phosphor-Coating Films 76

The phosphor-coating films 76 may be formed by the electronic beam deposition method or the sputtering method. However, in terms of forming the phosphor-coating films 76 very thin as defined above, it is preferable to form the film by the electronic beam deposition method.

The phosphor-coating films 76 can be formed by the electronic beam deposition method in the following procedures.

Coating materials such as MgO are supplied into an electronic beam deposition apparatus. The coating materials are irradiated with an electronic beam. The coating materials irradiated with the electronic beam are deposited on the surface of the phosphor layers 75. In this way, the phosphor-coating films 76 are formed. The use of this formation method hardly causes a damage to the surface of the phosphor layers 75 when forming the phosphor-coating films 76. For this reason, the luminance is not decreased when the phosphor-coating films 76 are formed.

3. Thickness Definition of Phosphor-Coating Films 76

In the PDP 5 of the present embodiment, the film thickness t of the phosphor-coating films 76 is defined to be in the range of 1 (nm) to 10 (nm) inclusive. The reasons are as follows.

When the film thickness t of the phosphor-coating films 76 is less than 1 (nm), it is difficult to keep generating a weak discharge in a stable manner during the reset period T1. That is to say, when the film thickness t of the phosphor-coating films 76 is less than 1 (nm), it is not possible to lower the firing voltage when the phosphor layers 75 side becomes a cathode. This makes it difficult to keep generating a weak discharge in a stable manner, and sometimes a strong discharge is generated.

Figure 10:
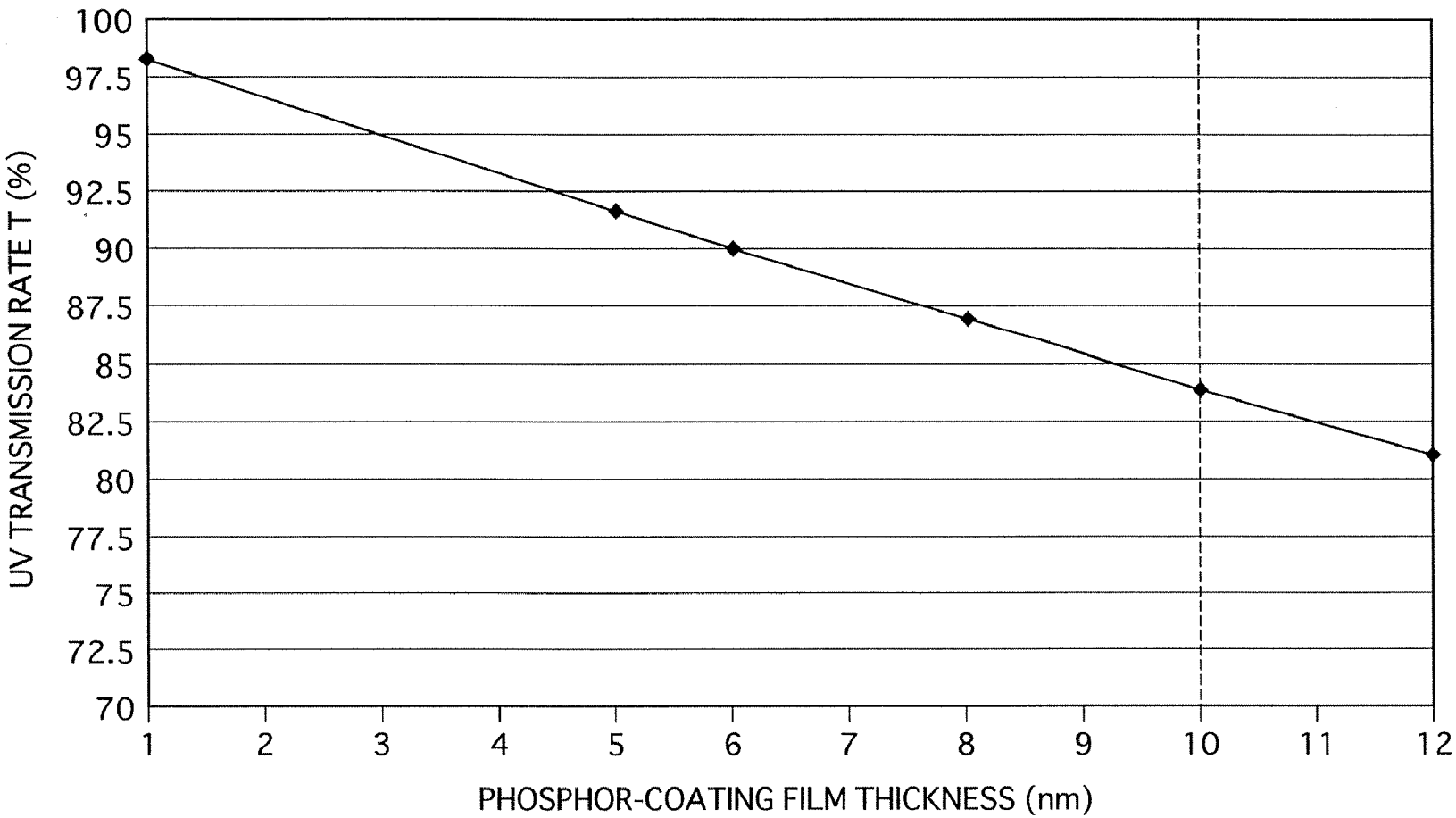
FIG. 10 shows the relationships between the phosphor-coating film thickness and the ultraviolet transmission rate.

On the other hand, as shown in FIG. 10, when the film thickness t of the phosphor-coating films 76 is more than 10 (nm), the ultraviolet transmission rate is smaller than approximately 83(%). This increases the amount of resonance lines and molecular beams absorbed by the phosphor-coating films. If the partial pressure of Xe in the discharge gas is increased from the current 5(%) to 10(%), the luminance is improved to approximately 120(%). If, in this condition, the film thickness t of the phosphor-coating films 76 is set to be more than 10 (nm), the ultraviolet transmission rate decreases to 83(%) or less, and this cancels out the improvement of the luminous efficiency. As will be understood from this, when the phosphor-coating films that are 10 (nm) or thicker are formed, the demerit of forming them cancels out the merit that a weak discharge is generated in a stable manner. It is accordingly unpractical to set the phosphor-coating films to be as thick as this.

It should be noted here that although FIG. 10 shows the relationships between the phosphor-coating film thickness and the ultraviolet transmission rate based on the phosphor layers that are made of $BaMg_2Al_{14}O_{24}$:Eu (BAM), the similar results are obtained when the phosphor layers are made of the other materials.

In the PDP 5 of the present embodiment, the film thickness t of the phosphor-coating films 76, which are formed to cover substantially the whole surface of the phosphor layers 75, is defined to be in the above-described value range. However, the film thickness t needs not to be uniform all over the whole of the phosphor-coating films 76. In case the phosphor-coating films 76 have a slight amount of portion in which the film thickness t exceeds 10 (nm), the similar advantages can be obtained if the film thickness t is effectively in the range of 1 (nm) to 10 (nm). In reality, the surface of the phosphor layers 75 is irregular, and therefore there may be locally a slight amount of portions, such as portions between particles, in which the film thickness t exceeds 10 (nm). However, this does not influence the advantageous effects of the PDP 5 of the present embodiment.

<Supplementary Notes on Embodiments 1-5>

The above-described Embodiments 1-5 are provided as examples to explain the structure of the present invention and the advantageous effects produced by the structure. The present invention is not limited to the embodiments. For example, in the PDPs described in Embodiments 1-5, three types of electrodes: Scn electrodes 121; Sus electrodes 122; and Dat electrodes 22, 42, 52, 62, and 72 are used to drive the panel for display. However, fourth-type and/or fifth-type electrodes may be provided in the back panels 20, 40, 50, 60, and 70, and voltages may be applied to these electrodes during the reset period T1 through the sustain period T3.

In the PDPs 1-5 in Embodiments 1-5, in the back panels 20, 40, 50, 60, 70, the barrier ribs 24, 44, 54, 64, 74 are formed in stripes in parallel with the Dat electrodes 22, 42, 52, 62, 72. However, the barrier ribs 24, 44, 54, 64, 74 may be formed in parallel crosses or in meander-like fashion, as well as in stripes.

Also, the waveforms of the pulses to be applied are not limited to those shown in FIG. 3, but may be varied in many ways. For example, a drive method, in which one field is divided into nine or more sub-fields or seven or less sub-fields, instead of eight sub-fields SF1 to SF8, may be adopted.

In Embodiment 1, the phosphor-coating films 26 are formed on the surface of the phosphor layers 25 to align regularly, as shown in FIG. 1 and FIGS. 2A and 2B. However, not limited to this, the phosphor-coating films may be formed to be arranged irregularly. Also, the phosphor-coating films may be formed in stripes, instead of in dots as shown in FIGS. 2A and 2B.

Further, the PDPs in the above-described embodiments may be varied in various ways in terms of the materials, formation methods and the like. Also, the formation methods of the phosphor-coating films 26, 46, 76 or the formation methods of the particles 56, 66 may be modified based on the formation methods or the materials to be used.

Embodiment 6

The structure of a PDP 6 of Embodiment 6 will be described.

1. Structure of PDP 6

Figure 11:
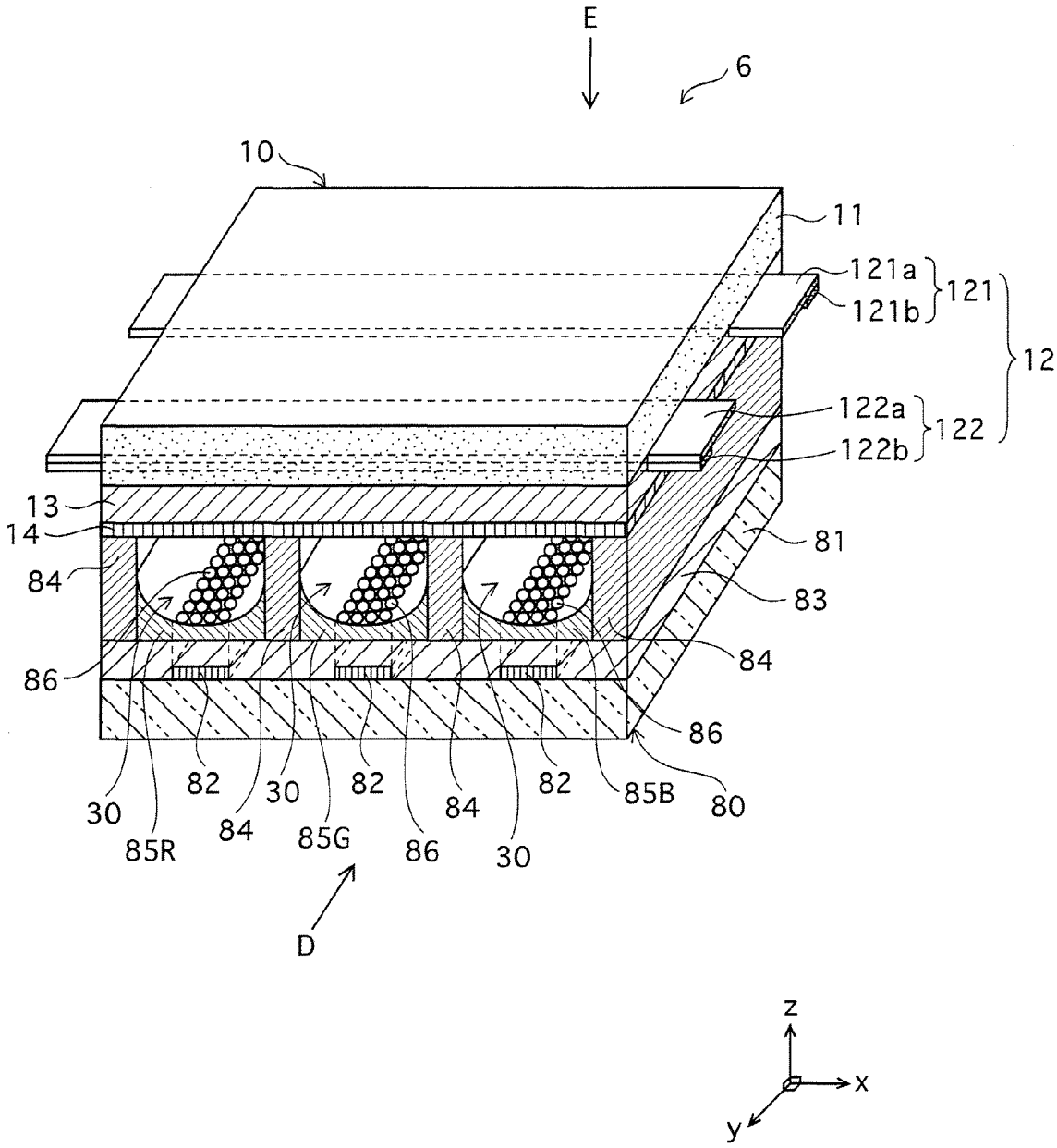
FIG. 11 is a main part perspective view (partially sectional view) showing a portion constituting one pixel in the PDP 6 of Embodiment 6.
Figure 12A:
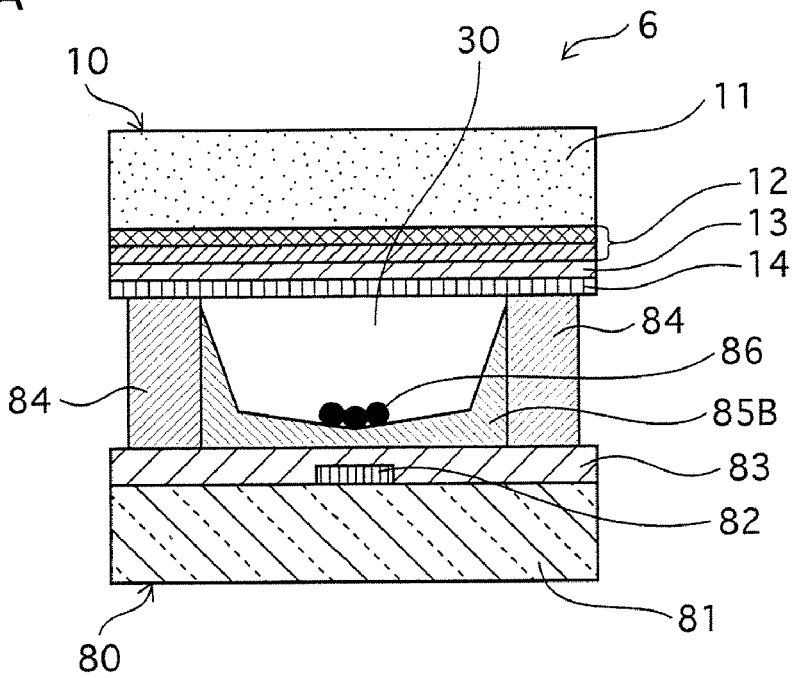
FIG. 12A is an enlarged view of a discharge cell viewed in the D direction indicated in FIG. 11.
Figure 12B:
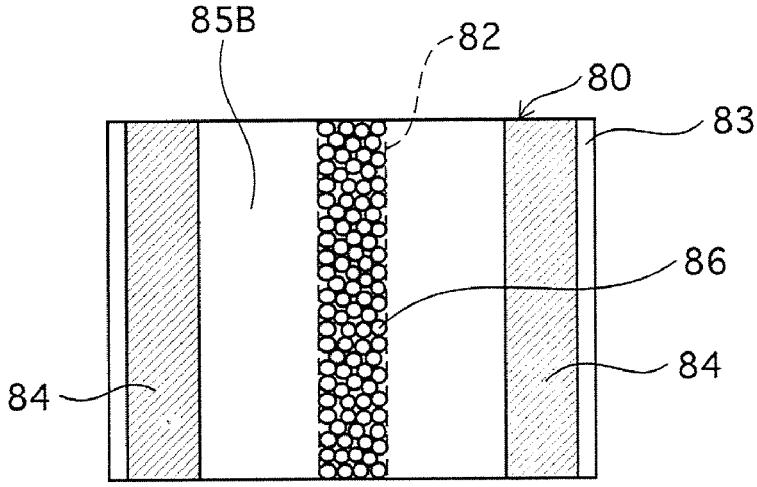
FIG. 12B is a plan view of the back panel 80, viewed in the E direction indicated in FIG. 11, where the front panel 10 has been removed for the sake of convenience.

FIG. 11 is a main part perspective view (partially sectional view) showing a portion of the PDP 6 constituting one pixel. FIG. 12A is an enlarged view of a discharge cell viewed in the D direction indicated in FIG. 11. FIG. 12B is a plan view of the back panel, viewed in the E direction indicated in FIG. 11, where the front panel 10 has been removed for the sake of convenience. Note that the PDP 6 of the present embodiment has the same constituent elements as the PDPs 1-5 of Embodiment 1-5, except for the back panel 80. Description of the same constituent elements is omitted.

The back panel 80 in the PDP 6 includes a back substrate 81, Dat electrodes 82 formed on the surface of the back substrate 81, and a dielectric layer 83 that is formed to cover the surface of the back substrate 81 on which the Dat electrodes 82 have been formed. The "surface" here means a surface that is positioned on the discharge spaces 30 side, as is the case with the front panel 10. In other words, the "surface" means a surface that faces toward the discharge spaces 30. More specifically, the "surface" is an upper surface of the back substrate 81 in the Z axis direction.

The Dat electrodes 82 are provided for the purpose of writing image data, are positioned substantially at the center of each discharge cell, and extend in stripes in a direction (the Y axis direction indicated in FIG. 11) perpendicular to a direction in which the plurality of display electrode pairs 12 extend. Also, as described in the Background Art section, discharge cells are discharge units and are areas that are formed at three-dimensional intersections of the display electrode pairs 12 and the Dat electrodes 82.

Barrier ribs 84 are formed in stripes along the extension direction of the Dat electrodes 82 on the dielectric layer 83 in the back panel 80, dividing the space into the plurality of discharge spaces 30, as shown in FIGS. 11, 12A, and 12B.

Phosphor layers 85R, 85G, and 85B are provided in the dents that are encircled by the dielectric layer 83 and the barrier ribs 84, where each dent has one of the three luminous colors. Further, high γ members 86 are formed on part of the surface of the phosphor layers 85R, 85G, and 85B. As is the case with Embodiments 1-5, the high γ members 86 are made of a material that is different from and has a higher value of the secondary electron emission coefficient γ than each phosphor material of the phosphor layers 85R, 85G, and 85B. That is to say, in the PDP 6 of the present embodiment, the high γ members 86 are formed unevenly with respect to the area, on the surface of the phosphor layers 85R, 85G, and 85B.

As is the case with Embodiment 4, the high γ members 86 are formed unevenly with respect to the area, on the surface of the phosphor layers 85R, 85G, and 85B. More specifically, the high γ members 86 exist, unevenly with respect to the area, on the surface of the phosphor layers 85R, 85G, and 85B, in portions that correspond to the front surface of the Dat electrodes 82. It should be noted here that, as will be described later in the present embodiment, the high γ members 86 are composed of MgO particles, as is the case with Embodiments 1-5. For this reason, the high γ members 86 are represented as particles in FIG. 12A, for the sake of convenience.

The PDP 6 is driven for display in the same manner as the PDP 1 in Embodiment 1. Description thereof is therefore omitted here.

2. Structure Example

The structure of the PDP 6 of the present embodiment will be described. It should be noted here that the structure is provided merely as an example, and the present invention is not limited to the structure.

First, a front plate 3 will be described.

The Scn electrodes 121 and transparent electrodes 121*a* and 122*a*, which constitute the Sus electrodes 122, are made of ITO, $SnO_2$, ZnO and the like, and bus lines 121*b* and 122*b* are made of Cr—Cu—Cr, Ag and the like.

The dielectric layer 13 of the front panel 10 is made of a low melting point glass, and is formed as follows. First, the paste of the low melting point glass is applied onto the surface of the front substrate 11 on which the display electrode pairs 12 have been formed, by the screen printing method or the like, and then the applied glass paste is baked.

The dielectric protective layer 14 is formed by the thin film process or the printing method. Typically, an electrically insulating, transparent MgO film is used as the material of the dielectric protective layer 14. The thickness of the dielectric protective layer 14 is, for example, approximately 0.6 (μm). It should be noted here that MgO used as the material of the dielectric protective layer 14 has a high secondary electron emission coefficient γ, is transparent and excellent in sputtering resistance.

The Dat electrodes 82 in the back panel 80 are made of Ag. The width (length in the X axis direction in FIG. 11) of the Dat electrodes 82 is 100 (μm).

The dielectric layer 83 in the back panel 80 is made of a low-melting glass, as is the case with the dielectric layer 13 in the front panel 10, and can be formed by the same method as the dielectric layer 13.

Barrier ribs 84 are also made of a low-melting glass. The barrier ribs 84 are formed as follows. First, a paste of the low-melting glass is applied onto the surface of the dielectric layer 83, and the applied paste is baked. Then, the resultant layer is cut into stripes that correspond to the discharge spaces 30 extending in the extension direction of the Dat electrodes 82, by the sand blast method, photolithography method or the like.

The phosphor layers 85R, 85G, and 85B respectively emit lights of red, green, and blue, and contain phosphors such as (Y,Gd) $BO_3$:Eu, $Zn_2SiO_4$:Mn, and $BaMg_2Al_{14}O_{24}$:Eu. The phosphor layers 85R, 85G, and 85B are formed by applying the materials onto side surfaces of the barrier ribs 84 and to the surface of the dielectric layer 83 in areas excluding the areas in which the barrier ribs 84 are formed, and baking the applied materials, for each luminous color of the phosphors.

The high γ members 86 are made of a metal oxide that is different from and has a higher value of the secondary electron emission coefficient γ than each phosphor material of the phosphor layers 85R, 85G, and 85B. The metal oxide as the material of the high γ members 86 is, for example, MgO, as is the case with Embodiments 1-5. The high γ members 86 are composed of particles whose diameter is in a range of 0.05 (μm) to 1 (μm) and are formed to be 1 (μm) in thickness, directly above the Dat electrodes 82. How to form the high γ members 86 will be described later in detail.

A rare gas used as the discharge gas is, for example, a rare gas containing xenon and neon. The discharge gas is filled with a filling pressure of approximately 60 (kPa). Also, the rate of partial pressure of Xe to the total pressure of the discharge gas is 15(%).

4. Method of Forming High γ members 86

The method of forming the high γ members 86 is outlined as follows. The material of the high γ members 86, which is different from and has a higher value of the secondary electron emission coefficient γ than each phosphor material of the phosphor layers 85R, 85G, and 85B (hereinafter, the sign "85R, 85G, and 85B" is represented by the sign "85"), is electrically charged. Then the electrically charged material is accumulated in the area directly above the Dat electrodes 82, by the static electricity. The high γ members 86 are formed in this way (this formation method is referred to as "voltage-applied particles dispersion accumulation method").

Figure 13A:
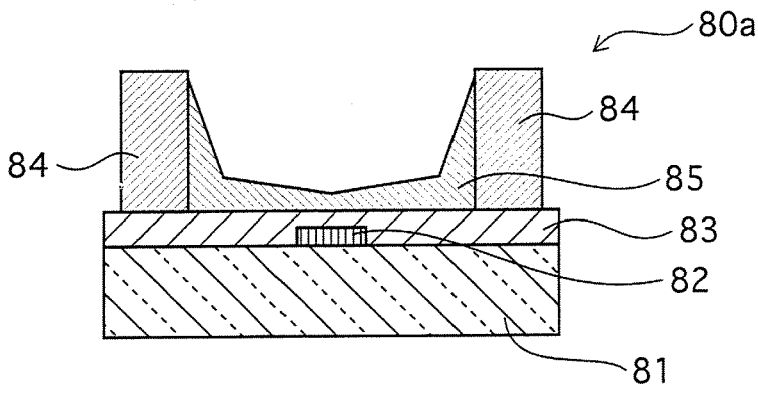
FIGS. 13A to 13C illustrate the method of forming the high γ members 86 in Embodiment 1.
Figure 13B:
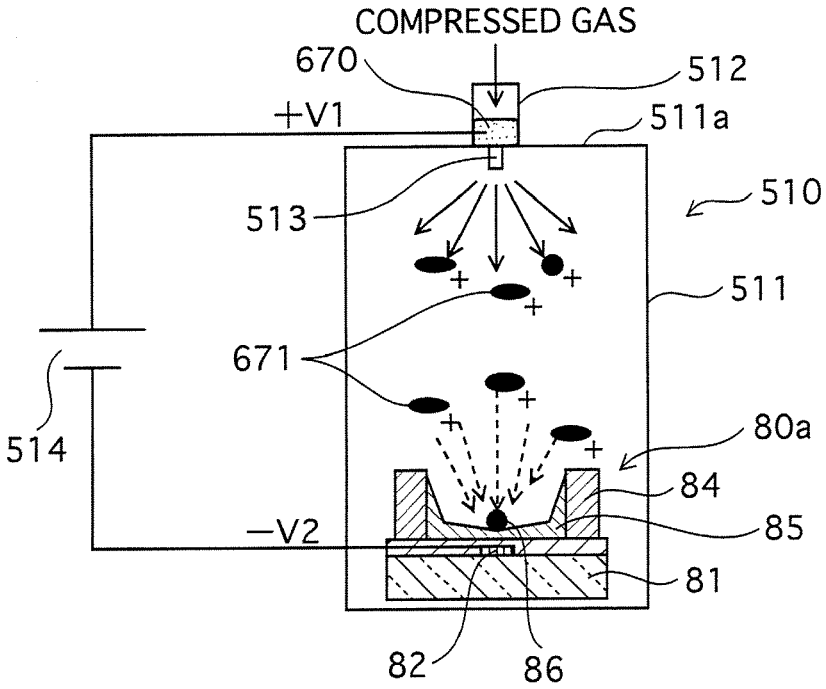
Figure 13C:
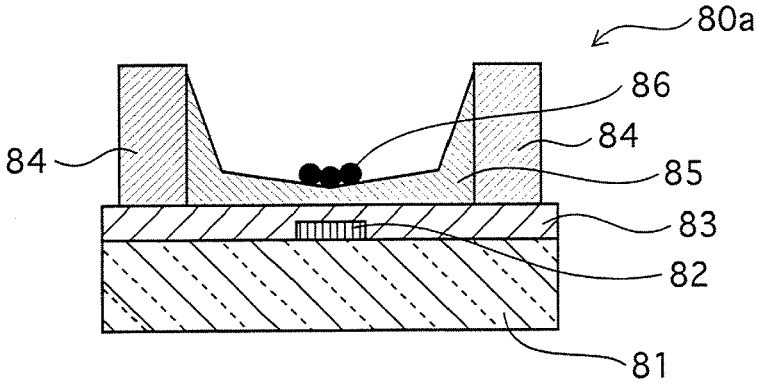

As described above, the high γ members 86 are formed through: an electrical charge step in which metal particles, the material thereof, are electrically charged; and an accumulation step in which the Dat electrodes 82 are made to have a lower potential than the electrically charged metal particles so that the metal particles are accumulated, by the static electricity, into the areas of the surface of the phosphor layers 85 directly above the Dat electrodes 82. The following describes the formation method in detail with reference to FIGS. 13A to 13C. FIGS. 13A to 13C illustrate the method of forming the high γ members 86.

In the following description, as one example, MgO (particles) is used as the material of the high γ members 86.

As shown in FIG. 13A, a plate 80*a* in which the barrier ribs 84 have been formed is prepared to form the back panel 80. It should be noted here that the plate 80*a* is also referred to as "pre-stage back panel" because the back panel 80 is completed by forming the high γ members 86 on the plate 80*a*, namely, the plate 80*a* is in the pre-stage of the back panel 80. The pre-stage back panel 80*a* includes the back substrate 81, Dat electrodes 82, dielectric layer 83, and barrier ribs 84, which have been described in terms of the structure. Also, the phosphor layers 85 are formed by applying the materials onto side surfaces of the barrier ribs 84 and to the surface of the dielectric layer 83 in areas excluding the areas in which the barrier ribs 84 are formed.

The high γ members 86 are formed using a particle dispersion apparatus 510 shown in FIG. 13B. The particle dispersion apparatus 510 includes: a particle dispersion container 511; a particle container 512 for storing MgO particles 670; a high-voltage DC power apparatus 514 for electrically charging the MgO particles in the particle container 512; a dispersion unit for dispersing the electrically charged MgO particles into the particle dispersion container 511; and a voltage application unit for applying a certain level of voltage to the Dat electrodes 82 in the pre-stage back panel 80*a* to accumulate the dispersed MgO particles 671.

The particle container 512 is disposed outside an upper wall 511*a* of the particle dispersion container 511. The dispersion unit includes: a nozzle 513 that allows the inner space of the particle container 512 to communicate with the inner space of the particle dispersion container 511; and a gas filling unit (not illustrated) that fills a compressed gas of a nitrogen gas or the air into the particle container 512.

Also, as shown in FIG. 13B, the electrical charge unit causes the MgO particles 670 in the particle container 512 and the nozzle 513 to be electrically charged, by applying a certain level of voltage to the particle container 512 and the nozzle 513. The application of the voltage to the particle container 512 and the nozzle 513 is performed by a high-voltage DC power apparatus 514. The high-voltage DC power apparatus 514 also applies a voltage to the Dat electrodes 82.

Now, a specific example of formation of the high γ members 86 using the particle dispersion apparatus 510 will be described.

First, as shown in FIG. 13B, a certain amount of MgO particles 670, whose diameter is, for example, in a range of 0.05 (μm) to 1 (μm), is put into the particle container 512 that is disposed on the particle dispersion container 511*a* of the particle dispersion container 511. Then, a positive voltage (+V1) of several thousand (V) to ten thousand (V) is applied, by the high-voltage DC power apparatus 514, to the nozzle 513 and the particle container 512 storing the MgO particles 670 so that the MgO particles 670 are electrically charged.

On the other hand, the high-voltage DC power apparatus 514 applies a certain level of negative voltage (−V2), such as a voltage of −100 (V) to 0 (V), to the Dat electrode 82 in the pre-stage back panel 80*a*, where the voltage applied here is opposed, in polarity, to the voltage that is applied to cause the MgO particles 670 to be electrically charged.

After this, a compressed gas is filled in the particle container 512 so that the electrically charged MgO particles 670 are ejected from the nozzle 513 to be dispersed. With this dispersion, the positively charged MgO particles 671 drop downward.

After this, the filling in of the compressed gas is stopped, and as the dispersed, positively charged MgO particles 671 fall freely, they are attracted by the static electricity of the Dat electrodes 82 to which a predetermined level of negative voltage has been applied. The MgO particles 671 being attracted in this way are eventually accumulated on the surface of the phosphor layers 85 in the areas directly above the Dat electrodes 82. In this way, the high γ members 86 composed of the MgO particles 670 and 671 are formed unevenly with respect to the area, on the surface of the phosphor layers 85, as shown in FIG. 13C.

In the above-described formation of the high γ members 86 by the voltage-applied particles dispersion accumulation method, the electrically charged MgO particles 671 are attracted by the static electricity of the Dat electrodes 82, and are eventually accumulated on the surface of the phosphor layers 85 in the areas directly above the Dat electrodes 82, such that the MgO particles 671 do not attach to areas that are apart from the Dat electrodes 82. This makes it possible to form the high γ members 86 with accuracy in desired areas (to form the high γ members 86 unevenly with respect to the area), with substantially equivalent thickness and desired density.

On the other hand, the thickness of the high γ members 86 can be determined by values of the voltage applied to the Dat electrodes 82 and the amount of the dispersed electrically charged MgO particles 671. Accordingly, with use of the method disclosed in the present embodiment, the thickness of the high γ members 86 can be readily controlled. Furthermore, as shown in FIG. 13C, the MgO particles 671, which are an insulative material, are accumulated, by the static electricity, on the surface of the phosphor layers 85 of the pre-stage back panel 80*a* in the areas directly above the Dat electrodes 82, with substantially equivalent thickness and desired surface density, and the high γ members 86 are formed as shown in FIGS. 11 and 13C.

It should be noted here that, if the high γ members 86 are formed on the surface of the phosphor layers 85 using conventional methods, first the MgO film is formed to cover the whole surface of the phosphor layers by the electronic beam deposition method, and then the MgO film is formed into a desired pattern by the etching or the like. However, with use of the formation method of the present embodiment, the high γ members 86 are formed only by causing the MgO particles 670 to be electrically charged and applying a voltage to the Dat electrodes 82. Such a formation method of the present embodiment enables the high γ members 86 to be formed very easily with high accuracy, compared with the conventional methods.

With the use of the above-described voltage-applied particles dispersion accumulation method, it is possible to form the high γ members 86 with a further equivalent thickness by appropriately setting the various conditions such as the shape of the particle dispersion container 511 of the particle dispersion apparatus 510, the amount and speed at which the compressed gas is filled, the amount of the MgO particles 670 stored in the particle container 512, and the value of the voltage applied to the MgO particles 670. Also, the method is referred to as the voltage-applied particles dispersion accumulation method in the present embodiment. However, the method may be called in any way, in so far as it indicates a method in which the material is electrically charged and is accumulated above the Dat electrodes 82 by the static electricity.

4. Evaluation Experiment

Samples of the PDP 6, in which the high γ members 86 of the present embodiment are formed, were manufactured by the above-described method of the present embodiment, and a screen display test was conducted on the manufactured samples of the PDP 6. In this test, in the reset period T1, a voltage, which has a ramp waveform where the voltage slowly rises and falls over time, was applied between the Scn electrodes 121 and the Dat electrodes 82 on the front panel 10 side; in the write period T2, discharge cells were selected depending on whether the address pulses had been applied; in the sustain period T3, discharges were generated in the selected discharge cells; and it was confirmed whether the image display was performed as desired.

According to the experiment results, in the PDP 6 of the present embodiment, the amount of generated reset luminous points was lowered even when the phosphor layers 85 side became a cathode during the reset period T1, and the reduction of the luminance was restricted. The reduction of the luminous efficiency was restricted to approximately 5(%) of the PDPs in which the high γ members 86 (MgO films) had not been formed on the surface of the phosphor layers.

On the other hand, even in the conventional PDP (with the structure shown in FIG. 26B) in which MgO films (corresponding to the high γ members) 746 had been formed to cover the whole surface of the phosphor layers 85 and barrier ribs 84 that faces toward the discharge spaces 30, the amount of generated reset luminous points was lowered even when phosphor layers 725 side became a cathode during the reset period T1. However, vacuum ultraviolet rays including the resonance lines were absorbed by the films 746 covering the whole surface of the phosphor layers 725, resulting in a large level of reduction of the luminance. The luminous efficiency prominently decreased to approximately 1/10 of the PDPs in which the phosphor layers were not covered with the films 746.

The reason for this is considered to be as follows. That is to say, the high γ members 86, which are made of a material that is different from and has a higher value of the secondary electron emission coefficient γ than each phosphor material of the phosphor layers 85, are formed unevenly with respect to the area, on the surface of the phosphor layers 85 in areas directly above the Dat electrodes 82, and the secondary electrons are emitted from the high γ members 86 in the reset period T1. This reduces the discharge delay when the phosphor layers 85 side becomes a cathode when a ramp waveform voltage is applied, causing a weak discharge to be generated in a stable manner.

Furthermore, the high γ members 86 are formed unevenly with respect to the area, on the surface of the phosphor layers 85 in areas directly above the Dat electrodes 82. With this structure, surface areas of the phosphor layers 85, excluding the areas on which the high γ members 86 are formed, are directly exposed to the discharge spaces 30. It is thought that this structure restricts the reduction in the luminance, and thus restricts the reduction in the luminous efficiency.

5. Others

In the above description, the high γ members 86 are formed on the surface of the phosphor layers 85 in the whole areas directly above the Dat electrodes 82. However, the high γ members 86 may not be formed in the whole areas directly above the Dat electrodes 82. The following will describe Modification 1 of Embodiment 1 in which the high γ members 86 are not formed in the whole areas directly above the Dat electrodes 82.

(1) Structure

Figure 14:
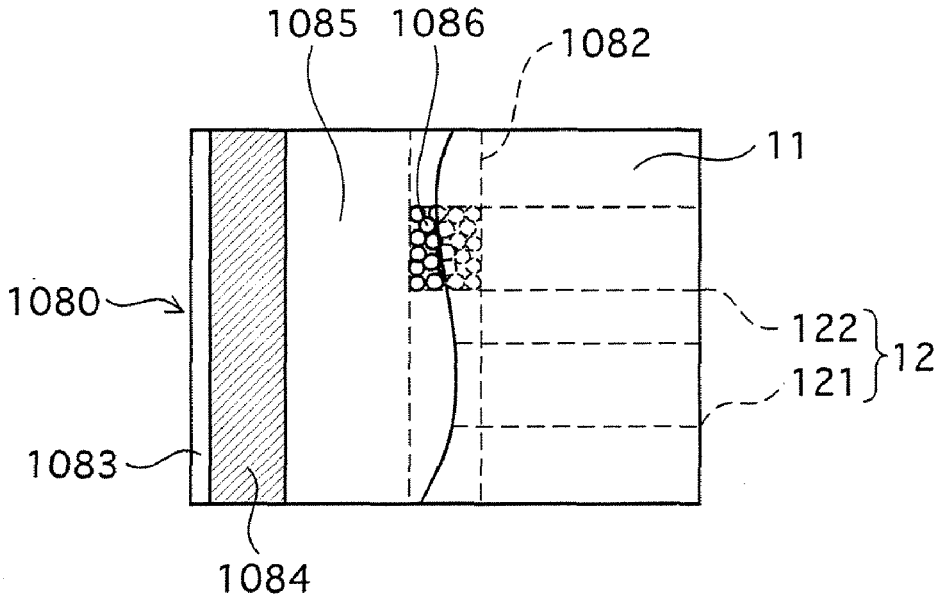
FIG. 14 is a cutaway plan view of a discharge cell in the PDP of Modification 1.

FIG. 14 is a cutaway plan view of a discharge cell in the PDP of Modification 1.

Note that the PDP of Modification 1 has the same constituent elements as the PDP of Embodiment 6, except for (the size of) high γ members 1086 and the areas of phosphor layers 1085 on which the high γ members are formed, thus the same reference signs as Embodiment 6 are used to indicate the constituent elements other than the high γ members 1086 and the phosphor layers 1085. FIG. 14 shows the discharge cell that is viewed in a direction perpendicular to the PDP display surface (a surface of the front substrate 11 of the front panel that is facing away from the discharge spaces 30).

As shown in FIG. 14, each of the high γ members 1086 is formed on the surface of the phosphor layers 1085 at a three-dimensional intersection of the Scn electrode 121 of the display electrode pair 12 and the Dat electrode 1082. That is to say, each of the high γ members 1086 is formed on the surface of the phosphor layers 1085 in an area that is an overlap of an upper surface (facing toward the front panel) of the Dat electrode 1082 and a lower surface (facing toward the back panel 1080) of the Scn electrode 121 in the front panel (the area corresponds to "areas that are formed at three-dimensional intersections of the display electrode pairs 12 and the Dat electrodes 82" of the present invention), when the front panel is viewed in a direction perpendicular to the main surface of the front panel (as shown in FIG. 14).

The high γ members 1086 are made of a material (MgO) that is different from and has a higher value of the secondary electron emission coefficient γ than each phosphor material of the phosphor layers 1085, as is the case with Embodiment 6 or the like. Also, in Modification 1, the phosphor layers 1085 are formed on the surface of the dielectric layer 1083 in areas in which barrier ribs 1084 are not formed. The phosphor layers 1085 are not formed on side surfaces of the barrier ribs 1084 (see FIG. 14).

(2) Formation Method

Figure 15:
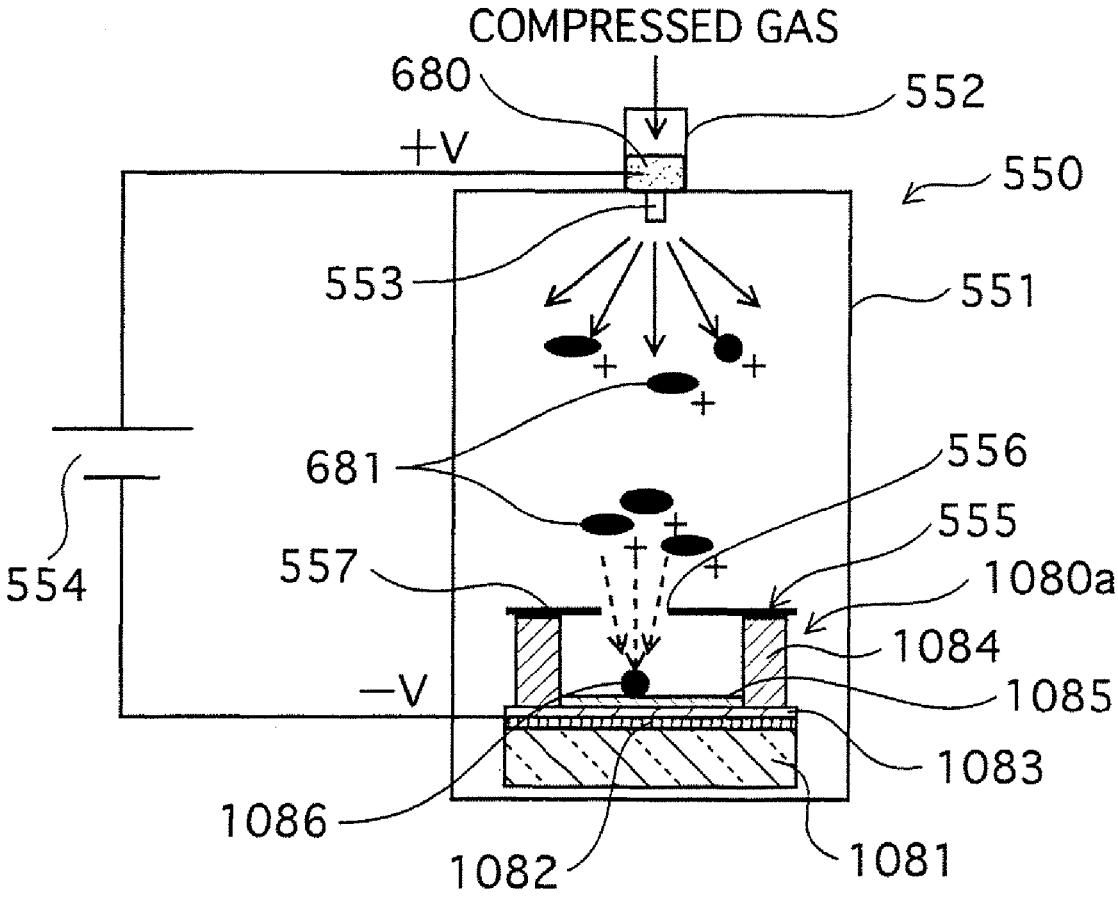
FIG. 15 shows how the high γ members in Modification 1 are formed.

The method of forming the high γ members 1086 of the present modification will be described with reference to FIG. 15. FIG. 15 shows how the high γ members in Modification 1 are formed.

As shown in FIG. 15, the high γ members 1086 of Modification 1 are formed by the voltage-applied particles dispersion accumulation method disclosed in Embodiment 6. In Modification 1, the high γ members 1086 are formed at three-dimensional intersections of the Scn electrodes 121 and the Dat electrodes 1082. Accordingly, a particle dispersion apparatus 550 to be described here differs from the particle dispersion apparatus 510 of Embodiment 1 in that it has a selection unit 555 that is used to form the high γ members 1086 selectively.

The particle dispersion apparatus 550 in Modification 1 includes: a particle dispersion container 551; a particle container 552 for storing MgO particles 680; an electrical charge unit 554 for electrically charging the MgO particles 680 in the particle container 552; a dispersion unit for dispersing the electrically charged MgO particles 680 into the particle dispersion container 551; a voltage application unit 554 for applying a certain level of voltage to the Dat electrodes 1082 in the pre-stage back panel 1080*a* to accumulate the dispersed MgO particles 680; and the selection unit 555 for selectively forming the high γ members 1086.

The selection unit 555 is composed of a mask 557 that includes through holes 556 at positions corresponding to the areas in which the high γ members 1086 are to be formed. When electrically charged MgO particles 680 are dispersed from the nozzle 553, the dispersed, electrically charged MgO particles 681 pass through the through holes 556 of the mask 557 and are accumulated in desired areas that correspond to the openings of the through holes 556. With such an arrangement, the high γ members 1086 are formed unevenly and partially, only in such areas that correspond to the Dat electrodes 1082 of the pre-stage back panel 1080*a* and correspond to portions of the Scn electrodes 121 of the front panel 10 facing toward the back panel 1080.

By using the above-described formation method that uses the selection unit 555, it is possible to form the high γ members 1086 unevenly and partially with ease.

(3) Experiment Results

An evaluation test was also conducted for the PDP of Modification 1, in a similar manner to the PDP 6 of Embodiment 6. According to the experiment results, in the PDP of Modification 1, the amount of generated reset luminous points was lowered even when the phosphor layers 1085 side became a cathode during the reset period T1, and the reduction of the luminance was restricted. The luminous efficiency obtained by the PDP of Modification 1 was higher than the luminous efficiency obtained by the conventional PDP (having the structure shown in FIG. 26B) in which the films 746 as the high γ members had been formed to cover the whole surface of the phosphor layers and barrier ribs that faces toward the discharge spaces.

The reason for this is considered to be as follows. That is to say, the high γ members 1086 of the present modification, which are made of a material that is different from and has a higher value of the secondary electron emission coefficient γ than each phosphor material of the phosphor layers 1085, are formed unevenly and partially, only in such areas that are above the Dat electrodes 1082 and below the Scn electrodes 121. With this structure, when a ramp waveform voltage is applied during the reset period T1, secondary electrons are effectively emitted from the high γ members 1086 that are formed in such areas that are above the Dat electrodes 1082 and below the Scn electrodes 121. This makes it possible to lower the firing voltage when the phosphor layers 1085 side becomes a cathode, which causes a weak discharge to be generated in a stable manner, and restricts the generation of reset luminous points.

Furthermore, the high γ members 1086 are formed unevenly in the areas that are above the Dat electrodes 1082 and below the Scn electrodes 121. That is to say, the areas on the surface of the phosphor layers 1085 in which the high γ members 1086 are not formed are larger in Modification 1 than in Embodiment 6, and as much, the surface areas of the phosphor layers that are directly exposed to the discharge spaces 30 are larger in Modification 1 than in Embodiment 6. It is considered that such a structure of Modification 1 enables the reduction of luminous efficiency to be restricted more than the structure of Embodiment 6.

Embodiment 7

In Embodiment 7, the barrier ribs are formed in what is called parallel crosses, while in Embodiment 6, the barrier ribs are formed in stripes along an extension direction of the Dat electrodes 82.

1. Structure

Figure 16:
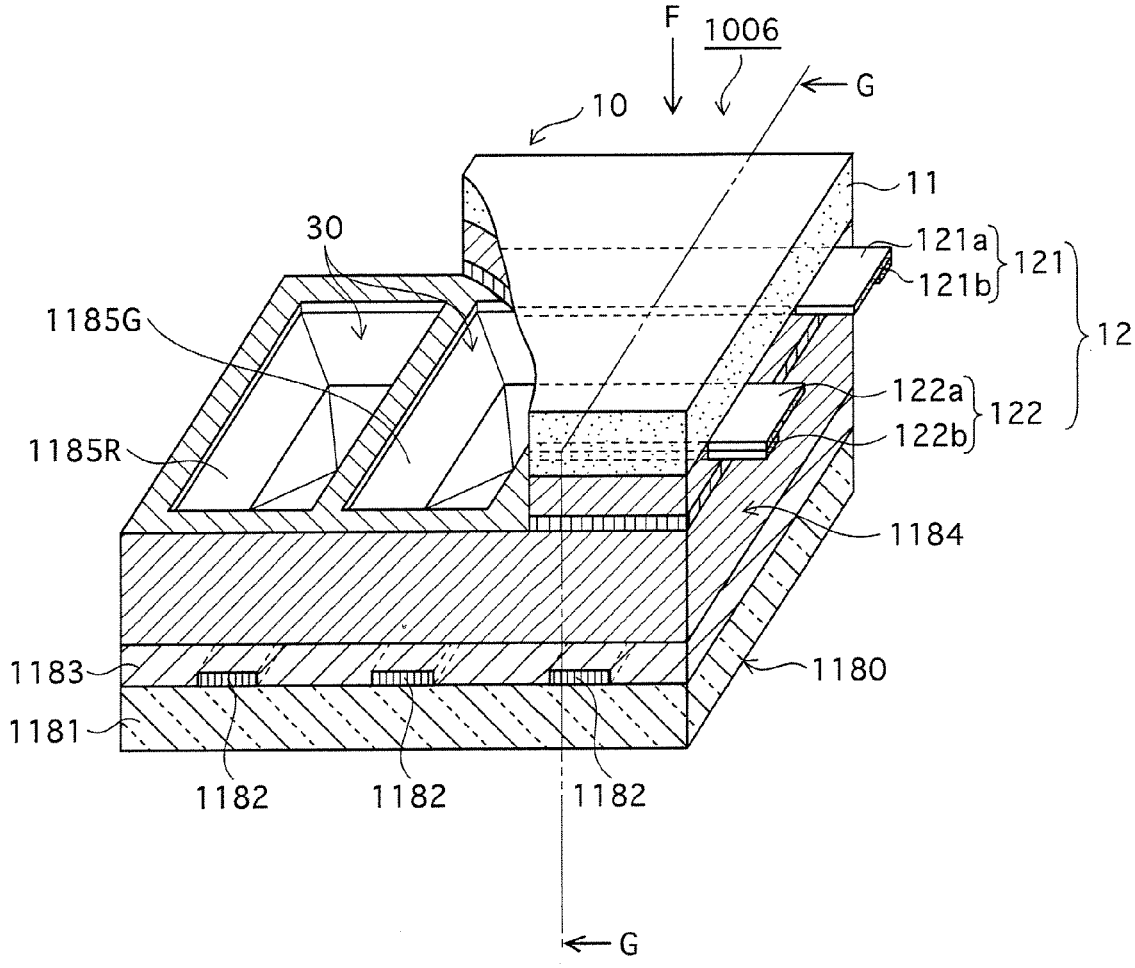
FIG. 16 is a perspective view of a portion constituting a pixel in the PDP 1006 of Embodiment 7, where part of the front panel 10 is cut away to facilitate the understanding of the internal structure of the back panel 1180.
Figure 17A:
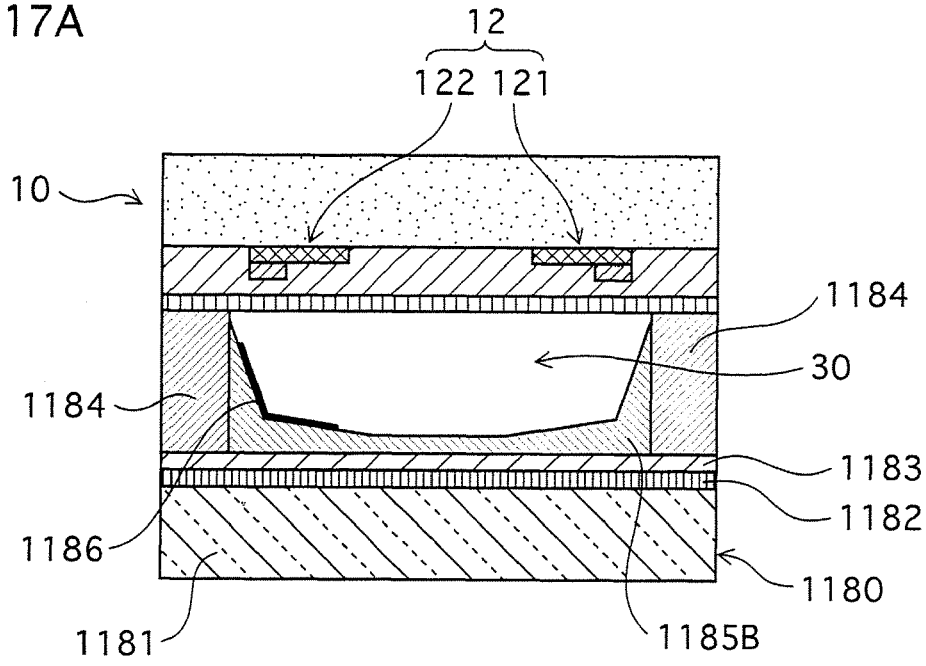
FIG. 17A is a cross sectional view taken along the line G-G shown in FIG. 16.
Figure 17B:
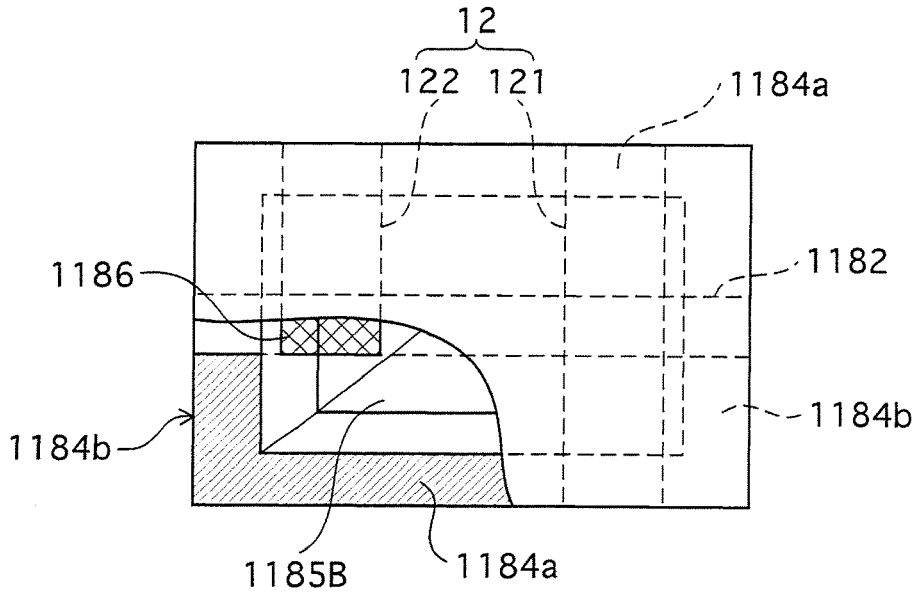
FIG. 17B shows one discharge cell viewed in the F direction.

FIG. 16 is a perspective view of a portion constituting a pixel in a PDP 1006, where part of the front panel is cut away to facilitate the understanding of the structure of the barrier ribs. FIG. 17A is a cross sectional view taken along the line G-G shown in FIG. 16 and viewed from a direction indicated by the arrow. FIG. 17B shows one discharge cell viewed in the F direction. In FIG. 17B, high γ members 1186 are indicated by the hatching. Note that the constituent elements having the same structure as those in Embodiment 6 are indicated by the same reference signs.

As shown in FIG. 16, the front panel 10 includes the front substrate 11, display electrode pairs 12, dielectric layer 13, and dielectric protective layer 14, as is the case with Embodiment 6. Also, each of the display electrode pairs 12 includes the Scn electrode 121 and the Sus electrode 122.

As shown in FIG. 16 and FIG. 17B, the back panel 1180 includes a back substrate 1181, Dat electrodes 1182, a dielectric layer 1183, phosphor layers 1185R, 1185G, and 1185B, barrier ribs 1184 (1184*a*, 1184*b*), and high γ members 1186. The present embodiment differs from Embodiment 6 in the shape of the barrier ribs 1184 and in the shape of the phosphor layers 1185R, 1185G, and 1185B on which the high γ members 1186 are formed.

It should be noted here that the front panel 10 and the back panel 1180 are bonded with each other such that the display electrode pairs 12 of the front panel 10 and the Dat electrodes 1182 of the back panel 1180 intersect orthogonally with each other three dimensionally.

As shown in FIG. 16 and FIGS. 17A and 17B, the barrier ribs 1184 are formed in parallel crosses surrounding each discharge space 30. The barrier ribs 1184 are formed on the dielectric layer 1183 as is the case with Embodiment 6, and divides the inner space into the discharge spaces 30. As shown in FIG. 17B, each barrier rib 1184 is composed of four elements 1184*a* and 1184*b*.

The barrier ribs 1184 are formed as follows. First, a low-melting glass is applied and baked, and then the resulting layer is formed into a parallel-cross pattern by the sand blast method, the photolithography method or the like such that the resulting barrier ribs 1184 divide the inner space into a plurality of discharge cells that are arranged in a matrix in rows and columns.

On the other hand, the phosphor layers 1185R, 1185G, and 1185B (the phosphor layers 1185B are not shown in FIG. 16 for the sake of convenience) are formed on the surface of the dielectric layer 1083 in areas in which barrier ribs 1084 are not formed, and formed on side surfaces of the barrier ribs 1084. As a result, each of the phosphor layers 1185R, 1185G, and 1185B has a bottom on the dielectric layer 1083, and slant portions between side surfaces of the barrier ribs 1084 and the bottom.

The positional relationship between the display electrode pairs 12 of the front panel 10 and the barrier ribs 1184 may be set in various ways. When the display electrode pairs 12 and the barrier ribs 1184 are close to each other, portions of the phosphor layers 1185R, 1185G, and 1185B that are directly below the display electrode pairs 12 are composed of the slant portions and a slight amount of the bottom on the side of the slant portions.

As shown in FIGS. 17A and 17B, each of the high γ members 1086 is formed on the surface of the phosphor layers 1085 in an area where an upper surface of the Dat electrode 1082 and a lower surface of the Scn electrode 121 intersect three dimensionally with each other (an overlapping area of the Dat electrode 1182 and the Scn electrode 121 in a plan view).

As shown in FIG. 17B, especially, the phosphor layers 1185B are slant in portions close to the barrier ribs 1184. As a result, the high γ members 1186 are formed on the surface of the phosphor layers 1185B in the areas of portions that are composed of: the slant portions that are formed on the side surfaces of the barrier ribs 1184*b* positioned outside the Scn electrodes 121; and a slight amount of the bottom on the side of the slant portions.

The high γ members 1186 are made of MgO particles, and are formed by the voltage-applied particles dispersion accumulation method, as is the case with Embodiment 6. Since the high γ members 1186 are formed on partial surfaces of the phosphor layers 1185R, 1185G, and 1185B, the selection unit 555, which is used in Modification 1, or the like needs to be used.

When the surface of the phosphor layers 1185R, 1185G, and 1185B, which are positioned between the Scn electrodes 121 and the Dat electrodes 1182, is slanted as in the present embodiment, the discharge is generated, in appearance, at a position in space near the Scn electrodes 121 and the slant portions of the phosphor layers 1185R, 1185G, and 1185B in the reset period T1. For this reason, when the high γ members 1186 are formed on the surface of the phosphor layers 1185R, 1185G, and 1185B in areas that span from the slant portions to part of the bottom, the secondary electrons emitted from the high γ members 1186 effectively act, and the firing voltage can be lowered effectively.

Embodiment 8

In Embodiments 6 and 7, the high γ members 86 and 1186 are formed by the voltage-applied particles dispersion accumulation method. However, they may be formed by other methods. Embodiment 8 explains how the high γ members 86 and 1186 can be formed by a vapor deposition method. Used here for the explanation is a case where the high γ members 86 are formed in the pre-stage back panel 80*a* described in Embodiment 6.

The high γ members 86 are formed by a vapor deposition method, such as an electron beam vapor deposition method, using a material that contains at least MgO. More specifically, for example, an electron beam is radiated onto MgO in an electron beam deposition apparatus so that a film made of MgO that is in a range of 10 (nm) to 1 (μm) in thickness is formed only on the upper surface of the Dat electrodes 82 by vapor deposition.

The following will describe how the high γ members 86 are formed by the electron beam vapor deposition method.

Figure 18:
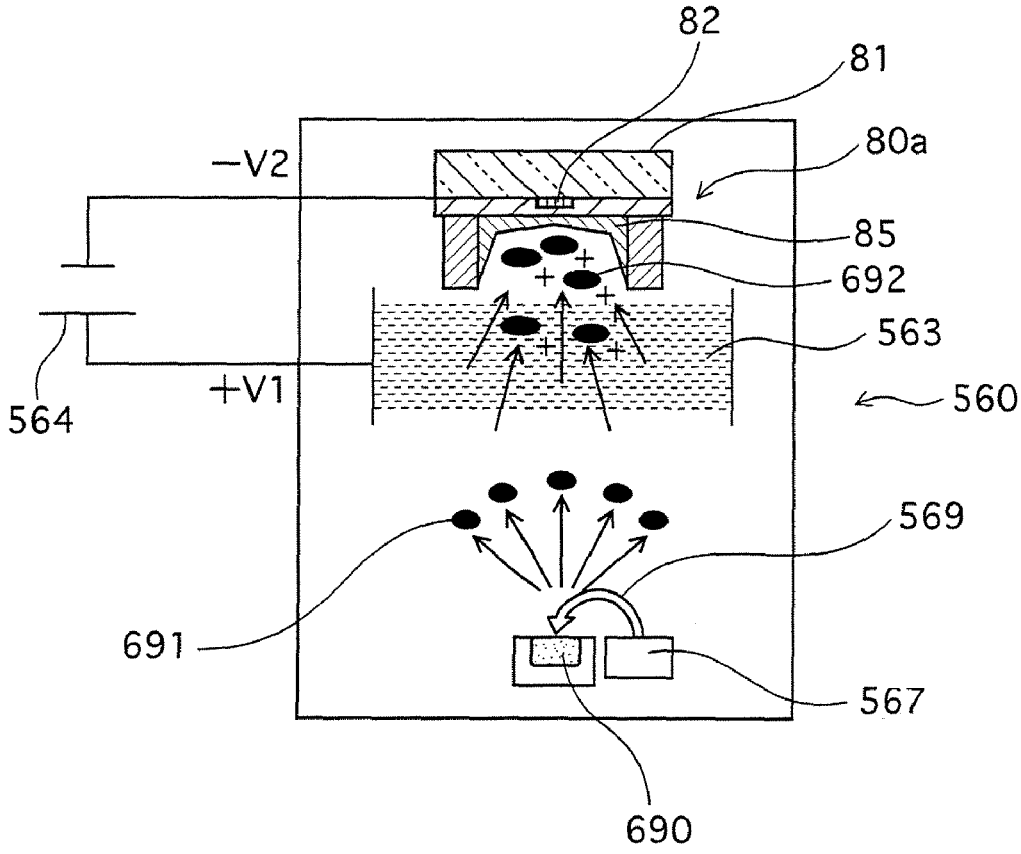
FIG. 18 illustrates the formation method of the high γ members 86 in Embodiment 8.

FIG. 18 illustrates the formation method of the high γ members 86 in Embodiment 8. According to this method, the high γ members 86 are formed as follows. First, a negative or ground potential is applied to the Dat electrodes 82 in the pre-stage back panel 80*a* within the a deposition apparatus 560. Also, an RF plasma 563 is generated below the pre-stage back panel 80*a* within the deposition apparatus 560.

In these conditions, an electron beam 569 is radiated from an electron gun 567 onto MgO 690 being the target so that particles of the MgO 690 are dispersed into the space. The dispersed MgO particles 691 are charged positively when passing through the RF plasma 563, and then are attracted by the negative or ground potential of the Dat electrodes 82, and are eventually accumulated on the surface of the phosphor layers 85 in the areas corresponding to the Dat electrodes 82.

As described above, the high γ members 86 can be formed by such a simple method in which an electron beam 569 is radiated from an electron gun 567 onto MgO 690 being the target, the dispersed MgO particles 691 are charged positively by the RF plasma 563, then are attracted by the negative or ground potential of the Dat electrodes 82, and are eventually accumulated on the surface of the phosphor layers 85 in the areas corresponding to the Dat electrodes 82. In this way, it is possible to form a thin film of the high γ members 86 by a simple method efficiently.

The PDP having the high γ members 86 formed by the above-described formation method was subjected into a test that is similar to the test of Embodiment 6.

The samples of the PDP used in this experiment were manufactured in the same manner as in Embodiment 6, except that the high γ members 86 made of an MgO material that has a higher value of the secondary electron emission coefficient γ than each phosphor material of the phosphor layers 85 were formed on the surface of the phosphor layers 85 in areas above the Dat electrodes 82 as the back plate of the discharge cells by the electron beam vapor deposition method in which the MgO material is charged positively by the RF plasma 563, and that the thickness of the high γ members 86 was approximately 0.5 (μm).

It was confirmed by the experiment that, as is the case with Embodiment 6, a weak discharge was generated in a stable manner in the reset period T1, the generation of reset luminous points was decreased, and the reduction of the luminance was restricted to the minimum.

Up to now, the characteristics of the present invention in the structure, acts and effects have been described through the embodiments. However, the present invention is not limited to these embodiments. For example, the present invention may be modified as follows.

1. High γ Members (1) Formation Range

In Embodiments 6 and 7 and Modification 1, the high γ members 86, 1086, and 1186 are formed on the surface of the phosphor layers 85, 1085, and 1185 only in the areas that correspond to the Dat electrodes 82, 1082, and 1182. However, the high γ members 86, 1086, and 1186 may be formed on the surface of the phosphor layers 85, 1085, and 1185 in the areas other than the areas that correspond to the Dat electrodes 82, 1082, and 1182. Here, the phrase "only in the areas that correspond to the Dat electrodes" includes the meaning that the high γ members 86, 1086, and 1186 may be formed on the surface of the phosphor layers 85, 1085, and 1185 in the areas that are slightly larger than the areas that correspond to the Dat electrodes 82, 1082, and 1182.

That is to say, the high γ members 86, 1086, and 1186 having unequal thickness may be formed on the surface of the phosphor layers 85, 1085, and 1185 in the areas that include the areas that correspond to the Dat electrodes 82, 1082, and 1182 such that the thickest portions of the high γ members 86, 1086, and 1186 are formed on the surface of the phosphor layers 85, 1085, and 1185 in the areas correspond to the Dat electrodes 82, 1082, and 1182.

In this case, however, the portions of the high γ members 86, 1086, and 1186 that are formed in the areas other than the areas correspond to the Dat electrodes 82, 1082, and 1182 need to have such a thickness with which the resonance lines are hardly absorbed by the portions. More specifically, the thickness of the portions needs to be 0.5 (μm) or less in average.

In Embodiments 6 and 7 and Modification 1, the high γ members 86, 1086, and 1186 are formed uniformly on the surface of the phosphor layers 85, 1085, and 1185 in the areas that correspond to the Dat electrodes 82, 1082, and 1182, or each of the high γ members 1086 is formed on the surface of the phosphor layers 1085 in an area that is an overlap of an upper surface (facing toward the front panel 10) of the Dat electrode 1082 and a lower surface (facing toward the back panel 80, 1080, 1180) of the Scn electrode 121. However, the high γ members 86, 1086, and 1186 may be formed nonuniformly. For example, the high γ members 86, 1086, and 1186 may be formed only partially on the surface of the phosphor layers 85, 1085, and 1185 in the areas that correspond to the Dat electrodes 82, 1082, and 1182, or the areas that are overlaps of upper surfaces of the Dat electrodes 1082 and lower surfaces of the Scn electrodes 121 (that is to say, the high γ members 86, 1086, and 1186 may be formed in a form of islands in the areas). Furthermore, the high γ members 86, 1086, and 1186 may be formed nonuniformly on the surface of the phosphor layers 85, 1085, and 1185 in the areas that correspond to the Dat electrodes 82, 1082, and 1182, or the areas that are overlaps (three-dimensional intersections) of upper surfaces of the Dat electrodes 1082 and lower surfaces of the Scn electrodes 121 such that the thickest portions of the high γ members 86, 1086, and 1186 are formed at each approximate center of the areas that correspond to the Dat electrodes 82, 1082, and 1182 and at each approximate center of the overlaps.

In other words, the high γ members 86, 1086, and 1186 cover the surface of the phosphor layers 85, 1085, and 1185 at a higher ratio in the areas that correspond to the Dat electrodes 82, 1082, and 1182, than in the other area. That is to say, the high γ members 86, 1086, and 1186 are formed on the surface of the phosphor layers 85, 1085, and 1185 focused on the areas that correspond to the Dat electrodes 82, 1082, and 1182.

(2) Material

In Embodiments 6 and 7 and Modification 1, MgO is used as a material of the high γ members 86, 1086, and 1186. However, other materials may be used. For example, (i) a metal oxide material containing at least one of MgO, CaO, BaO, SrO, MgNO, and Zno or (ii) an insulator material containing at least one of insulators: nanofiber such as CNT (Carbon Nano Tube); fullerene such as C60; and AlN (Aluminum Nitride). These materials may contain other materials and impurities.

In the description so far, the high γ members 86, 1086, and 1186 are made of MgO particles 670, 680, 690 that are insulator materials. However, particles of a metal material that contains at least one of Pt (platinum), Au (gold), palladium (Pd), Mg (magnesium), Ta (tantalum), W (tungsten), and Ni (nickel) may be used. These particle groups have small values of the work function, have a higher value of the secondary electron emission coefficient γ than the phosphor layers, and are metal particles that are difficult to be oxidized. As a result, with use of these materials, it is possible to lower the firing voltage when the phosphor layers 85, 1085, 1185 side becomes a cathode in the reset period T1, which causes a weak discharge to be generated in a stable manner, and restricts the generation of reset luminous points.

2. Voltage-Applied Particles Dispersion Accumulation Method

In Embodiments 6 and 7 and Modification 1, in the procedures of forming the high γ members 86, 1086, and 1186, the material of the high γ members 86, 1086, and 1186 is charged positively, and a negative voltage is applied to the Dat electrodes 82, 1082, 1182. However, the procedures of forming the high γ members 86, 1086, and 1186 may include: a process in which a predetermined level of negative voltage is kept to be applied to the Dat electrodes 82, 1082, 1182; a process in which a voltage, which is represented by a straight line or a curved line, is kept to be applied to the Dat electrodes 82, 1082, 1182, where the voltage becomes greater on the negative side over time; a process in which a voltage is kept to be applied to the Dat electrodes 82, 1082, 1182, where the voltage becomes greater on the negative side over time in a step-by-step manner; or a process in which a pulse of a negative voltage is applied to the Dat electrodes 82, 1082, 1182.

In each of the above-described methods, a negative voltage is applied to the Dat electrodes 82, 1082, 1182. With this arrangement, it is possible to prevent the following. That is to say, when the positively charged MgO insulator material is accumulated toward the Dat electrodes 82, 1082, 1182, the electric charge of the MgO particles 671, 681, 691 may increase the potential at the upper surface of the Dat electrodes 82, 1082, 1182. This makes the MgO particles difficult to accumulate above the Dat electrodes 82, 1082, 1182. The above-described formation methods of the high γ members 86, 1086, and 1186 prevent this phenomenon from occurring, by applying a negative voltage to the Dat electrodes 82, 1082, 1182.

With the above-described method in which a voltage is kept to be applied to the Dat electrodes 82, 1082, 1182, where the voltage becomes greater on the negative side over time, it is possible to keep the potential at the upper surface of the Dat electrodes 82, 1082, 1182, which would increase over time, at approximately a predetermined constant level. And since the potential at the upper surface is not lowered, it is possible to accumulate the MgO particles 671, 681, 691 uniformly above the Dat electrodes 82, 1082, 1182.

The other methods in the above-described ones are also efficient and easy methods for forming the high γ members 86, 1086, and 1186 above the Dat electrodes 82, 1082, 1182. It is also possible to form the high γ members 86, 1086, and 1186 above the Dat electrodes 82, 1082, 1182 by a method in which the potential at the upper surface of the Dat electrodes 82, 1082, 1182 is detected and fed back, and the above-described negative voltage is adjusted based on the fed-back potential.

In each of the above-described Embodiments, MgO particles 670, 680, 690 are used as the material of the high γ members 86, 1086, and 1186. However, MgO particles are apt to be charged positively. Accordingly, in the above-described Embodiments, the MgO particles 670, 680, 690 are charged positively, and a negative voltage is applied to the data electrodes.

However, for example, if the MgO particles 670, 680, 690 are charged negatively, a positive voltage needs to be applied to the Dat electrodes 82, 1082, 1182. As understood from this, in the formation of the high γ members 86, 1086, and 1186, the polarity with which the material of the high γ members 86, 1086, and 1186 is determined based on which polarity the material is easy to be charged with. And the polarity of the voltage to be applied to the Dat electrodes 82, 1082, 1182 is determined depending on the polarity of the material.

In each of the above-described Embodiments, MgO particles 670, 680, 690 are used as the material of the high γ members 86, 1086, and 1186, a negative voltage is applied to the Dat electrodes 82, 1082, 1182. However, if, for example, a ground potential is applied to the Dat electrodes 82, 1082, 1182, positively charged MgO particles are attracted to the Dat electrodes 82, 1082, 1182. This also applies to a case where the material of the high γ members 86, 1086, and 1186 is charged negatively.

3. Formation of High γ Members 86, 1086, 1186

In Embodiments 6 and 7 and Modification 1, the high γ members 86, 1086, and 1186 are formed by the voltage-applied particles dispersion accumulation method. Also, in Embodiment 8, the high γ members 86 are formed by the electron beam vapor deposition method. However, the high γ members 86 may also be formed by a plasma beam film forming method in which a plasma beam is radiated onto the material of the high γ members 86 to electrically charge the material and form a film as the high γ members 86.

With the adoption of such a simple method, it is possible to form the high γ members 86 efficiently. More specifically, a plasma beam is radiated onto positively charged MgO particles 690 so that the MgO particles are dispersed into the space and are accumulated in areas above the data electrodes (Dat electrodes) to which at least negative or ground potential has been applied, so that a thin film as the high γ members 86 is formed in the areas.

Furthermore, the high γ members 86, 1086, and 1186 may be formed by a method in which a film made of MgO is formed by a vapor deposition method, and then the film is formed by the photoetching method or the like so that the film remains as the high γ members 86, 1086, and 1186 only in the areas that correspond to the Dat electrodes 82, 1082, 1182. Conversely, the high γ members 86, 1086, and 1186 may be formed by a method in which the areas in which the high γ members 86, 1086, and 1186 are not to be formed are masked, and then the high γ members 86, 1086, and 1186 are formed on the surface of the phosphor layers 85, 1085, 1185 only in the areas that that correspond to the Dat electrodes 82, 1082, 1182.

4. Dat Electrodes 82, 1082, 1182

In Embodiments 6 and 7, the Dat electrodes 82 and 1182 are made of Ag (silver). However, they may be made of other materials such as Au (gold), Cr (chromium), Cu (Copper), Ni (nickel), Pt (platinum), and any appropriate combinations of these materials.

5. Barrier Ribs 84, 1084, 1184

In Embodiments 6 and 7 and Modification 1, the back panels 80, 1080, and 1180 are provided with the barrier ribs 84, 1084, and 1184, respectively. However, for example, the barrier ribs 84, 1084 and 1184 may be provided in the front panel 10. Alternatively, the barrier ribs 84, 1084 and 1184 may be prepared independently of the front panel 10 and the back panels 80, 1080, and 1180, and may be interposed between the front and back panels that have been arranged to face each other when the PDP is manufactured.

6. Phosphor Layers 85, 1085, 1185

The materials of the phosphor layers 85, 1085, 1185 are not limited to those disclosed in Embodiment 6. For example, $CaMgSi_2O_6$:Eu or $YBO_3$:Tb may be used as the material.

7. Others

The phosphor materials, types of discharge gases, and values of pressure are not limited to those disclosed above, but the materials and conditions that are generally used in AC-type PDPs are applicable. Also, the materials and conditions disclosed in the modifications may be combined with such materials and conditions.

Embodiment 9

Figure 19:
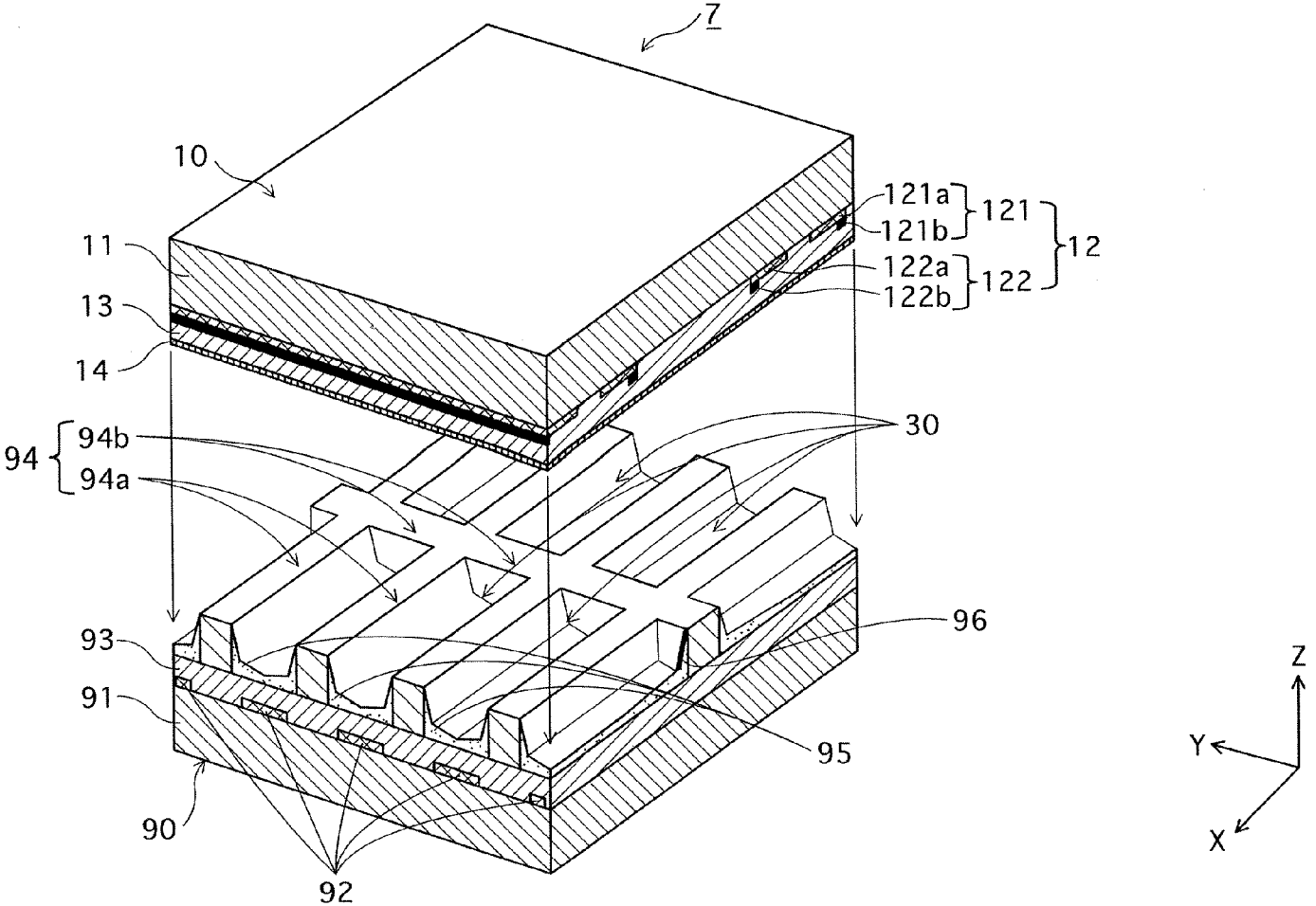
FIG. 19 is a main part perspective view showing the structure of the PDP 7 in Embodiment 9.

The structure of a PDP 7 of Embodiment 9 will be described with reference to FIG. 19. FIG. 19 is a main part perspective view (partially sectional view) showing the structure of the PDP 7 of Embodiment 9. Although the basic structure of the front panel 10 is the same as in Embodiment 1-8, it will be described in the following for the sake of confirmation.

1-1. Structure of Front Panel 10

The front panel 10 is constructed such that a plurality of display electrode pairs 12, each of which is composed of the Scn electrode 121 and the Sus electrode 122, are disposed in parallel with each other on a main surface (in FIG. 19, the lower main surface facing downward), which faces a back panel 90, of the front substrate 11. And the dielectric layer 13 and the dielectric protective layer 14 are formed to cover the display electrode pairs 12, in the stated order.

The front substrate 11 is made of, for example, a high-strain-point glass or a soda-lime glass. Each Scn electrode 121 is a stack of a transparent electrode element 121*a* and a bus line 121*b*; and each Sus electrode 122 is a stack of a transparent electrode element 122*a* and a bus line 122*b*. The transparent electrode elements 121*a* and 122*a* are larger in width than the bus lines 121*b* and 122*b*, contain ITO (tin-dope indium tin oxide), $SnO_2$ (tin oxide), and ZnO (zinc oxide), are approximately 100 nm in film thickness, and are high in resistance. The bus lines 121*b* and 122*b* are made of silver (Ag), aluminum (Al), chromium (Cr), copper (Cu), nickel (Ni), platinum (Pt), or palladium (Pd). The transparent electrode elements 121*a* and 122*a* are formed in stripes or projections (in FIG. 19, formed in stripes).

The dielectric layer 13 is made of a lead-based or non-lead-based low-melting glass, a silicon oxide ($SiO_2$) or the like. The dielectric layer 13 is formed to be several micrometers to several tens of micrometers in film thickness in a thick film or thin film formation process. The protective layer 14 is mainly made of MgO (magnesium oxide) or $MgF_2$ (magnesium flouride), and is formed to be several hundreds of nanometers in film thickness.

It should be noted here that on the surface of the front substrate 11, black stripes may be provided between adjacent display electrode pairs 12 so as to prevent light from leaking to adjacent discharge cells.

1-2. Structure of Back Panel 90

The back panel 90 is constructed such that a plurality of Dat electrodes 92 are disposed in a direction substantially perpendicular to the display electrode pairs 12 on a surface (in FIG. 19, the upper surface) of a back substrate 91 that faces the front panel 10. And a dielectric layer 93 is formed to cover the Dat electrodes 92. Further, on the dielectric layer 93, main barrier rib elements 94*a* are formed to be erected between adjacent Dat electrodes 92, and sub-barrier rib elements 94*b* are formed in a direction substantially perpendicular to the main barrier rib elements 94*a*.

In the PDP 7, the main barrier rib elements 94*a* and the sub-barrier rib elements 94*b* constitute barrier ribs 94 of the back panel 90. It should be noted here that although the drawing do not show in detail, the upper end of the sub-barrier rib elements 94*b* is set to be slightly lower than the upper end of the main barrier rib elements 94*a* in the z direction.

A phosphor layer 95 is provided in each area enclosed by two main barrier rib elements 94*a* and two sub-barrier rib elements 94*b*. One of three colors: red color (R); green color (G); and blue color (B) is assigned to the phosphor layers 95 formed in each dent.

The back substrate 91 of the back panel 90 is, as is the case with the front substrate 11 of the front panel 10, made of a high-strain-point glass, a soda-lime glass or the like. The Dat electrodes 92 are made of a metal material such as silver (Ag). The Dat electrodes 92 are formed by applying Ag past to the surface of the back substrate 91 by the screen printing. The material of the Dat electrodes 92 is not limited to Ag, but may be Al, Cr, Cu, Ni, Pt, Pd, or any combination of these materials achieved in a stack of them.

The dielectric layer 93 is, as is the case with the dielectric layer 13 of the front panel 10, basically made of a lead-based or non-lead-based low-melting glass, $SiO_2$ or the like. However, not limited to this, the dielectric layer 93 may be made of a material that contains aluminum oxide ($Al_2O_3$) or titanium oxide ($TiO_2$). The barrier ribs 94 are made of, for example, a low-melting glass material and formed by the sand blast method, photolithography method or the like. The barrier ribs 94 are formed by digging holes that are in the shape of rectangular parallelepiped in correspondence with the discharge cells. Accordingly, the side surfaces of the barrier ribs 94 are not perpendicular to the back substrate 91, but slant (this feature is omitted in FIG. 19), and the thickness of the barrier ribs 94 becomes greater as it goes downward along the Z axis direction, namely, a distance between adjacent barrier ribs becomes smaller downward in the Z axis direction.

The phosphor layer 95 in each dent is made of one of the following phosphors.

| | |
|---|---|
| The R phosphor | (Y, Gd) $BO_3$: Eu |
| The G phosphor | $Zn_2SiO_4$: Mn |
| The B phosphor | $BaMg_2Al_{14}O_{24}$: Eu |

In the PDP 7 of the present embodiment, phosphor-coating films 96 are further formed on the surface of the phosphor layers 95. The phosphor-coating films 96 cover part of the surface of the phosphor layers 95. The phosphor-coating films 96 and the areas in which they are formed will be described later.

1-3. Arrangement of Front Panel 10 and Back Panel 90

The PDP 7 is constructed such that the front panel 10 and the back panel 90 are arranged to face each other with the barrier ribs 94, which function as a member for maintaining the gap between these panels, in between, and the display electrode pairs 12 and the Dat electrodes 92 are arranged respectively in directions that are substantially perpendicular to each other, and the front panel 10 and the back panel 90 are sealed at the perimeter thereof. With this construction, discharge spaces 30 are formed, enclosed by the front panel 10, the back panel 90, and the barrier ribs 94. Namely, the front panel 10 and the back panel 90 form a sealed container. A discharge gas, being a mixture of Ne, Xe, He and the like is filled in the discharge spaces 30 in the PDP 7. The filling pressure of the discharge gas is, for example, 50-80 (kPa).

Conventionally, the ratio of the partial pressure of Xe to the total pressure of the discharge gas has been set to less than 5(%). However, with the aim of improving the panel luminance, the partial pressure of Xe in the discharge gas is set to be as high as 5(%) to 100(%).

It should be noted here that the PDP 7 may be manufactured with a method in which the panels 10 and 90 are assembled together, and then are bonded together and sealed in an atmosphere of a discharge gas that is prepared in a vacuum replacement. Also, the types of gases are not limited to those disclosed above, but the materials and conditions that are generally used in AC-type PDPs are applicable.

In the PDP 7, three-dimensional intersections of the display electrode pairs 12 and the Dat electrodes 92 respectively correspond to the discharge cells (not illustrated), and a plurality of discharge cells are arranged in a matrix.

2. Phosphor-Coating Films 96

Figure 20A:
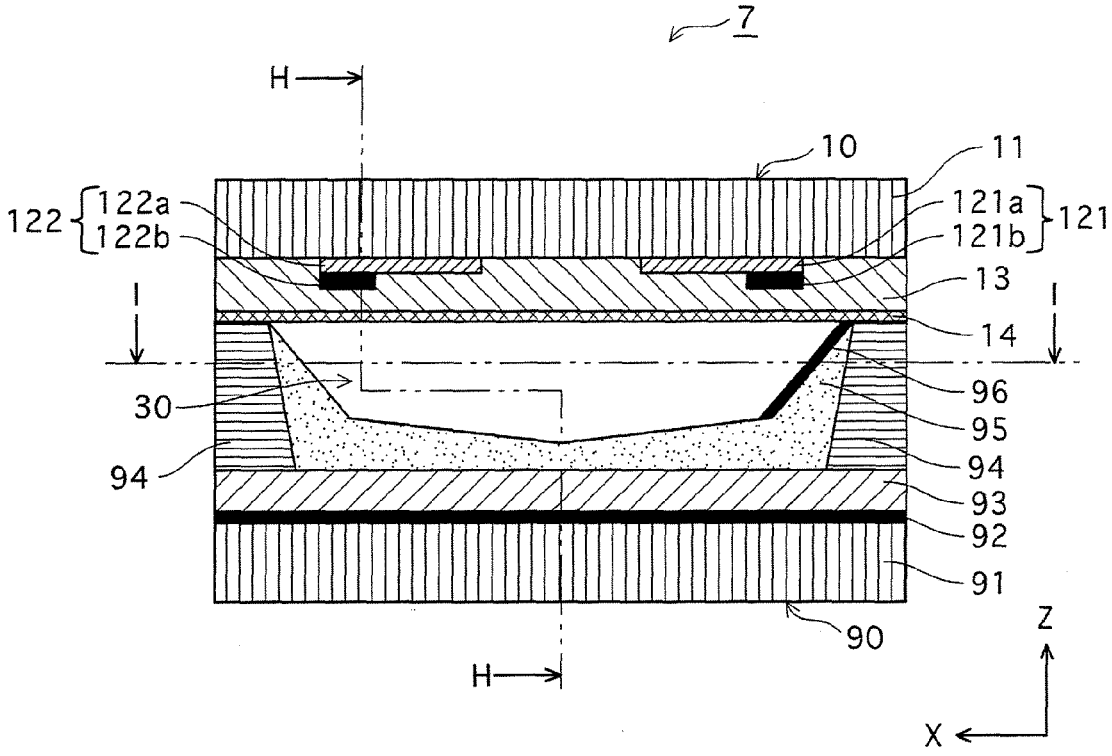
FIGS. 20A and 20B are conceptual cross sectional views of a discharge cell extracted from the PDP 7.
Figure 20B:
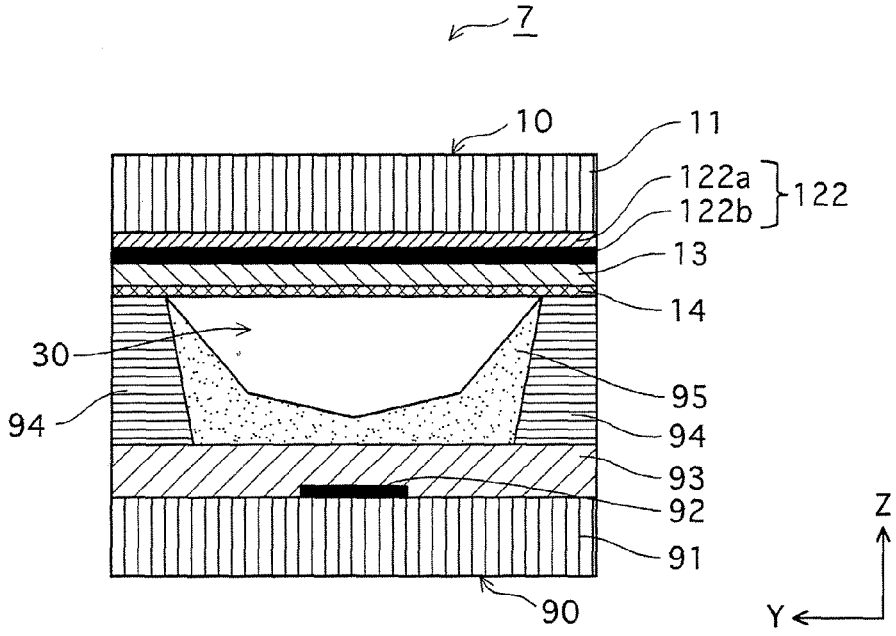

The phosphor-coating films 96, which are most characteristic among the constituent elements of the PDP 7 in the present embodiment, will be described with reference to FIGS. 20A, 20B, and 21. FIGS. 20A and 20B are both a cross sectional view of a discharge cell extracted from the PDP 7. FIG. 20A is a cross-sectional view of the PDP 7 taken along the X and Z axis directions. FIG. 20B is a cross-sectional view of the PDP 7 taken along the Y and Z axis directions.

As shown in FIG. 20A, in the PDP 7, the phosphor layers 95 are formed to be slant on the slant surface of the barrier ribs 94 facing toward the discharge spaces 30, where the barrier ribs 94 are formed substantially in parallel with a direction in which the Scn electrodes 121 and the Sus electrodes 122 extend (the Y axis direction). The phosphor layers 95 are formed as layers on the inner surfaces including the surface of the dielectric layer 93.

As will be described later, the phosphor-coating films 96 are formed on part of the surface of the phosphor layers 95 to be exposed to the discharge spaces 30, using a material that is different from and has a higher value of the secondary electron emission coefficient γ than each phosphor material of the phosphor layers 95 so that the secondary electrons are emitted during the reset period T1. As shown in FIGS. 20A and 20B, the phosphor-coating films 96 are formed in the areas that include the areas of the surface of the phosphor layers 95 that are demarcated by the perpendicular lines dropped to the surface of the back substrate 91 from each of the side edges of the Scn electrodes 121 (both edges in the X axis direction). Furthermore, in the PDP 7, the surface of the phosphor layers 95, in the areas below the Sus electrodes 122 and in the areas on the surface of the dielectric layer 93, faces toward the discharge spaces 30.

Figure 21:
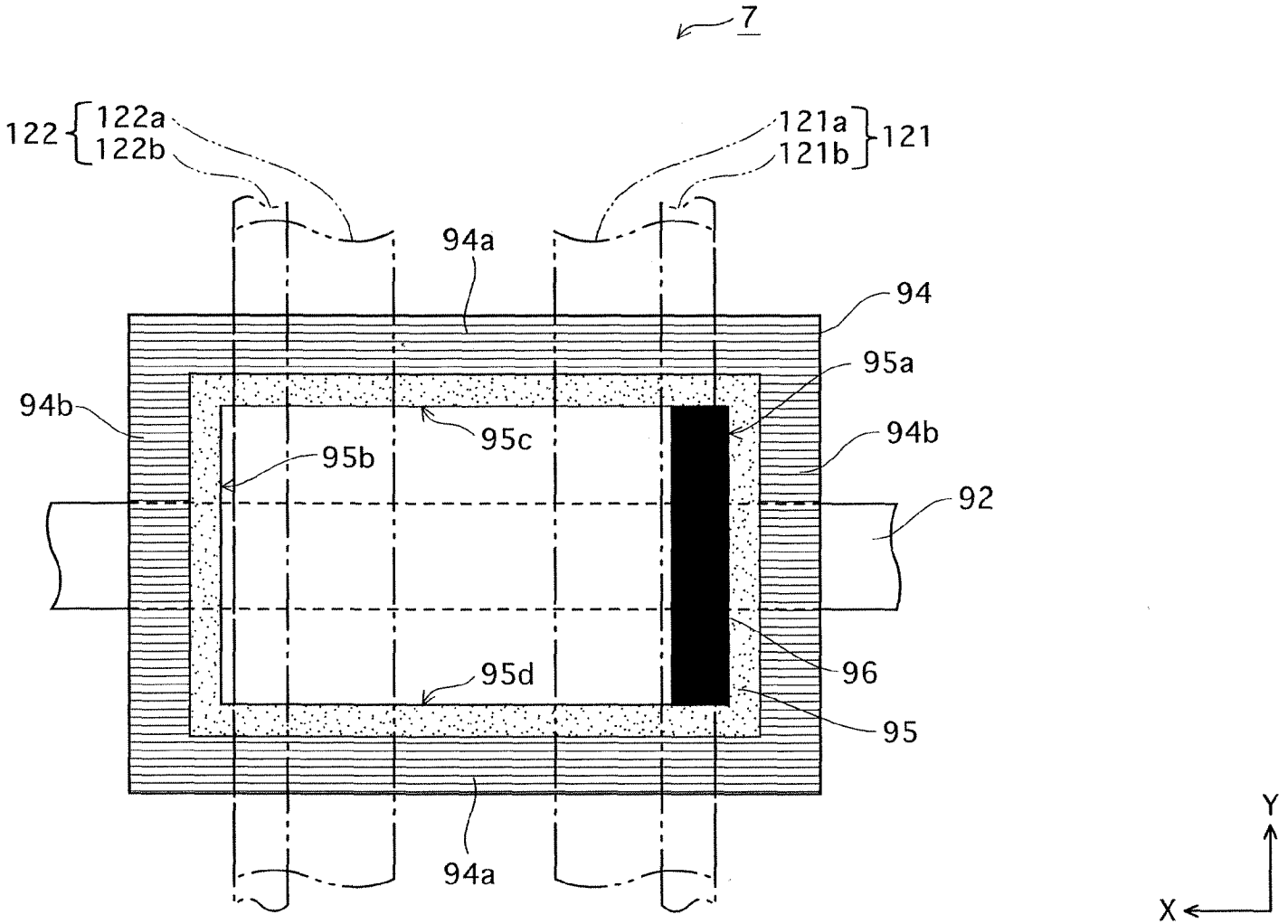
FIG. 21 is a conceptual plan view of a discharge cell extracted from the PDP 7.

As shown in FIG. 21, when the phosphor layers 95 of the PDP 7 are viewed from the front panel 10 side in Z axis direction, it is clear that the phosphor-coating films 96 are formed on the surface of the phosphor layers 95 in the areas that include phosphor layer slant areas 95*a* that are directly below the bus lines 121*b* among the areas that are directly below the Scn electrodes 121, and that the phosphor-coating films 96 are not formed in the other areas of the surface of the phosphor layers 95, namely, the phosphor-coating films 96 are not formed in the other slant areas 95*b*-95*d* and on the bottom surface (areas of the surface of the phosphor layers formed on the dielectric layer 93).

The phosphor-coating films 96 are made of a metal oxide containing MgO (magnesium oxide) and are formed by the electron beam vapor deposition method to be several tens of nanometers to several thousands of nanometers in film thickness. It is more preferable that the phosphor-coating films 96 are in a range of 100 (nm) to 3000 (nm) inclusive in film thickness. The thickness of the phosphor-coating films 96 needs to be in the above-indicated value range in average, in the phosphor layer slant portions 95*a*, but need not be equal across the areas. The phosphor-coating films 96 may be formed as extremely thin films in a form of islands. The formation method of the phosphor-coating films 96 will be described later.

3. Driving PDP 7 and Advantage

The following will describe how to drive the PDP 7 of the present embodiment. A drive circuit (not illustrated) is connected to the PDP 7, where the drive circuit applies a voltage to the electrodes 121, 14, and 22 at predetermined timings. In the PDP 7 of the present embodiment, as is the case with the PDP 1 of Embodiment 1, the following three operation periods are repeated where the PDP 7 is driven for display by what is called an address/display separation driving method:

(1) the reset period T1 in which all the display cells are reset;

(2) the write period T2 in which each discharge cell is addressed, and display states are selected and input into each cell depending on the input data; and (3) the sustain period T3 in which discharge cells in the display state are lighted for display.

In (3) the sustain period T3, rectangular waveform voltages of electrode voltage pulses with different phases are applied to display electrode pairs 12 composed of Scn electrodes 121 and Sus electrodes 122. That is to say, an alternate voltage is applied between display electrodes 12 in each pair so that pulse discharges are generated in the discharge cells in which the display state data has been written, each time the voltage polarity changes.

The generation of such sustain discharges causes resonance lines of 147 (nm) to be emitted from the excited Xe atoms and causes molecular beams of 173 (nm) to be emitted from the excited Xe molecules in the discharge spaces 30, and the ultraviolet rays generated by this are converted into visible light by the phosphor layers 95 of the back panel 90, which realizes the image display in the PDP 7.

The PDP 7 with the above-described structure including the back panel 90, in which the phosphor-coating films 96 are formed on part of the surface of the phosphor layers 95, has the following advantages.

As shown in FIGS. 20A, 20B, and 21, the phosphor-coating films 96 are formed on part of the surface of the phosphor layers 95 using a material that is different from and has a higher value of the secondary electron emission coefficient γ than each phosphor material of the phosphor layers 95, covering the phosphor layer slant portions 95*a* that are directly below the Scn electrodes 121 in the Z axis direction. Also, in the PDP 7, the other areas of the surface of the phosphor layers 95 (including the other slant portions 95*b*, 95*c*, 95*d*) are exposed to the discharge spaces 30.

The phosphor-coating films 96 covering the slant areas 95*a* in the surface of the phosphor layers 95 are made of a metal oxide material containing MgO that has a high secondary electron emission coefficient γ, and is excellent in sputtering resistance. This makes it possible to further lower the firing voltage when the phosphor layers 95 side becomes a cathode and to further stabilize the weak discharge during the reset period T1 while the PDP 7 is being driven, and to increase the image quality and reliability due to the use of the material having excellent sputtering resistance.

Also, the phosphor-coating films 96 are formed as very thin films, as well as making it possible to further lower the firing voltage when the phosphor layers 95 side becomes a cathode and to further stabilize the weak discharge during the reset period T1 while the PDP 7 is being driven, to increase the image quality. With such very small thickness, the phosphor-coating films 96 hardly absorb the emitted vacuum ultraviolet rays including the resonance lines of 147 (nm). As a result, in the PDP 7, the vacuum ultraviolet rays generated in the discharge spaces 30 are transferred to the phosphor layers 95 with high efficiency, and the luminous efficiency is maintained at a high level.

Also, the phosphor-coating films 96 are formed on part of the surface of the phosphor layers 95 in areas that include the phosphor layer slant areas 95*a*, and are not formed in the other areas of the surface of the phosphor layers 95, namely, the phosphor-coating films 96 are not formed in the other slant areas 95*b*, 95*c*, 95*d* and on the bottom surface above the dielectric layer 93. This means that in the PDP 7, the phosphor-coating films 96 are formed in the areas that are required to generate the weak discharge, but are not formed in the areas that are not required to generate the weak discharge. This enables the absorption of the ultraviolet rays by the phosphor-coating films 96 to be limited to the minimum range.

4. Experiment

For an experiment, panels having the same structure as the above-described PDP 7 were prepared. Namely, after the phosphor layers 95 in the back panel 90 were formed, the phosphor-coating films 96 were formed on part of the surface of the phosphor layers 95 in the areas that include the areas that are directly below the Scn electrodes 121 (the phosphor layer slant areas 95*a*) using an MgO material by the electron beam vapor deposition method to be as thin as approximately 1000 (nm).

The phosphor-coating films 96 were formed using a slant vapor deposition method, which will be described later, such that the phosphor-coating films 96 are formed on the surface of the phosphor layers 95 excluding at least the slant areas 95*b*, 95*c*, 95*d*. The ratio of the partial pressure of Xe to the total pressure of the discharge gas was set to be as high as approximately 15(%). The discharge gas was filled with approximately 60 (kPa). The samples of the PDP 7 produced in this way were subjected to the following evaluations.

With respect to the samples of the PDP 7, a high-voltage ramp waveform, which represents voltage/time and rises and falls with a slow slant, was applied between the Scn electrodes 121 and the Dat electrodes 92 during the reset period T1 in which all the discharge cells were reset, and the evaluation was made.

The experiment results show that, with the structure where the phosphor-coating films 96 were formed on part of the surface of the phosphor layers 95 including the slant areas 95*a*, the following advantages were observed although the ratio of the partial pressure of Xe to the total pressure of the discharge gas was set to be as high as approximately 15(%). That is to say, the firing voltage is lowered by 50 (V) to 100 (V) due to the phosphor-coating films 96 when a ramp waveform is applied between the Scn electrodes 121 and the Dat electrodes 92 during the reset period T1 and the phosphor layers 95 side becomes a cathode. As a result of this, a weak discharge is generated in a stable manner, luminous points are not generated, and the image quality is greatly improved.

Also, with the structure where the phosphor-coating films 96 were formed on part of the surface of the phosphor layers 95 excluding at least the slant areas 95*b*, 95*c*, 95*d*, the following advantages were observed although the ratio of the partial pressure of Xe to the total pressure of the discharge gas was set to be high. That is to say, the reduction of the luminous efficiency is restricted, the reduction of the luminance is restricted, and the luminance is greatly improved as a high-Xe PDP. It should be noted here that it was also confirmed from the experiment that, in the PDP 7, even if the ratio of the partial pressure of Xe to the total pressure of the discharge gas was increased to a range of 5(%) to 100(%), a weak discharge is always generated in a stable manner, and the luminance is improved in correspondence with the Xe partial pressure.

Figure 26A:
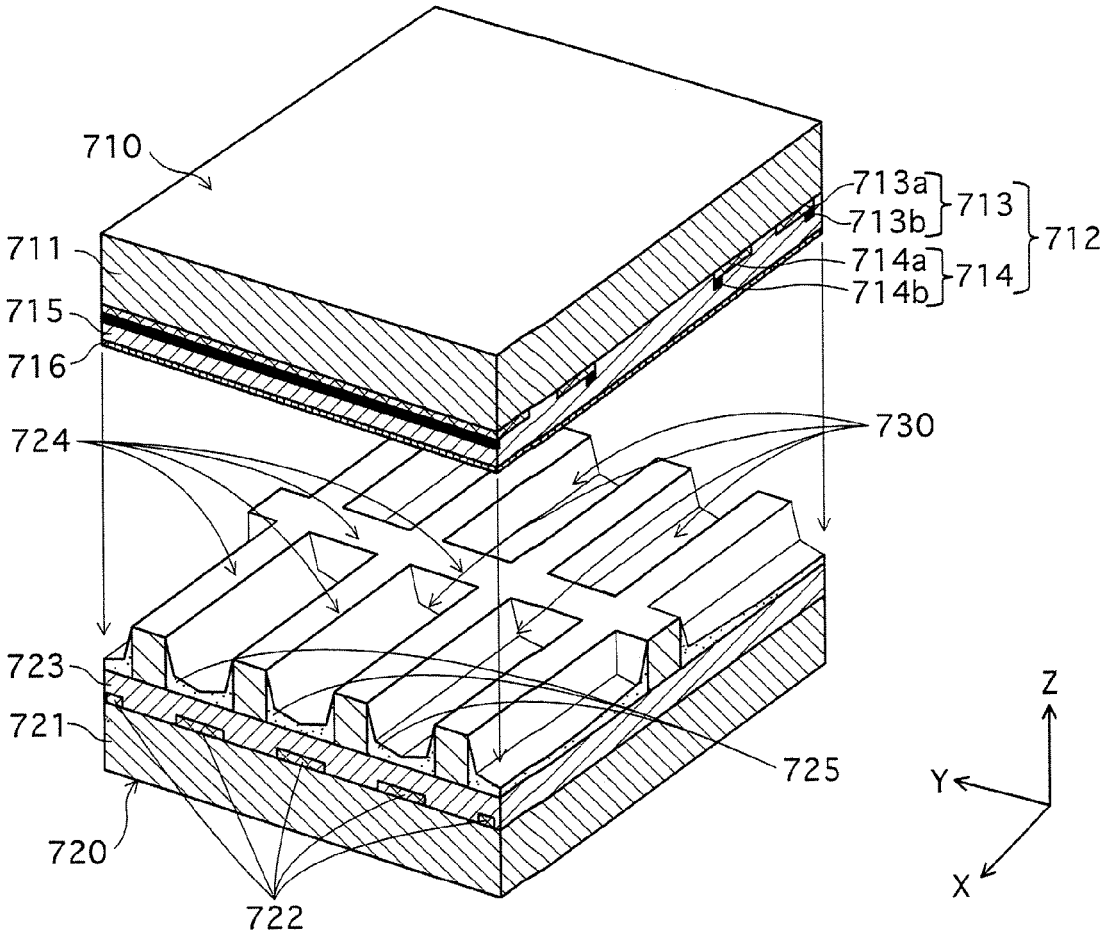
FIGS. 26A and 26B are conceptual cross sectional views showing the structure of a conventional surface discharge AC type PDP.
Figure 26B:
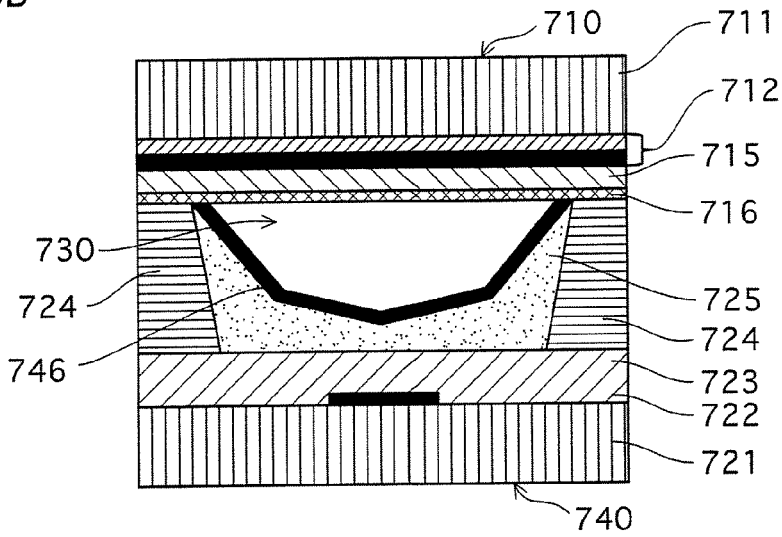

On the other hand, in a conventional PDP, in which phosphor-coating films 746 being made of MgO and thick are formed to cover the whole surface of phosphor layers 725 as shown in FIG. 26B, the following were observed. That is to say, if the ratio of the partial pressure of Xe to the total pressure of the discharge gas is increased, the firing voltage when the phosphor layers 725 side becomes a cathode is lowered and stabilizes the weak discharge during the reset period T1. However, due to the thick phosphor-coating films 746 covering the whole surface of phosphor layers 725 absorb the vacuum ultraviolet rays including the resonance lines, resulting in the restriction of the luminous efficiency. It was observed that the luminance of the conventional PDP was not improved and was approximately 1/10 of the PDP 7 of the present embodiment although the ratio of the partial pressure of Xe to the total pressure of the discharge gas was increased.

The above-described experiment results show that, with the structure of the PDP 7 of the present embodiment where the phosphor-coating films 96 are formed on part of the surface of the phosphor layers 95 including the slant areas 95*a*, and the other areas are exposed to the discharge spaces 30, a weak discharge is generated in a stable manner during the reset period T1 in which all the display cells are reset, restricting the generation of the reset luminous points, and as a result, the reduction of the luminous efficiency during the sustain period T3 is restricted, the reduction of the luminance is restricted, the image quality is improved, and a high luminance is obtained.

As described above, in the present embodiment, the phosphor-coating films 96 are formed on part of the surface of the phosphor layers 95 in the areas including at least part of the slant areas 95*a* and excluding the slant areas 95*b*, 95*c*, 95*d*, especially excluding the areas below the Sus electrodes 122 (corresponding to the slant areas 95*b*). This structure stabilizes the generation of the weak discharge during the reset period T1, restricts the reduction in the ultraviolet rays emitting efficiency, and restricts the reduction in the luminous efficiency. Accordingly, the PDP 7 with such a structure provides various advantages such as high image quality, high luminance, and low power consumption.

Embodiment 10

Figure 22A:
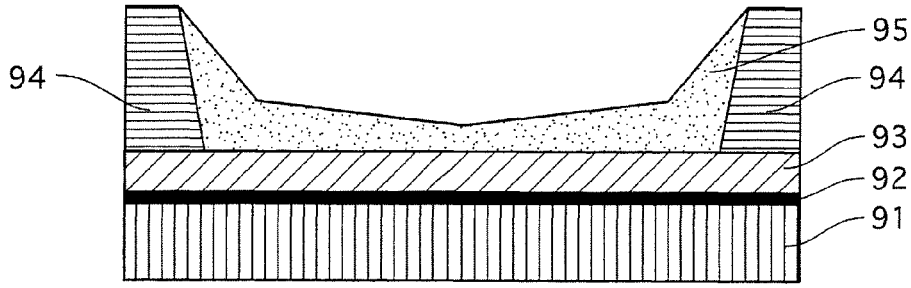
FIGS. 22A to 22C are conceptual process drawings showing part of processes for forming the phosphor-coating films 96, in the manufacturing method of the PDP in Embodiment 10.
Figure 22B:
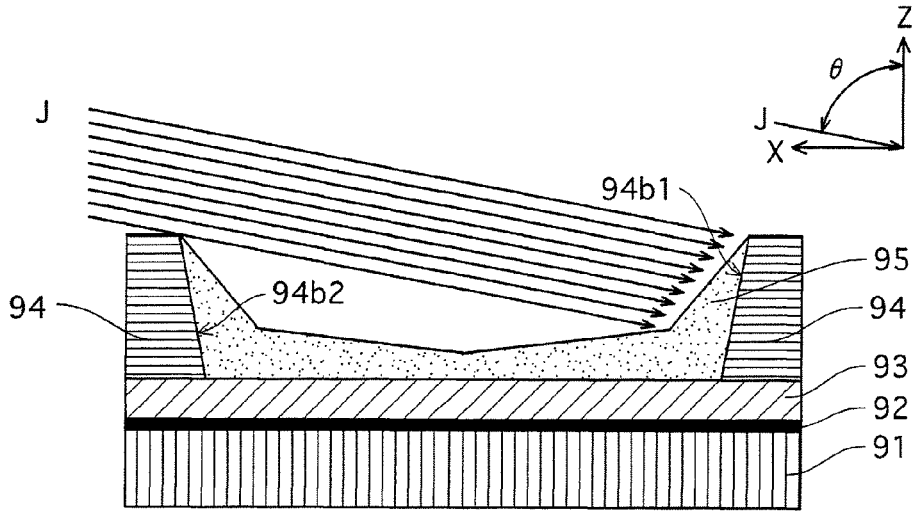
Figure 22C:
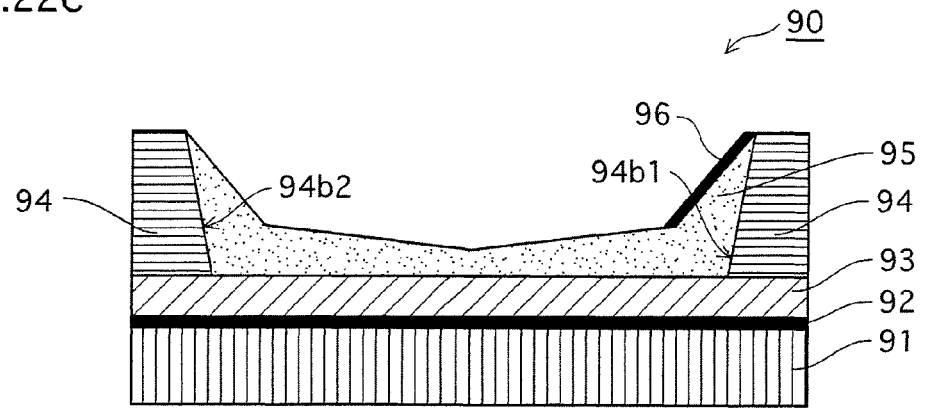

A manufacturing method of the PDP 7 in Embodiment 10 will be described with reference to FIGS. 22A to 22C. FIGS. 22A to 22C are conceptual process drawings showing part of processes for forming the phosphor-coating films 96 in the back panel 90, in the manufacturing method of the PDP 7 in Embodiment 10. It should be noted here that the PDP 7 manufactured by the method of the present embodiment has the same structure as the PDP 7 in Embodiment 9.

As shown in FIG. 22A, the Dat electrodes 92 are formed on one main surface of the back substrate 91 by patterning, and the dielectric layer 93 is formed by applying a low-melting glass paste onto the main surface to cover at least part of the surfaces of the Dat electrodes 92 and the back substrate 91, and then baking the applied paste. Further, the barrier ribs 94 are formed to erect on the surface of the dielectric layer 93. As the material of the barrier ribs 94, for example, a low-melting glass is used. The barrier ribs 94 are formed by applying the material onto the barrier ribs 94, baking the applied material, and then forming the rows and columns to demarcate the discharge cells, for example, in a pattern of parallel crosses, by the sand blast method, photolithography method, transfer method or the like.

As is the case with Embodiment 9, as the barrier ribs 94 in a form of parallel crosses, the side wall surfaces of the barrier ribs 94 that have been formed in parallel with each other along an extension direction of the Scn electrodes 121 are defined as Scn electrode side slant portions 94*b*1 (see FIG. 22B). Similarly, the side wall surfaces of the barrier ribs 94 on the side of the Sus electrodes 122 are defined as Sus electrode side slant portions 94*b*2. Also, the other side wall surfaces of the barrier ribs 94 are defined as slant portions of the barrier ribs.

As shown in FIG. 22A, a phosphor material is applied to the barrier ribs 94 having been formed in a pattern of parallel crosses, and the applied pasted is baked to form the phosphor layers 95 on the side wall surfaces of the barrier ribs 94 and the surface of the dielectric layer 93. The phosphor layers 95 for each lighting color of red (R), green (G), blue (B) are formed by using the phosphor materials of each color in units of discharge cells of R, G, and B. It should be noted here that the phosphor materials are not limited to the above-indicated ones, but the materials that normally used in the AC type PDPs can be used.

The phosphor layers 95 are formed to be slant on the Scn electrode side slant portions 94*b*1 that have been formed substantially in parallel with each other along an extension direction of the Scn electrodes 121 (in the Y axis direction). Similarly, the phosphor layers 95 are formed to be slant on the Sus electrode side slant portions 94*b*2. The phosphor layers 95 are also formed on the other side wall surfaces of the barrier ribs 94 and the surface of the dielectric layer 93.

The manufacturing method of the PDP 7 of the present embodiment is characterized in that the step of forming processing surface of the back panel 90 includes a step for forming the phosphor-coating films 96 in areas, which are demarcated by perpendicular lines dropped to the surface of the back substrate 91 from each of side edges of the Scn electrodes, and include at least part of the slant portions 95*a* of the phosphor layers 95 (see FIG. 21), where the material of the phosphor-coating films 96 is different from and has a higher value of the secondary electron emission coefficient γ than each phosphor material of the phosphor layers 95. Here, this step will be described in detail.

As shown in FIG. 22B, aback plate processing surface, which has been formed by forming the Dat electrodes 92, the dielectric layer 93, the barrier ribs 94, and the phosphor layers 95 in sequence on the back substrate 91, is arranged such that the extension direction of the Scn electrodes 121 and the Sus electrodes 122 is in the Y axis direction (in a direction perpendicular to the plane of the paper), and the length direction of the Dat electrodes 92 is in the X axis direction (in a direction horizontal to the paper). The phosphor-coating films 96 are then formed on the back plate processing surface by the slant vapor deposition method using the material that is different from and has a higher value of the secondary electron emission coefficient γ than each phosphor material of the phosphor layers 95, in a direction perpendicular to the extension direction of the Scn electrodes 121 (Y axis direction).

The phosphor-coating films 96 can be formed from, for example, a metal oxide containing MgO. The phosphor-coating films 96 are formed on the back plate processing surface by a thin film forming process such as the electron beam vapor deposition method, in a direction perpendicular to the extension direction of the Scn electrodes 121 (Y axis direction), by performing the slant vapor deposition in the C direction at a slant angle of θ degrees from a normal line (the Z axis direction) of the back plate processing surface. The thickness of the phosphor-coating films 96 formed by the slant vapor deposition is set be in a range of several tens (nm) to 6000 (nm). It is preferable that the film thickness of the phosphor-coating films 96 is in a range of 100 (nm) to 3000 (nm). Further, the phosphor-coating films 96 may be formed in a form of islands of very thin film.

As shown in FIG. 22C, in each discharge cell on the back plate processing surface, the slant vapor deposition is performed at the slant angle θ so that the material is not applied to the bottom on the Sus electrode side before the barrier ribs 94 on the side of the Scn electrodes 121, in a direction perpendicular to the extension direction of the Scn electrodes 121 (Y axis direction), and using the barrier ribs 94 on the side of the Sus electrodes 122 as shielding walls before the target. As apparent from this, in the manufacturing method of the present embodiment, by using the barrier ribs 94 on the side of the Sus electrodes 122 as shielding walls before the target, and by setting the slant angle θ at which the material is not applied to the bottom on the Sus electrode side before the barrier ribs 94 on the side of the Scn electrodes 121, it is possible to set the slant angle of the slant vapor deposition to be in an appropriate range. In this way, the phosphor-coating films 96 are formed in areas that include at least part of the slant surfaces of the phosphor layers 95 having been formed on the Scn electrode side slant portions 94*b*1 of the barrier ribs 94, and the phosphor-coating films 96 are not formed on the bottom surface of the phosphor layers 95 and in areas of the phosphor layer surface having been formed on the slant portions 94*b*2.

With the above-described manufacturing method, the PDP 7 can be formed by arranging the back panel 90 and the front panel 10 to face each other with the discharge spaces 30 and a plurality of discharge cells therebetween, where in the back panel 90, the phosphor-coating films 96 have been formed on part of the surface of the phosphor layers 95 (in areas on the Scn electrode side slant portions 94*b*1), and the front panel 10 includes the display electrode pairs 12 composed of Scn electrodes 121 and Sus electrodes 122 having been arranged in parallel with each other, as in Embodiment 9. It should be noted here that the discharge spaces 30 are filled with a discharge gas that contains Xe in the state where the ratio of a partial pressure of Xe to the total pressure of the discharge gas is high. With this method, it is possible to manufacture the PDP 7 of the present embodiment, which has a high image quality and high luminance, in a stable manner with high yields.

In the manufacturing method of the PDP 7 of the present embodiment, the step of forming processing surface of the back plate includes a step for forming the phosphor-coating films 96 on the surface of the phosphor layers 95 in areas above the Scn electrode side slant portions 94*b*1 of the barrier ribs 94 that have been formed in parallel with each other along an extension direction of the Scn electrodes 121, using a material that is different from and has a higher value of the secondary electron emission coefficient γ than each phosphor material of the phosphor layers 95. When the PDP 7 manufactured with this method is driven, the generation of the weak discharge during the reset period T1 is stabilized, the generation of the rest luminous points is restricted, and the reduction of the luminance during the sustain period T3 is restricted, which produce advantages of high image quality and high luminance.

Also, with the manufacturing method of the PDP 7 of the present embodiment, it is possible to form the phosphor-coating films 96 containing a metal oxide material on the surface of the phosphor layers 95 in areas above the Scn electrode side slant portions 94*b*1 of the barrier ribs 94 that have been formed along an extension direction of the Scn electrodes 121, by using a simple method in which the electron beam vapor deposition method is used to apply a metal oxide containing MgO onto the back plate processing surface from a direction perpendicular to the extension direction of the Scn electrodes 121, by performing the slant vapor deposition at a slant angle using the barrier ribs 94 on the side of the Sus electrodes 122 as shielding walls before the target. With this manufacturing method, the phosphor-coating films 96 are not formed on the bottom surface of the phosphor layers 95 in each dent and in areas of the phosphor layer surface having been formed on the Sus electrode side slant portions 94*b*2 of the barrier ribs 94. Accordingly, when the PDP 7 manufactured with this method is driven, the generation of the weak discharge during the reset period T1 is stabilized, the generation of the rest luminous points is restricted, and the reduction of the luminance during the sustain period T3 is restricted, which produce advantages of high image quality and high luminance.

Embodiment11

Figure 23:
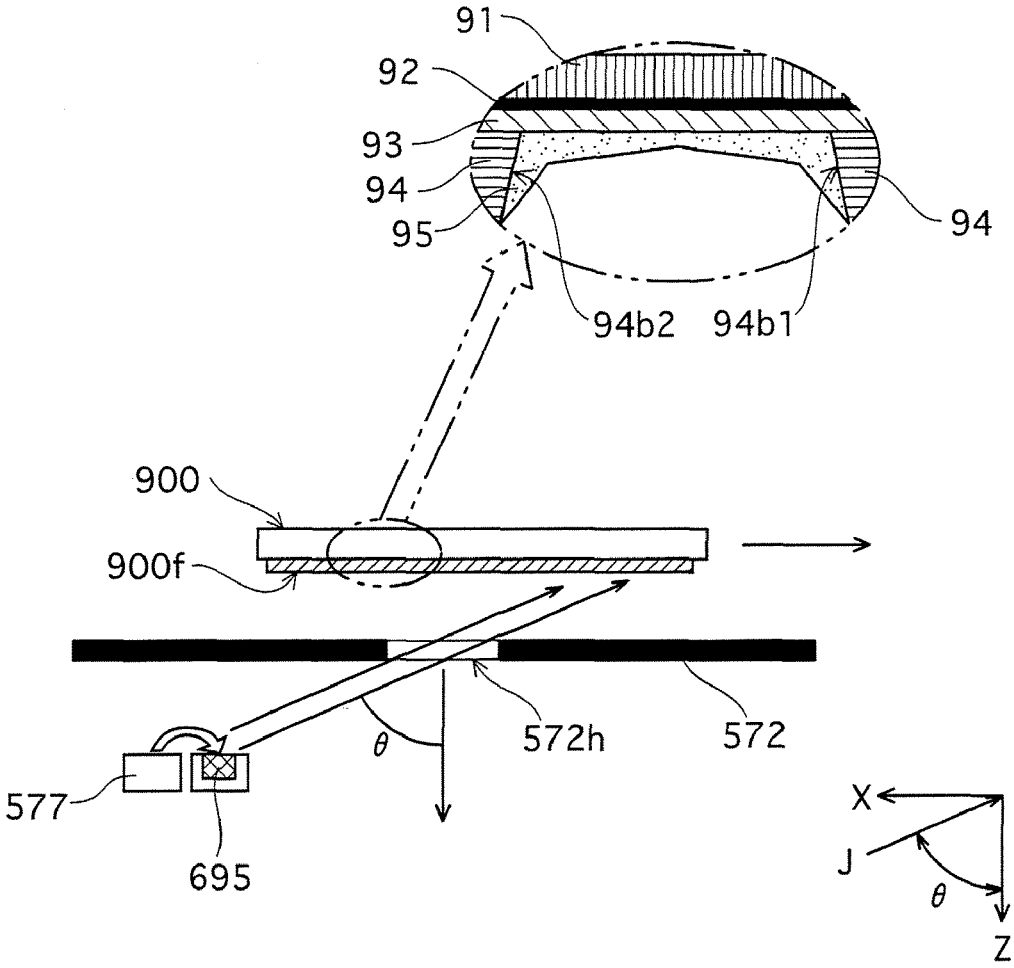
FIG. 23 is a conceptual process drawing showing part of processes for forming the phosphor-coating films 96, in the manufacturing method of the PDP in Embodiment 11.

A manufacturing method of the PDP in Embodiment 11 will be described with reference to FIG. 23. FIG. 23 is a conceptual process drawing showing the process of forming part of the back panel 90, in the manufacturing method of the PDP in Embodiment 11. The following will describe the process of forming part of the back panel 90 of the PDP 7 in Embodiment 9, as a specific example of the manufacturing method in Embodiment 10, with reference to FIGS. 20 and 22. The same reference numbers are assigned to the constitutional elements that are the same as those shown in FIGS. 19-22. Also, some of the reference numbers are omitted for the sake of convenience.

Although not illustrated in FIG. 23, the discharge cells on a back plate processing surface 900*f*, where up to the phosphor layers 95 have been formed in the back panel 90, have the same structure as those shown in FIGS. 20B and 22A. As shown in the enlarged portion of FIG. 23, the side wall surfaces of the barrier ribs 94 that have been formed in parallel with each other along an extension direction of the Scn electrodes 121 are defined as Scn electrode side slant portions 94*b*1. Similarly, the side wall surfaces of the barrier ribs 94 on the side of the Sus electrodes 122 are defined as Sus electrode side slant portions 94*b*2.

The phosphor layers 95 are formed to be slant on the Scn electrode side slant portions 94*b*1 of the barrier ribs 94 that have been formed in parallel with each other along an extension direction (the X axis direction) of the Scn electrodes 121. Similarly, the phosphor layers 95 are formed to be slant on the Sus electrode side slant portions 94*b*2 of the barrier ribs 94.

As shown in FIG. 23, in the electron beam vapor deposition apparatus (not illustrated), a preparatory back panel 900, which has been formed by forming the back plate processing surface 900*f* on the surface of the back substrate 91 in units of discharge cells, is arranged horizontally such that the back plate processing surface 900*f* faces downward (in the Z axis direction). That is to say, in FIG. 23, the back plate processing surface shown in FIG. 22A is arranged to face downward (in the Z axis direction), and the preparatory back panel 900 is arranged so that the extension direction of the Scn electrodes 121 and the Sus electrodes 122 is in the Y axis direction (in a direction perpendicular to the plane of the paper), and the Dat electrodes 92 extend in the X axis direction.

As shown in FIG. 23, for example, a metal mask 572 is arranged between the preparatory back panel 900 and a set of a material target 695 and an electron gun 577 so that a line connecting the material target 695 with an opening 572*h* forms a slant angle θ with a normal line of the metal mask 572 (a normal line of the back plate processing surface), where the metal mask 572 has the opening 572*h* being, for example, a rectangular hole that is long in the extension direction of the Scn electrodes 121 (Y axis direction).

Next, the electron gun 577 is caused to emit an electron beam toward the material target 695 being, for example, a metal oxide containing MgO while the preparatory back panel 900 is moving at a constant speed in either way in the X axis direction perpendicular to the extension direction of the Scn electrodes 121 (Y axis direction) so that a slant vapor deposition of the metal oxide containing MgO is performed in the J direction at the slant angle θ from below the metal mask 572. That is to say, the phosphor-coating films 96 being the high γ members are formed by performing a slant vapor deposition of the metal oxide containing MgO, which is a material that is different from and has a higher value of the secondary electron emission coefficient γ than each phosphor material of the phosphor layers 95, onto the preparatory back panel 900 through the opening 572*h* of the metal mask 572, in a direction perpendicular to the extension direction of the Scn electrodes 121, maintaining substantially the slant angle θ that is formed with the normal line of the back plate processing surface 900*f*, while the preparatory back panel 900 is moving at a constant speed in either way in the X axis direction.

As described above, in the process of forming the phosphor-coating films 96, the phosphor-coating films 96 are formed by a simple method in which a slant vapor deposition is performed in a direction perpendicular to the extension direction of the Scn electrodes 121 and at a slant angle maintaining substantially the slant angle θ with the back plate processing surface 900*f*, onto the back plate processing surface 900*f*, while the preparatory back panel 900 is moving at a constant speed in either way in the X axis direction, where the slant vapor deposition is performed at a constant vapor deposition speed in a constant direction with respect to each discharge cell on the back plate processing surface 900*f*, in a direction perpendicular to the extension direction of the Scn electrodes 121, using the barrier ribs 94 on the side of the Sus electrodes 122 as shielding walls before the target.

With the above-described simple manufacturing method, it is possible to form the phosphor-coating films 96 for discharge cells on the surface of the phosphor layers 95 in areas above the Scn electrode side slant portions 94*b*1 of the barrier ribs 94, using a material that is different from and has a higher value of the secondary electron emission coefficient γ than each phosphor material of the phosphor layers 95, and not to form the phosphor-coating films 96 on the bottom surface of the phosphor layers 95 in each dent and in areas of the phosphor layer surface having been formed on the Sus electrode side slant portions 94*b*2 of the barrier ribs 94. This enables the PDP with high image quality and high luminance to be manufactured in a stable manner and at low cost.

Also, in the above-described manufacturing method, the phosphor-coating films 96 are formed by a simple method in which a slant vapor deposition is performed in a direction perpendicular to the extension direction of the Scn electrodes 121 and at a slant angle maintaining substantially the slant angle θ with the back plate processing surface 900*f*, onto the back plate processing surface 900*f*, while the preparatory back panel 900 is moving at a constant speed, where, in respective discharge cells, the phosphor-coating films 96, which are made of a material that is different from and has a higher value of the secondary electron emission coefficient γ than each phosphor material of the phosphor layers 95, are formed on the surface of the phosphor layers 95 in areas above the Scn electrode side slant portions 94*b*1 of the barrier ribs 94 along the extension direction of the Scn electrodes 121, and the phosphor-coating films 96 are not formed on the bottom surface of the phosphor layers 95 in each dent and in areas of the phosphor layer surface having been formed on the slant portions 94*b*2 of the barrier ribs 94. Accordingly, when the PDP manufactured with this method is driven, the generation of the weak discharge during the reset period T1 is stabilized, the generation of the rest luminous points is restricted, and the reduction of the luminance during the sustain discharge is restricted, which produce advantages of high image quality and high luminance. This enables the PDP with such advantages to be manufactured in a stable manner and at low cost.

Embodiment12

Figure 24A:
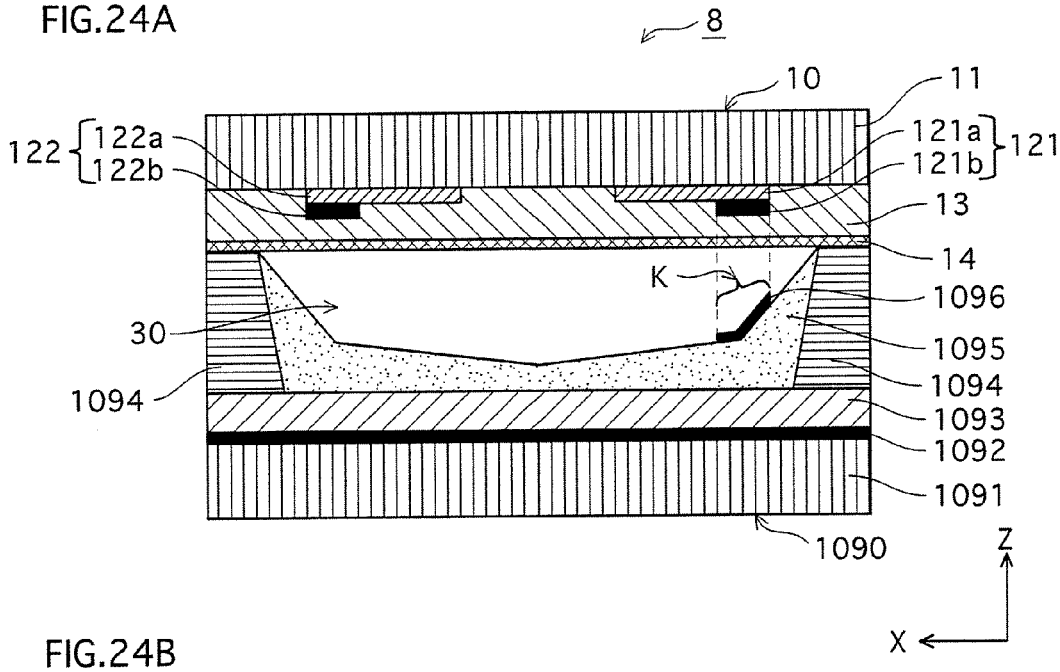
FIGS. 24A and 24B are conceptual cross sectional views of a discharge cell extracted from the PDP 8 in Embodiment 12.
Figure 24B:
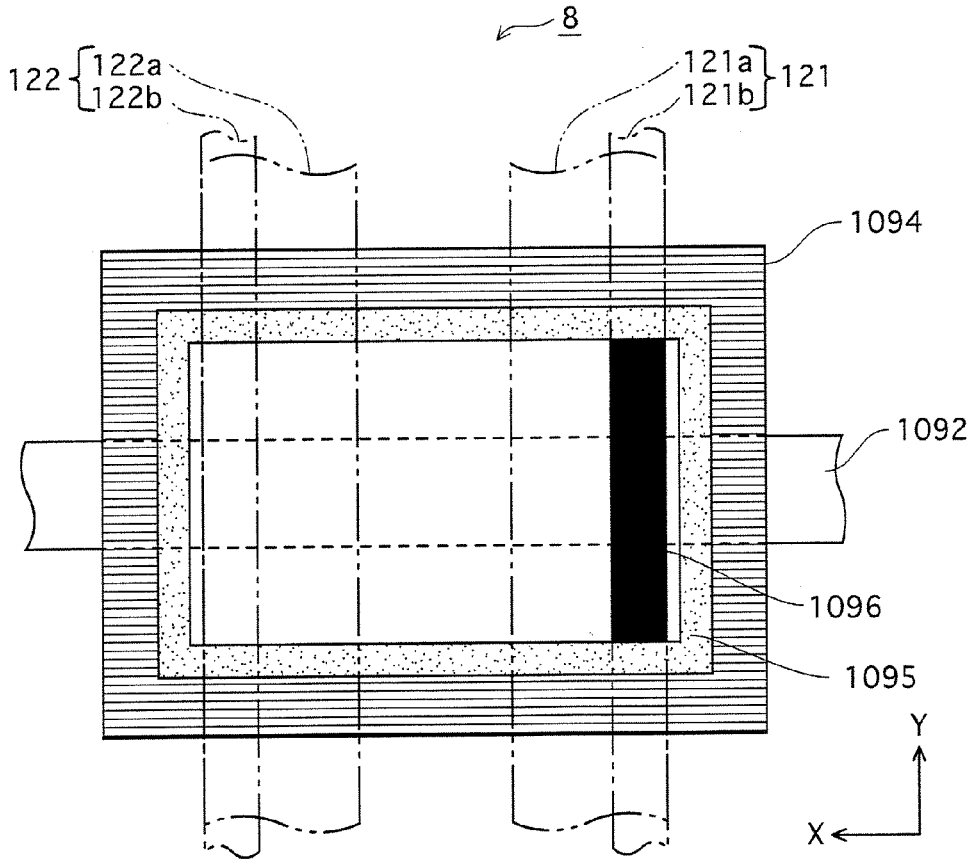

The structure of a PDP 8 of Embodiment 12 will be described with reference to FIGS. 24A and 24B. FIGS. 24A and 24B are a conceptual cross sectional view and a conceptual plan view showing a partial structure of the PDP 8 in Embodiment 12. The same reference numbers are assigned to the constitutional elements that are the same as those shown in FIG. 20C. Also, some of the reference numbers are omitted for the sake of convenience.

As shown in FIG. 24A, the PDP 8 of the present embodiment differs from the PDP 7 in the areas in which phosphor-coating films 1096 are formed. More specifically, the phosphor-coating films 1096 are formed on the surface of phosphor layers 1095 in areas K that are demarcated by the perpendicular lines that are dropped to the surface of back substrate 1091 from each of side edges of the bus lines 121*b* in the Scn electrodes 121.

As shown in FIG. 24B, the area K where the bus line 121*b* of the Scn electrode 121 overlaps, in a plan view, with the surface of the phosphor layer 1095 formed in the back panel is a slant surface with a very slow slant. As a result, the area K is remarkably wide. With this structure in which the phosphor-coating films 1096 are formed on the surface of the phosphor layer 1095 in the areas K, the phosphor-coating films 1096 greatly contribute to the reset discharge to be generated between the Scn electrodes 121 and the Dat electrodes 1092. This reduces the firing voltage in a stable manner, and stabilizes the generation of the weak discharge. It should be noted here that the phosphor-coating films 1096 can contribute to the discharge in the electric field in the slant direction even if the phosphor-coating films 1096 are formed so as not to overlap with the Scn electrode 121 or the Dat electrodes 1092 in a plan view.

Also, according to this structure, since the areas on the surface of the phosphor layer 1095 in which the phosphor-coating films 1096 are formed are limited to the areas K, the amount of ultraviolet rays absorbed by the phosphor-coating film 1096 is reduced, and thus the luminance is not reduced.

As described above, in the PDP 8 of the present embodiment, the phosphor-coating films 1096 made of a material containing MgO are provided on the surface of phosphor layers 1095 in the areas K. With this structure, it is possible to lower the firing voltage between the Scn electrodes 121 and the Dat electrodes 1092 when the phosphor layers 1095 side became a cathode during the reset period T1 when the PDP 8 is driven, and further stabilizes the generation of the weak discharge, even if the rate of partial pressure of Xe to the total pressure of the discharge gas in the discharge spaces 30 is increased.

Accordingly, in the PDP 8, the generation of the reset luminous points is further restricted and high-quality images are provided especially when the rate of partial pressure of Xe to the total pressure of the discharge gas is increased. Also, the areas on the surface of the phosphor layer 1095 in which the phosphor-coating films 1096 are formed are limited to the areas K, the amount of ultraviolet rays absorbed by the phosphor-coating film 1096 is further reduced compared with the PDP 7, and thus the luminance is not reduced. It is possible to improve the luminance depending on the rate of partial pressure of Xe to the total pressure of the discharge gas, especially when a high-Xe discharge gas is adopted.

It should be noted here that the advantageous effects of the present invention to restrict the generation of the reset luminous points and further restrict the reduction of the luminance are especially remarkable in the PDP in which the rate of partial pressure of Xe to the total pressure of the discharge gas has been increased. However, the advantageous effects are also obtained with the PDP in which the rate of partial pressure of Xe to the total pressure of the discharge gas is in the typical range of 5(%) to 6(%). Even in such conventional PDPs in which the rate of partial pressure of Xe to the total pressure of the discharge gas is in the typical range of 5(%) to 6(%) and in which the luminance is low or power consumption is high and a weak discharge is generated unstably in the reset period T1, it is possible to lower the firing voltage, stabilize the generation of the weak discharge during the reset period T1, and restrict the reduction in the luminance, by adopting the structure of the present embodiment, namely, by forming the phosphor-coating films 1096 on the surface of phosphor layers 1095 in areas above the Scn electrode side slant portions of the barrier ribs (see Embodiment 9 or the like), and not forming the phosphor-coating films 96 on the bottom surface of the phosphor layers 95 in the dents and in areas of the phosphor layer surface having been formed on the Sus electrode side slant portions (see Embodiment 9 or the like).

Also, in the PDP 8, the display electrode pairs 12 are formed on the main surface of the front substrate 11 as laminations of transparent electrode elements 121*a*, 122*a* and bus lines 121*b*, 122*b*. However, not limited to this, first the bus lines 121*b*, 122*b* may be formed on the main surface of the front substrate 11, and then the transparent electrode elements 121*a*, 122*a* may be formed thereon.

Embodiment13

Figure 25A:
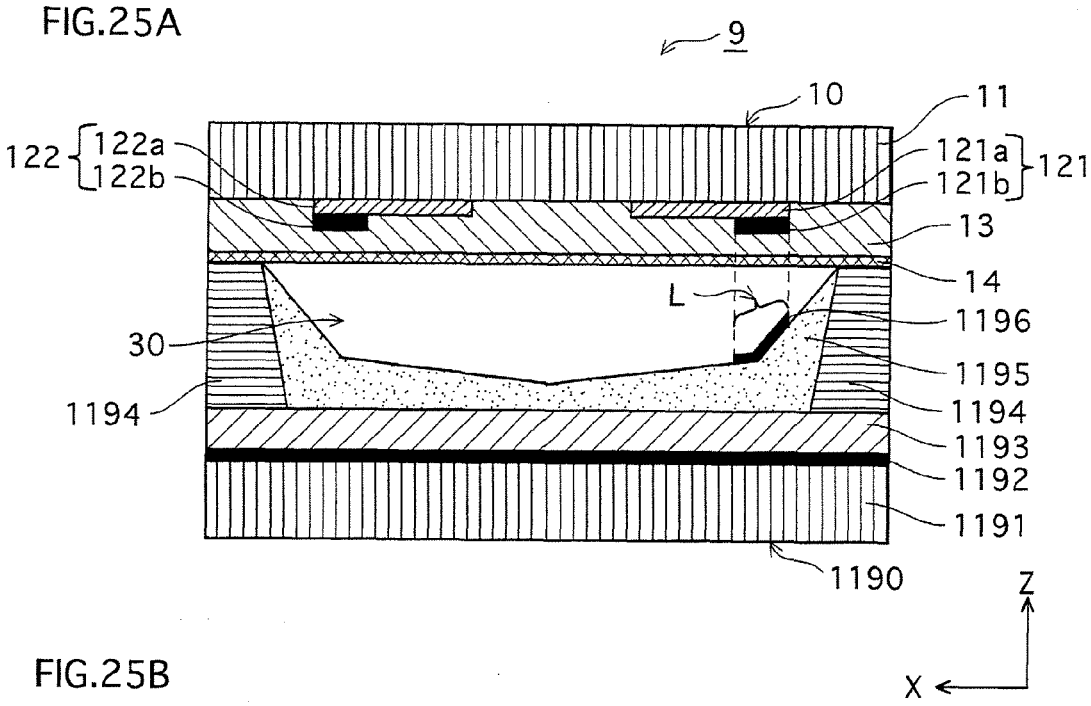
FIGS. 25A and 25B are conceptual cross sectional views of a discharge cell extracted from the PDP 9 in Embodiment 13.
Figure 25B:
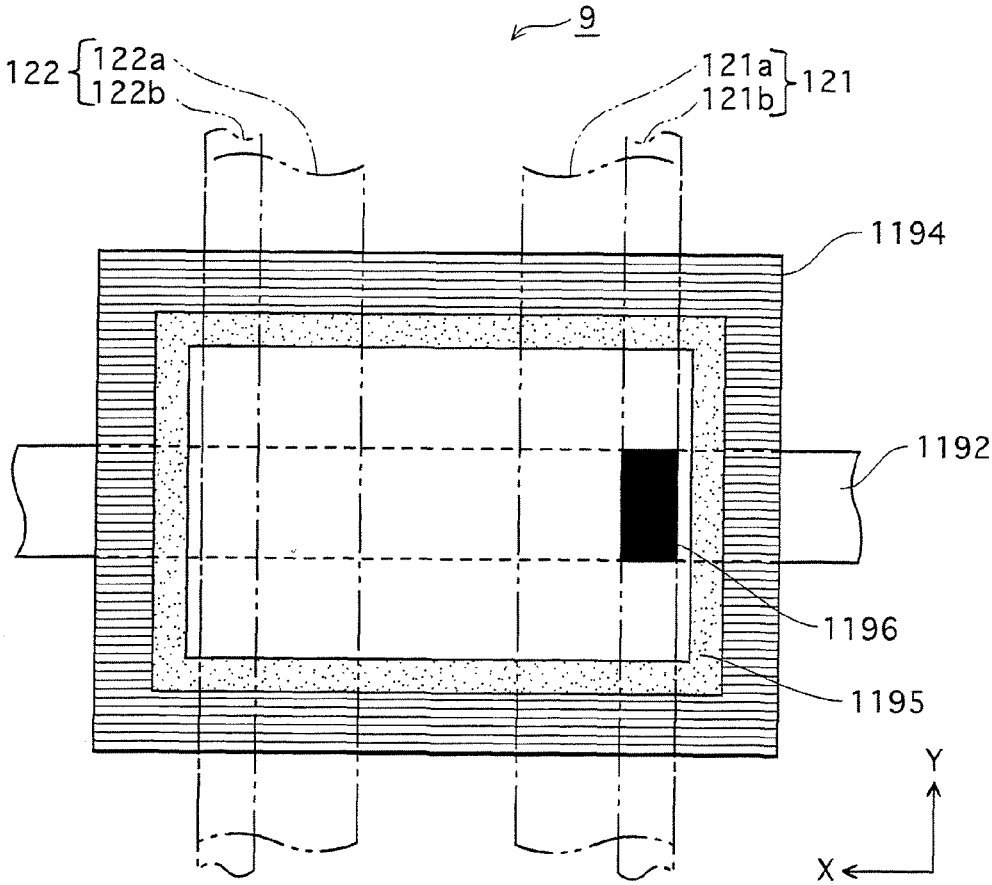

The structure of a PDP 9 of Embodiment 13 will be described with reference to FIGS. 25A and 25B. FIGS. 25A and 25B are a conceptual cross sectional view and a conceptual plan view showing a partial structure of the PDP 9 in Embodiment 13. The same reference numbers are assigned to the constitutional elements that are the same as those shown in FIGS. 20C, 24A and 24B. Also, some of the reference numbers are omitted for the sake of convenience.

As shown in FIG. 25A, in the PDP 9 of the present embodiment, as is the case with the PDP 8 of Embodiment 12, phosphor-coating films 1196 are formed on the surface of phosphor layers 1195 in areas that are demarcated by the perpendicular lines that are dropped to the surface of back substrate 1191 from each of side edges of the bus lines 121*b* in the Scn electrodes 121. However, the present embodiment is different from Embodiment 12 in that as shown in FIG. 25B, the areas in which the phosphor-coating films 1196 are formed are limited to areas E where the bus line 121*b* of the Scn electrode 121 overlaps with the Dat electrodes 1192 in an X-Y plan view.

The PDP 9 of the present embodiment having the above-described structure produces the same advantageous effects as the PDPs 7 and 8 in Embodiments 9 and 12, and is further preferable in terms of restricting the reduction of the luminance.

<Others>

In Embodiments 9-13 described above, barrier ribs in a form of parallel crosses are used as one example, as the barrier ribs 94, 1094, 1194 that demarcate discharge cells. However, not limited to those, barrier ribs demarcating the discharge cells may be meander barrier ribs that are meandering in a waveform, and the barrier ribs 94, 1094, 1194 arranged in the extension direction of the Scn electrodes 121 may be meandering in a waveform.

In Embodiments 9-13 described above, in the phosphor-coating film forming step, the phosphor-coating films 96, 1096, 1196 are formed by performing a slant vapor deposition onto the back plate processing surface 900*f* in a direction perpendicular to the extension direction of the Scn electrodes 121. However, the phosphor-coating films may be formed in a direction substantially perpendicular to the extension direction of the Scn electrodes 121, namely, in a direction perpendicular to the extension direction of the Scn electrodes 121 with an allowance of +30 degrees of angle.

In Embodiments 9-13 described above, MgO is adopted a the material of the phosphor-coating films 96, 1096, 1196. However, not limited to this, a metal oxide containing at least one of CaO, BaO, SrO, and ZnO may be used as the material. Also, any of these materials may contain other materials or impurities. These materials are different from the phosphor materials used for the phosphor layers 95, 1095, 1195, and have a higher value of the secondary electron emission coefficient γ than each phosphor material of the phosphor layers 95, and thus are effective as the materials of the phosphor-coating films 96, 1096, 1196 in the present invention.

The high γ members are made of the materials disclosed in Embodiments 1-13. However, it is also possible to use different materials for the high γ members in units of discharge cells in the PDP. For example, the discharge cells have different values of the secondary electron emission coefficient γ depending on the phosphor materials used for each color of R, G, and B. In such a case, it is possible to change the material or the coverage ratio of the high γ members depending on the phosphor material type used in the phosphor layers of discharge cells.

In Embodiments 10 and 11, an electron gun 577 is used to emit an electron beam as the slant vapor deposition is performed by the electron beam vapor deposition method. However, a plurality of electron guns may be used, as well. In this case, the plurality of electron guns are arranged in parallel with each other along the substrate, and electron beams are emitted from the electron guns toward corresponding material targets 695, that are also arranged in parallel with each other. This makes it possible to form the phosphor-coating films 96, 1096, 1196 more uniformly on the substrate, and to manufacture high-luminance, high-image-quality, large-screen, high-definition PDPs.

In Embodiments 10 and 11, the slant vapor deposition is performed by the electron beam vapor deposition method. However, other methods such as the sputtering method and the ion gun vapor deposition method may be used, as well.

Also, in Embodiments 10 and 11, in the phosphor-coating film forming step, the phosphor-coating films 96, 1096, 1196 are formed by performing a slant vapor deposition onto the preparatory back panel 900, maintaining substantially the slant angle θ that is formed with the normal line of the back plate processing surface 900*f*, while the preparatory back panel 900 is moving at a constant speed in either way in the X axis direction. However, not limited to this, the phosphor-coating films may be formed by performing the slant vapor deposition while the preparatory back panel 900 is moving in the X axis direction while, at the same time, the substrate is moving back and forth in the Y axis direction. This makes it possible to form the phosphor-coating films 96, 1096, 1196 more uniformly by the vapor deposition, and to manufacture more-uniform, high-image-quality, large-screen, and high-definition PDPs.

INDUSTRIAL APPLICABILITY

The present invention is applicable especially to large-scale televisions, high-definition televisions, large-scale display apparatuses and the like which require high luminous efficiency and high image quality.

The invention claimed is:

1. A plasma display panel including a first substrate and a second substrate arranged to face each other with a space therebetween, and including a phosphor layer in an area of the first substrate that faces toward the space, wherein part of a surface of the phosphor layer is covered with a high gamma member that is made of a material having a higher secondary electron emission coefficient than a material of the phosphor layer, and the high gamma member and a remaining area of the surface of the phosphor layer are exposed to the space, wherein the space that exists between the first substrate and the second substrate has been filled with a discharge gas that contains Xe, and a ratio of a partial pressure of Xe to a total pressure of the discharge gas is in a range of 5% to 100% inclusive, wherein a coverage ratio of the high gamma member to the surface of the phosphor layer is in a range of 3% to 20% inclusive.

2. The plasma display panel of claim 1, wherein the high gamma member is in a form of dots or stripes provided on the surface of the phosphor layer.

3. The plasma display panel of claim 1, wherein the high gamma member is in a form of particles attached to the surface of the phosphor layer.

4. The plasma display panel of claim 3, wherein a diameter of the particles is in a range of 0.05 μm to 20 μm inclusive.

5. The plasma display panel of claim 4, wherein a diameter of first particles among the particles is in a range of 0.05 μm to 1 μm inclusive.

6. The plasma display panel of claim 4, wherein a diameter of secondary particles among the particles is in a range of 2 μm to 20 μm inclusive.

7. The plasma display panel of claim 1, wherein a plurality of first electrodes are provided on a surface of the first substrate, and a dielectric layer and the phosphor layer have been stacked on the surface of the first substrate to cover the plurality of first electrodes, and the high gamma member is provided in a surface area that includes an area that is directly above the first electrodes.

8. The plasma display panel of claim 1, wherein the high gamma member is provided on the surface of the phosphor layer unevenly in area.

9. The plasma display panel of claim 8, wherein the high gamma member is provided on the surface of the phosphor layer unevenly in an area that corresponds to at least part of a surface of the first electrodes.

10. The plasma display panel of claim 9, wherein a plurality of first electrodes are provided on a surface of the first substrate, a plurality of pairs of second electrode and third electrode are provided on a surface of the second substrate in a direction perpendicular to an extension direction of the first electrodes, and the high gamma member is provided in areas that are three-dimensional intersections of the electrode pairs and the first electrodes, or in areas that correspond to the three-dimensional intersections.

11. The plasma display panel of claim 10, wherein one of the second electrode and the third electrode in each pair is a scan electrode and another is a sustain electrode, and the high gamma member is provided in areas that are three-dimensional intersections of the scan electrodes and the first electrodes, or in areas that correspond to the three-dimensional intersections.

12. The plasma display panel of claim 11, wherein a voltage, which is based on input image data, is applied to each of the first electrode, the second electrode, and the third electrode, and in a discharge cell that is selected based on the input image data, a write discharge is generated when a voltage is applied between the first electrode and the second electrode, and a wall charge is provided by the generation of the write discharge.

13. The plasma display panel of claim 1, wherein a plurality of data electrodes are provided on a surface of the first substrate, a plurality of pairs of scan electrode and sustain electrode are provided on a surface of the second substrate in parallel with each other in a direction perpendicular to an extension direction of the data electrodes, and the high gamma member exists on the surface of the phosphor layer in an area that is demarcated by perpendicular lines dropped to the surface of the first substrate from each of side edges of the scan electrode.

14. The plasma display panel of claim 13, wherein a dielectric layer is provided on the first substrate to cover the plurality of data electrodes, and on a surface of the dielectric layer, barrier ribs are provided to erect between adjacent data electrodes and to extend in parallel with the data electrodes, and have slant surfaces such that a distance between adjacent barrier ribs becomes smaller toward the surface of the first substrate, the phosphor layer is provided in each dent that is enclosed by the dielectric layer and the barrier ribs, and the high gamma member is provided on the surface of the phosphor layer in an area that includes the area demarcated by the perpendicular lines, and includes a surface of a portion of the phosphor layer that is provided on a slant surface of the barrier ribs.

15. The plasma display panel of claim 13, wherein a dielectric layer is provided on the first substrate to cover the plurality of data electrodes, and on a surface of the dielectric layer, first barrier ribs are provided to erect between adjacent data electrodes to extend in parallel with the data electrodes, and second barrier ribs are provided in a direction perpendicular to the first barrier ribs to extend between adjacent pairs of electrodes provided on the second substrate, the phosphor layer is provided in each dent that is enclosed by the dielectric layer, the first barrier ribs, and the second barrier ribs, the second barrier ribs have slant surfaces such that a distance between adjacent second barrier ribs becomes smaller toward the surface of the first substrate, and the high gamma member is provided on the surface of the phosphor layer in an area that includes the area demarcated by the perpendicular lines, and includes a surface of a portion of the phosphor layer that is provided on a slant surface of the second barrier ribs.

16. The plasma display panel of claim 13, wherein the high gamma member exists on the surface of the phosphor layer in an area that is demarcated by second perpendicular lines dropped to the surface of the second substrate from each of side edges of the data electrode.

17. The plasma display panel of claim 13, wherein an area of the surface of the phosphor layer that is demarcated by third perpendicular lines dropped to the surface of the first substrate from each of side edges of the sustain electrode is exposed to the space.

18. The plasma display panel of claim 13, wherein areas other than an area of the surface of the phosphor layer that is demarcated by the perpendicular lines are exposed to the space.

19. The plasma display panel of claim 13, wherein thickness of the high gamma member is in a range of 100 nm to 3 μm inclusive.

20. The plasma display panel of claim 1, wherein the high gamma member contains a metal oxide.

21. The plasma display panel of claim 20, wherein the metal oxide contains at least one of MgO, CaO, BaO, SrO, and ZnO.

22. The plasma display panel of claim 20, wherein the metal oxide contains MgO.

23. The plasma display panel of claim 1, wherein the high gamma member contains at least one of carbon nanotube, nanofiber, fullerene, and AlN.

24. The plasma display panel of claim 1, wherein the high gamma member contains at least one of Pt, Au, Pd, Mg, Ta, W, and Ni which are metal materials.

25. The plasma display panel of claim 1, wherein the high gamma member contains at least one of Pt and Mg.

26. A plasma display panel including a first substrate and a second substrate arranged to face each other with a space therebetween, and including a phosphor layer in an area of the first substrate that faces toward the space, wherein a surface of the phosphor layer is covered with a high gamma member being a film that is made of a material having a higher secondary electron emission coefficient than a material of the phosphor layer, and a film thickness of the high gamma member is in a range of 1 nm to 10 nm inclusive, wherein the space that exists between the first substrate and the second substrate has been filled with a discharge gas that contains Xe, and a ratio of partial pressure of Xe to a total pressure of the discharge gas is in a range of 5% to 100% inclusive, wherein a coverage ratio of the high gamma member to the surface of the phosphor layer is in a range of 3% to 20% inclusive.

27. The plasma display panel of claim 26, wherein the high gamma member contains a metal oxide.

28. The plasma display panel of claim 27, wherein the metal oxide contains MgO.

29. The plasma display panel of claim 27, wherein the metal oxide contains MgO, and the high gamma member has been formed from the metal oxide by an electron beam vapor deposition method.

30. The plasma display panel of claim 1, wherein the space that exists between the first substrate and the second substrate has been filled with a discharge gas that contains Xe, and a ratio of a partial pressure of Xe to a total pressure of the discharge gas is in a range of 5% to 50% inclusive.

31. A manufacturing method of a plasma display panel that includes a first substrate and a second substrate arranged to face each other with a space therebetween, and includes a phosphor layer in an area of the first substrate that faces toward the space, the manufacturing method comprising the steps of:

forming the phosphor layer on a surface of the first substrate that are to face the second substrate;

forming a high gamma member on part of a surface of the phosphor layer, using a material that has a higher secondary electron emission coefficient than a material of the phosphor layer, wherein in the high gamma member forming step, the high gamma member is formed so that both the high gamma member and a remaining area of the surface of the phosphor layer are exposed to the space;

sealing the first substrate and the second substrate at peripheries thereof; and filling a discharge gas that includes Xe in the space, wherein a ratio of a partial pressure of Xe to a total pressure of the discharge gas is in a range of 5% to 100% inclusive, wherein in the high gamma member forming step, the high gamma member is formed so that a coverage ratio of the high gamma member to the surface of the phosphor layer is in a range of 3% to 20% inclusive.

32. The manufacturing method of claim 31, wherein in the high gamma member forming step, the high gamma member is formed as a film in a form of dots or stripes on the surface of the phosphor layer, by any of a spray method, a dispersion accumulation method, and an electron beam vapor deposition method.

33. The manufacturing method of claim 31, wherein in the high gamma member forming step, the high gamma member is formed as a film in a form of dots or stripes on the surface of the phosphor layer, by attaching particles of the material to the surface of the phosphor layer using any of a dispersion method, a spray method, a dispersion accumulation method, and an electrodeposition method.

34. The manufacturing method of claim 31, wherein before the phosphor layer is formed in the phosphor layer forming step, a plurality of first electrodes are formed on the surface of the first substrate to be in parallel with each other, and a dielectric layer is formed to cover the first electrodes, and in the high gamma member forming step, the high gamma member is formed in a surface area that includes an area that is directly above the first electrodes.

35. The manufacturing method of claim 31, wherein before the phosphor layer is formed in the phosphor layer forming step, a plurality of first electrodes are formed on the surface of the first substrate to be in parallel with each other, and a dielectric layer is formed to cover the first electrodes, a plurality of pairs of second electrode and third electrode are formed on a surface of the second substrate in a direction perpendicular to an extension direction of the first electrodes, and in the high gamma member forming step, the high gamma member is formed in areas that include intersections of the first electrodes and the second electrodes.

36. The manufacturing method of claim 31, wherein in he high gamma member forming step, the high gamma member is formed using a material that contains MgO or SrO.

37. The manufacturing method of claim 31, wherein in the high gamma member forming step, the high gamma member is formed using a material that contains at least one of carbon nanotube, nanofiber, fullerene, and AlN.

38. The manufacturing method of claim 31, wherein in the high gamma member forming step, the high gamma member is formed using a material that contains Pt or Mg.

39. A manufacturing method of a plasma display panel that includes a first substrate and a second substrate arranged to face each other with a space therebetween, and includes a phosphor layer in an area of the first substrate that faces toward the space, the manufacturing method comprising the steps of:

forming the phosphor layer on a surface of the first substrate that are to face the second substrate;

forming a high gamma member as a film on a surface of the phosphor layer, using a material that has a higher secondary electron emission coefficient than a material of the phosphor layer, wherein in the high gamma member forming step, the high gamma member is formed so that a film thickness of the high gamma member is in a range of 1 nm to 10 nm inclusive;

sealing the first substrate and the second substrate at peripheries thereof; and filling a discharge gas that includes Xe in the space, wherein a ratio of a partial pressure of Xe to a total pressure of the discharge gas is in a range of 5% to 100% inclusive, wherein in the high gamma member forming step, the high gamma member is formed so that a coverage ratio of the high gamma member to the surface of the phosphor layer is in a range of 3% to 20% inclusive.

40. The manufacturing method of claim 39, wherein in the high gamma member forming step, the high gamma member is formed by an electron beam vapor deposition method.

41. The manufacturing method of claim 39, wherein in the high gamma member forming step, the high gamma member is formed using a material that contains MgO or SrO.

42. The manufacturing method of claim 31:

the discharge gas used in the discharge gas filling step has been adjusted such that a ratio of a partial pressure of Xe to a total pressure of the discharge gas is 50% or less.

43. A manufacturing method of a plasma display panel that includes a first substrate and a second substrate arranged to face each other with a space therebetween, and includes a phosphor layer in an area of the first substrate that faces toward the space, the manufacturing method comprising the steps of: forming the phosphor layer on a surface of the first substrate that are to face the second substrate; and forming a high gamma member on part of a surface of the phosphor layer, using a material that has a higher secondary electron emission coefficient than a material of the phosphor layer, wherein in the high gamma member forming step, the high gamma member is formed so that both the high gamma member and a remaining area of the surface of the phosphor layer are exposed to the space, wherein in the high gamma member forming step, the material of the high gamma member is electrically charged, the electrically charged material is accumulated in the part of the surface of the phosphor layer by static electricity, and wherein in the high gamma member forming step, the high gamma member is formed so that a coverage ratio of the high gamma member to the surface of the phosphor layer is in a range of 3% to 20% inclusive.

44. The manufacturing method of claim 43, wherein before the phosphor layer is formed in the phosphor layer forming step, a plurality of first electrodes are formed on the surface of the first substrate to be in parallel with each other, and a dielectric layer is formed to cover the first electrodes, and in the high gamma member forming step, the material of the high gamma member is charged positively, and the positively charged material is accumulated by applying a negative voltage to the first electrodes.

45. The manufacturing method of claim 44, wherein in the high gamma member forming step, the applied negative voltage becomes greater on a negative side over time.

46. The manufacturing method of claim 45, wherein in the high gamma member forming step, the applied negative voltage becomes greater on a negative side over time continuously or in a step-by-step manner.

47. The manufacturing method of claim 43, wherein in the high gamma member forming step, the electrically charged material is dispersed toward the surface of the phosphor layer.

48. The manufacturing method of claim 43, wherein in the high gamma member forming step, the material of the high gamma member is electrically charged in plasma, and the electrically charged material is accumulated by an electron beam vapor deposition.

49. The manufacturing method of claim 43, wherein in the high gamma member forming step, the material of the high gamma member is electrically charged by eradiating a plasma beam onto the material, and the electrically charged material is accumulated as a film.

50. The manufacturing method of claim 43, wherein in the high gamma member forming step, the material of the high gamma member contains at least MgO.

51. The manufacturing method of claim 31, wherein before the phosphor layer is formed in the phosphor layer forming step, a plurality of data electrodes are formed on a surface of the first substrate to be in parallel with each other, then a dielectric layer is formed to cover the data electrodes, and on a surface of the dielectric layer, barrier ribs are formed to erect between adjacent data electrodes and to extend in parallel with the data electrodes, and have slant surfaces such that a distance between adjacent barrier ribs becomes smaller toward the surface of the first substrate, in the phosphor layer forming step, the phosphor layer is formed on inner surfaces of each dent that is enclosed by the dielectric layer and the barrier ribs, a plurality of pairs of scan electrode and sustain electrode are formed on a surface of the second substrate in parallel with each other in a direction perpendicular to an extension direction of the data electrodes, and the high gamma member is formed by a slant vapor deposition method on the surface of the phosphor layer in areas on the slant surfaces with an angle perpendicular to perpendicular lines that are dropped to the surface of the first substrate from each of side edges of the scan electrode.

52. The manufacturing method of claim 31, wherein a plurality of pairs of scan electrode and sustain electrode are formed on a surface of the second substrate in parallel with each other in a direction perpendicular to an extension direction of the data electrodes, before the phosphor layer is formed in the phosphor layer forming step, a plurality of data electrodes are formed on a surface of the first substrate to be in parallel with each other, then a dielectric layer is formed to cover the data electrodes, and on a surface of the dielectric layer, first barrier ribs are formed to erect between adjacent data electrodes to extend in parallel with the data electrodes, and second barrier ribs are formed in a direction perpendicular to the first barrier ribs to extend between adjacent pairs of electrodes formed on the second substrate, in the phosphor layer forming step, the phosphor layer is formed on inner surfaces of each dent that is enclosed by the dielectric layer, the first barrier ribs, and the second barrier ribs, the second barrier ribs have slant surfaces such that a distance between adjacent second barrier ribs becomes smaller toward the surface of the first substrate, and the high gamma member is formed by a slant vapor deposition method on the surface of the phosphor layer in areas on the slant surfaces of the second barrier ribs with an angle perpendicular to perpendicular lines that are dropped to the surface of the first substrate from each of side edges of the scan electrode.

53. The manufacturing method of claim 51, wherein in the high gamma member forming step, the first substrate is transported in a direction along a main surface of the first substrate while the angle is maintained.

54. The manufacturing method of claim 51, wherein in the high gamma member forming step, the high gamma member is formed as a film by an electron vapor deposition method, using a metal oxide material containing MgO.

55. The manufacturing method of claim 51, wherein in the high gamma member forming step, the high gamma member is formed as a film whose thickness is in a range of 100 nm to 3 μm inclusive.

56. The manufacturing method of claim 51, wherein in the high gamma member forming step, areas other than an area of the surface of the phosphor layer that is demarcated by the perpendicular lines are maintained to be exposed to the space.

57. The plasma display panel of claim 26, wherein the space that exists between the first substrate and the second substrate has been filled with a discharge gas that contains Xe, and a ratio of a partial pressure of Xe to a total pressure of the discharge gas is in a range of 5% to 50% inclusive.

58. The manufacturing method of claim 39 wherein the discharge gas used in the discharge gas filling step has been adjusted such that a ratio of a partial pressure of Xe to a total pressure of the discharge gas is 50% or less.

59. The manufacturing method of claim 54, wherein in the high gamma member forming step, the first substrate is transported in a direction along a main surface of the first substrate while the angle is maintained.

60. The manufacturing method of claim 54, wherein in the high gamma member forming step, the high gamma member is formed as a film by an electron vapor deposition method, using a metal oxide material containing MgO.

61. The manufacturing method of claim 54, wherein in the high gamma member forming step, the high gamma member is formed as a film whose thickness is in a range of 100 nm to 3 μm inclusive.

62. The manufacturing method of claim 52, wherein in the high gamma member forming step, areas other than an area of the surface of the phosphor layer that is demarcated by the perpendicular lines are maintained to be exposed to the space.

63. The plasma display panel of claim 1 wherein a coverage ratio of a high gamma member, formed using a material containing Mg, to the surface of the phosphor layer is in a range of 3% to 20%.

64. The manufacturing method of claim 43, wherein a coverage ratio of a high gamma member, formed using a material containing Mg, to the surface of the phosphor layer is in a range of 3% to 20%.

* * * * *